US008111229B2

(12) United States Patent
Song et al.

(10) Patent No.: US 8,111,229 B2
(45) Date of Patent: Feb. 7, 2012

(54) LIQUID CRYSTAL DISPLAY AND DRIVING METHOD THEREOF

(75) Inventors: Hong Sung Song, Gyeongsangbuk-do (KR); Ju Young Lee, Gyeongsangbuk-do (KR); Woong Ki Min, Daegu (KR); Dong Hoon Cha, Gyeongsangbuk-do (KR); Sun Young Choi, Seoul (KR); Su Hyuk Jang, Daegu (KR)

(73) Assignee: LG Display Co., Ltd., Seoul (KR)

( * ) Notice: Subject to any disclaimer, the term of this patent is extended or adjusted under 35 U.S.C. 154(b) by 1027 days.

(21) Appl. No.: 12/003,666

(22) Filed: Dec. 28, 2007

(65) Prior Publication Data

US 2008/0170025 A1 Jul. 17, 2008

(30) Foreign Application Priority Data

| | | |
|---|---|---|
| Jan. 15, 2007 | (KR) | 10-2007-0004246 |
| Jan. 15, 2007 | (KR) | 10-2007-0004251 |
| Jan. 29, 2007 | (KR) | 10-2007-0008895 |
| May 16, 2007 | (KR) | 10-2007-0047787 |
| May 30, 2007 | (KR) | 10-2007-0052679 |
| Jun. 1, 2007 | (KR) | 10-2007-0053959 |

(51) Int. Cl.
*G09G 3/36* (2006.01)

(52) U.S. Cl. ..... 345/96; 345/99

(58) Field of Classification Search ..... 345/50, 345/53, 54, 87, 94, 95, 96, 98, 204, 209
See application file for complete search history.

(56) References Cited

U.S. PATENT DOCUMENTS

| | | | | |
|---|---|---|---|---|
| 2002/0089485 | A1* | 7/2002 | Youn | 345/99 |
| 2004/0104873 | A1 | 6/2004 | Kang et al. | |
| 2004/0178981 | A1* | 9/2004 | Asada et al. | 345/96 |
| 2005/0168425 | A1 | 8/2005 | Nakamoto et al. | |
| 2005/0264508 | A1 | 12/2005 | Nakamura et al. | |

FOREIGN PATENT DOCUMENTS

| | | | |
|---|---|---|---|
| JP | 4-204490 | A | 7/1992 |
| JP | 7-44137 | A | 2/1995 |
| JP | 2002-196731 | A | 7/2002 |
| JP | 2005-215317 | A | 8/2005 |
| JP | 2005-266803 | | 9/2005 |
| JP | 2005-345603 | A | 12/2005 |
| KR | 1998-024357 | | 7/1998 |
| KR | 10-2004-0049348 | | 6/2004 |
| KR | 10-2005-0000644 | | 1/2005 |

* cited by examiner

*Primary Examiner* — Amare Mengistu
*Assistant Examiner* — Dmitriy Bolotin
(74) *Attorney, Agent, or Firm* — Morgan, Lewis & Bockius LLP

(57) ABSTRACT

A liquid crystal display device includes a liquid crystal display panel including a plurality of data lines, a plurality of gate lines, and a plurality of liquid crystal cells, the plurality of liquid crystal cells associated to a first and second liquid crystal cell groups, a data drive circuit to supply a data voltage to the data lines in response to a polarity control signal, a gate drive circuit to supply a scan pulse to the gate lines, and a polarity control circuit to generate different polarity control signals for each frame period and to control data voltage frequencies of the first and second liquid crystal cell groups to be different from each other.

11 Claims, 63 Drawing Sheets

Fig. 35

H2V1 (N)th Frame HINV:H

| | C1 | C2 | C3 | C4 | C5 | C6 | C7 | C8 |
|---|---|---|---|---|---|---|---|---|
| R1 | + | − | − | + | + | − | − | + |
| R2 | − | + | + | − | − | + | + | − |
| R3 | + | − | − | + | + | − | − | + |
| R4 | − | + | + | − | − | + | + | − |
| R5 | + | − | − | + | + | − | − | + |
| R6 | − | + | + | − | − | + | + | − |
| R7 | + | − | − | + | + | − | − | + |

H2V1 (N+1)th Frame HINV:L

| | C1 | C2 | C3 | C4 | C5 | C6 | C7 | C8 |
|---|---|---|---|---|---|---|---|---|
| R1 | + | + | − | − | + | + | − | − |
| R2 | − | − | + | + | − | − | + | + |
| R3 | + | + | − | − | + | + | − | − |
| R4 | − | − | + | + | − | − | + | + |
| R5 | + | + | − | − | + | + | − | − |
| R6 | − | − | + | + | − | − | + | + |
| R7 | + | + | − | − | + | + | − | − |

H2V1 (N+2)th Frame HINV:H

| | C1 | C2 | C3 | C4 | C5 | C6 | C7 | C8 |
|---|---|---|---|---|---|---|---|---|
| R1 | − | + | + | − | − | + | + | − |
| R2 | + | − | − | + | + | − | − | + |
| R3 | − | + | + | − | − | + | + | − |
| R4 | + | − | − | + | + | − | − | + |
| R5 | − | + | + | − | − | + | + | − |
| R6 | + | − | − | + | + | − | − | + |
| R7 | − | + | + | − | − | + | + | − |

H2V1 (N+3)th Frame HINV:L

| | C1 | C2 | C3 | C4 | C5 | C6 | C7 | C8 |
|---|---|---|---|---|---|---|---|---|
| R1 | − | − | + | + | − | − | + | + |
| R2 | + | + | − | − | + | + | − | − |
| R3 | − | − | + | + | − | − | + | + |
| R4 | + | + | − | − | + | + | − | − |
| R5 | − | − | + | + | − | − | + | + |
| R6 | + | + | − | − | + | + | − | − |
| R7 | − | − | + | + | − | − | + | + |

POL2 H L

▨ : FIRST LIQUID CRYSTAL CELL GROUP

□ : SECOND LIQUID CRYSTAL CELL GROUP

Fig. 42

H2V2 (N)th Frame HINV:H

| POL2 | C1 | C2 | C3 | C4 | C5 | C6 | C7 | C8 |
|---|---|---|---|---|---|---|---|---|
| R1 | + | − | − | + | + | − | − | + |
| R2 | + | − | − | + | + | − | − | + |
| R3 | − | + | + | − | − | + | + | − |
| R4 | − | + | + | − | − | + | + | − |
| R5 | + | − | − | + | + | − | − | + |
| R6 | + | − | − | + | + | − | − | + |
| R7 | − | + | + | − | − | + | + | − |

H2V2 (N+1)th Frame HINV:L

| POL2 | C1 | C2 | C3 | C4 | C5 | C6 | C7 | C8 |
|---|---|---|---|---|---|---|---|---|
| R1 | + | + | − | − | + | + | − | − |
| R2 | + | + | − | − | + | + | − | − |
| R3 | − | − | + | + | − | − | + | + |
| R4 | − | − | + | + | − | − | + | + |
| R5 | + | + | − | − | + | + | − | − |
| R6 | + | + | − | − | + | + | − | − |
| R7 | − | − | + | + | − | − | + | + |

H2V2 (N+2)th Frame HINV:H

| POL2 | C1 | C2 | C3 | C4 | C5 | C6 | C7 | C8 |
|---|---|---|---|---|---|---|---|---|
| R1 | − | + | + | − | − | + | + | − |
| R2 | − | + | + | − | − | + | + | − |
| R3 | + | − | − | + | + | − | − | + |
| R4 | + | − | − | + | + | − | − | + |
| R5 | − | + | + | − | − | + | + | − |
| R6 | − | + | + | − | − | + | + | − |
| R7 | + | − | − | + | + | − | − | + |

H2V2 (N+3)th Frame HINV:L

| POL2 | C1 | C2 | C3 | C4 | C5 | C6 | C7 | C8 |
|---|---|---|---|---|---|---|---|---|
| R1 | − | − | + | + | − | − | + | + |
| R2 | − | − | + | + | − | − | + | + |
| R3 | + | + | − | − | + | + | − | − |
| R4 | + | + | − | − | + | + | − | − |
| R5 | − | − | + | + | − | − | + | + |
| R6 | − | − | + | + | − | − | + | + |
| R7 | + | + | − | − | + | + | − | − |

: FIRST LIQUID CRYSTAL CELL GROUP

: SECOND LIQUID CRYSTAL CELL GROUP

LIQUID CRYSTAL DISPLAY AND DRIVING METHOD THEREOF

This application claims the benefit of the Korean Patent Application Nos. P07-004246 filed Jan. 15, 2007, P07-004251 filed Jan. 15, 2007, P07-008895 filed Jan. 29, 2007, P07-047787 filed May 16, 2007, P07-052679 filed May 30, 2007, and P07-053959 filed Jun. 1, 2007, which are hereby incorporated by reference.

BACKGROUND OF THE INVENTION

1. Field of the Invention

The present invention relates to a liquid crystal display device, and more particularly to a liquid crystal display device that is adaptive for increasing display quality by preventing flickers and DC image sticking, and a driving method thereof.

2. Discussion of the Related Art

A liquid crystal display device controls the light transmittance of liquid crystal cells in accordance with video signals, thereby displaying a picture. An active matrix type liquid crystal display device actively controls the displayed images by switching data voltages supplied to a thin film transistor TFT formed at each liquid crystal cell Clc, as shown in FIG. 1, thus increasing the display quality of motion pictures. As shown in FIG. 1, a reference numeral "Cst" represents a storage capacitor for keeping data voltages charged in the liquid crystal cell Clc. "DL" represents a data line to which the data voltages are supplied, and "GL" represents a gate line to which scan voltages are supplied to activate the thin film transistor TFT.

The liquid crystal display device is driven by an inversion method where polarities are inverted between adjacent liquid crystal cells and between successive frame periods, in order to reduce the deterioration of liquid crystals and to decrease DC offset components. If any one polarity between two polarities of the data voltage is dominantly supplied for a long time, a residual image is generated. Such a residual image, referred to as "DC image sticking," is created because a voltage of the same polarity is repeatedly charged in the liquid crystal cell.

An example of when DC image sticking occurs is when interlaced data voltages are supplied to the liquid crystal display device. An interlace method applies odd-numbered line data voltages to liquid crystal cells in odd-numbered horizontal lines during odd-numbered frame periods and even-numbered line data voltages to liquid crystal cells in even-numbered horizontal line during even-numbered frame periods.

FIG. 2 illustrates a waveform diagram representing an example of data voltages supplied to a liquid crystal cell Clc using an interlace method. The data voltages of FIG. 2 represent data voltages supplied to any one of the liquid crystal cells disposed on an odd-numbered horizontal line.

As shown in FIG. 2, using the interlace method, high data voltages (i.e., image data) are supplied to a liquid crystal cell Clc (not shown) disposed on an odd-numbered horizontal lines only during odd-numbered frame periods. In addition, because the polarity of the data voltages alternate every frame period, the liquid crystal cell Clc is supplied with high voltages that are positive only during odd-numbered frame periods and with low voltages (i.e., no image data) during even-numbered frame periods. Because of this, the positive data voltage, like the waveform shown in the box of FIG. 2, becomes more dominant than the negative data voltage over a four-frame period, for example, thus creating a DC image sticking phenomenon.

FIG. 3 shows exemplary images of an experimental result of a DC image sticking phenomenon generated due to interlace data. For example, if an original picture (e.g., left image of FIG. 3) is displayed on a liquid crystal display panel using the interlace method for a fixed period of time, a DC image sticking pattern of the original picture (e.g., right image of FIG. 3) dimly appears when a data voltage of an intermediate gray level (e.g., gray level of 127) is supplied to all of the liquid crystal cells Clc of the liquid crystal display panel after the original picture.

As another example of when the DC image sticking occurs is when an image is moved or scrolled at a fixed speed because the image data voltage of the same polarity is repeatedly accumulated in the liquid crystal cell Clc based on the scroll speed (or moving speed) and the size of a picture which is scrolled (or moved). FIG. 4 shows exemplary images of an experimental result of a DC image sticking phenomenon generated when moving an oblique line or character pattern at a fixed speed.

In a liquid crystal display device, the display quality of motion pictures is degraded not only because of the DC image sticking, but also because of a flicker phenomenon caused by a visual perception of difference in brightness. Accordingly, in order to improve the display quality of a liquid crystal display device, the DC image sticking phenomenon and the flicker phenomenon need to be prevented or minimized.

SUMMARY OF THE INVENTION

Accordingly, the present invention is directed to a liquid crystal device and a driving method thereof that substantially obviates one or more problems due to limitations and disadvantages of the related art.

An object of the present invention is to provide a liquid crystal device and a driving method thereof for improving display quality by preventing DC image sticking and flicker.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes a liquid crystal display panel including a plurality of data lines, a plurality of gate lines, and a plurality of liquid crystal cells, the plurality of liquid crystal cells associated to a first and second liquid crystal cell groups, a data drive circuit to supply a data voltage to the data lines in response to a polarity control signal, a gate drive circuit to supply a scan pulse to the gate lines, and a polarity control circuit to generate different polarity control signals for each frame period and to control data voltage frequencies of the first and second liquid crystal cell groups to be different from each other.

In another aspect, a liquid crystal display device includes a liquid crystal display panel including a plurality of data lines, a plurality of gate lines, and a plurality of liquid crystal cells, a logic circuit to generate a first polarity control signal, a second polarity control signal that is different from the first polarity control signal, a third polarity control signal having an opposite phase as that of the first polarity control signal, and a fourth polarity control signal having an opposite phase as that of the second polarity control signal, and to generate a horizontal output inversion signal, logic of which is inverted for each frame period, a data drive circuit to shift a polarity of a data voltage that is to be supplied to the data lines in a vertical direction of the liquid crystal cells for each frame period in response to the polarity control signals, and to shift the polarity of the data voltage in a horizontal direction for each frame period in response to the horizontal output inversion signal, and a gate drive circuit to supply a scan pulse to the gate lines.

In another aspect, a liquid crystal display device includes a liquid crystal display panel including a plurality of data lines, a plurality of gate lines, and a plurality of liquid crystal cells, an image analyzing circuit to analyze digital video data of an input image, a logic circuit to generate a first polarity control signal, a second polarity control signal that is different from the first polarity control signal, a third polarity control signal having an opposite phase as that of the first polarity control signal, and a fourth polarity control signal having an opposite phase as that of the second polarity control signal, and to generate a horizontal output inversion signal, logic of which is inverted for each frame period, when data with which DC image sticking is likely to occur is input in accordance with an output of the image analyzing circuit, a data drive circuit to shift a polarity of a data voltage that is to be supplied to the data lines in a vertical direction for each frame period in response to the polarity control signals, and to shift the polarity of the data voltage in a horizontal direction in response to the horizontal output inversion signal, and a gate drive circuit to supply a scan pulse to the gate lines.

In yet another aspect, a liquid crystal display device includes a liquid crystal display panel including a plurality of data lines, a plurality of gate lines, and a plurality of liquid crystal cells, a control circuit to generate a polarity control signal, logic of which is periodically inverted, and a horizontal output inversion signal to shift a polarity of the data voltage in a horizontal direction for each frame period, a data drive circuit to invert the polarity of the data voltage for each horizontal period or every two horizontal periods in response to the polarity control signal and to shift the polarity of the data voltage in the horizontal direction in response to the horizontal output inversion signal, and to supply the data voltage to the data lines, and a gate drive circuit to a supply scan pulse to the gate lines.

In yet another aspect, a liquid crystal display device includes a liquid crystal display panel including a plurality of data lines, a plurality of gate, and a plurality of liquid crystal cells, an image analyzing circuit to analyze digital video data of an input image, a control circuit to generate a polarity control signal, logic of which is periodically inverted, and a horizontal output inversion signal to shift a polarity of a data voltage in a horizontal direction for each frame period when the image analyzing circuit determines that interlace data is input as an image, a data drive circuit to invert the polarity of the data voltage for each horizontal period in response to the polarity control signal and to shift the polarity of the data voltage in the horizontal direction in response to the horizontal output inversion signal, and to supply the data voltage to the data lines, and a gate drive circuit to supply a scan pulse to the gate lines.

In still yet another aspect, a method of driving a liquid crystal display device includes the steps of generating a polarity control signal that is different for each frame period so as to variably control a data voltage frequency to be supplied to first and second liquid crystal cell groups that co-exist in a liquid crystal display panel, supplying a data voltage to data lines of the liquid crystal display panel in response to the polarity control signal, and supplying a scan pulse to gate lines of the liquid crystal display panel.

In still yet another aspect, a method of driving a liquid crystal display device having a liquid crystal display panel including a plurality of data lines, a plurality of gate lines, and a plurality of liquid crystal cells, includes the steps of generating a first polarity control signal, a second polarity control signal that is different from the first polarity control signal, a third polarity control signal having an opposite phase as that of the first polarity control signal, and a fourth polarity control signal having an opposite phase as that of the second polarity control signal, and a horizontal output inversion signal, logic of which is inverted for each frame period, shifting a polarity of a data voltage that is to be supplied to the data lines in a vertical direction for each frame period in response to the polarity control signals, and shifting the polarity of the data voltage in a horizontal direction for each frame period in response to the horizontal output inversion signal, and supplying a scan pulse to the gate lines.

In still yet another aspect, a method of driving a liquid crystal display device having a liquid crystal display panel including a plurality of data lines, a plurality of gate lines, and a plurality of liquid crystal cells, includes the steps of analyzing digital video data of an input image, generating a first polarity control signal, a second polarity control signal that is different from the first polarity control signal, a third polarity control signal having an opposite phase as that of the first polarity control signal, a fourth polarity control signal having an opposite phase as that of the second polarity control signal, and a horizontal output inversion signal, logic of which is inverted for each frame period when data with which DC image sticking is likely to occur is input, shifting a polarity of a data voltage that is to be supplied to the data lines in a vertical direction for each frame period in response to the polarity control signals, and shifting the polarity of the data voltage in a horizontal direction for each frame period in response to the horizontal output inversion signal, and supplying a scan pulse to the gate lines.

In still yet another aspect, a method of driving a liquid crystal display device having a liquid crystal display panel including a plurality of data lines, a plurality of gate lines, and a plurality of liquid crystal cells, includes the steps of generating a polarity control signal, logic of which is periodically inverted, generating a horizontal output inversion signal to shift a polarity of the data voltage in a horizontal direction for each frame period, inverting the polarity of the data voltage for each horizontal period or every two horizontal periods in response to the polarity control signal and shifting the polarity of the data voltage in the horizontal direction in response to the horizontal output inversion signal, and supplying the data voltage to the data lines, and supplying a scan pulse to the gate lines.

In still yet another aspect, a method of driving a liquid crystal display device having a liquid crystal display panel including a plurality of data lines, a plurality of gate lines, and a plurality of liquid crystal cells, includes the steps of analyzing digital video data of an input image, generating a polarity control signal, logic of which is periodically inverted, generating a horizontal output inversion signal to shift a polarity of the data voltage in a horizontal direction for each frame period when interlace data is input as an image, inverting the polarity of the data voltage for each horizontal period in response to the polarity control signal and shifting the polarity of the data voltage in the horizontal direction in response to the horizontal output inversion signal, and supplying the data voltage to the data lines, and supplying a scan pulse to the gate lines.

In another aspect, a liquid crystal display device includes a liquid crystal display panel including a plurality of data lines, a plurality of gate lines, and a plurality of liquid crystal cells, a data drive circuit to supply a data voltage to the data lines in response to a polarity control signal, a gate drive circuit to supply a scan pulse to the gate lines, and a controller to generate the polarity control signal differently for each frame period, wherein the liquid crystal display panel includes first and second liquid crystal cell groups, the first and second liquid crystal cells having different data drive frequencies within two frame periods, the first and second liquid crystal cell groups alternating in vertical and horizontal directions and are changed with each other for each frame period.

In another aspect, a method of driving a liquid crystal display device having a liquid crystal display panel including a plurality of data lines, a plurality of gate lines, and a plurality of liquid crystal cells, includes the steps of supplying a data voltage to the data lines in response to a polarity control signal, supplying a scan pulse to the gate lines, and generating the polarity control signal differently for each frame period, wherein the liquid crystal display panel includes first and second liquid crystal cell groups, the first and second liquid crystal cell groups having different data drive frequencies within two frame periods, the first and second liquid crystal cell groups alternating in vertical and horizontal directions and are changed with each other for each frame period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 35 is a diagram illustrating an exemplary polarity pattern of data voltages supplied to a liquid crystal display device according to a seventh embodiment of the present invention;

FIG. 42 is a diagram illustrating another exemplary polarity pattern of the data voltages supplied to the liquid crystal display device according to the seventh and eighth embodiments of the present invention.

DETAILED DESCRIPTION OF THE EMBODIMENTS

Reference will now be made in detail to the embodiments of the present invention, examples of which are illustrated in the accompanying drawings.

In accordance with an exemplary embodiment of the present invention, a method for driving an liquid crystal display device includes using a data voltage polarity frequency of a first liquid crystal cell group that is different than a data voltage polarity frequency of a second liquid crystal cell group within two frame periods, and the first and second liquid crystal cell groups co-exist in a liquid crystal display panel. The first liquid crystal cell group is driven at a low data voltage polarity frequency in order to prevent a DC image sticking By comparison, the second liquid crystal cell group is driven at a relatively high data voltage polarity frequency in order to prevent flickers that might be generated by the first liquid crystal cell group. Change in the polarity pattern of a data voltage charged in the first liquid crystal cell group corresponds to the data voltage polarity frequency of the first liquid crystal cell group, and change in the polarity pattern of a data voltage charged in the second liquid crystal cell group corresponds to the data voltage polarity frequency of the second liquid crystal cell group. The polarity patterns of the data voltages charged in the first and second liquid crystal cell groups are changed for each frame and the same polarity pattern is repeated for the N (N is an integer of not less than 4) frame periods. The following embodiment will be explained by taking N=4 as an example.

Figure 1:
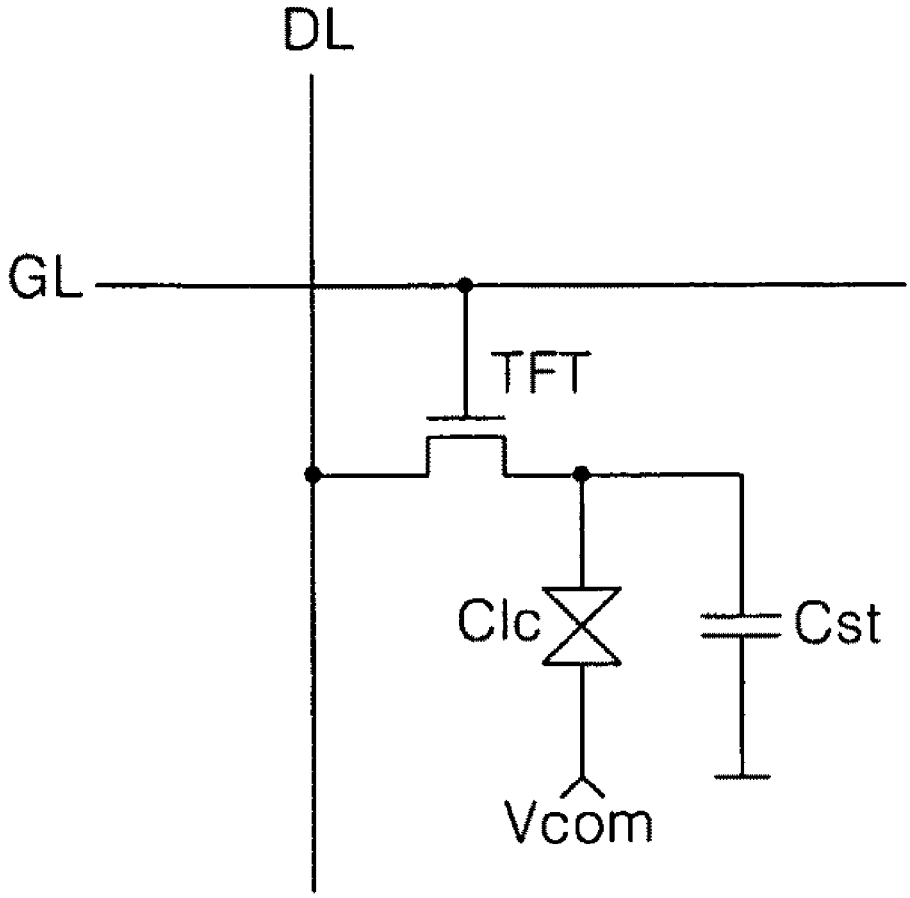
Fig. 1 [Related Art]
FIG. 1 is a circuit diagram showing a liquid crystal cell of a liquid crystal display device.
Figure 2:
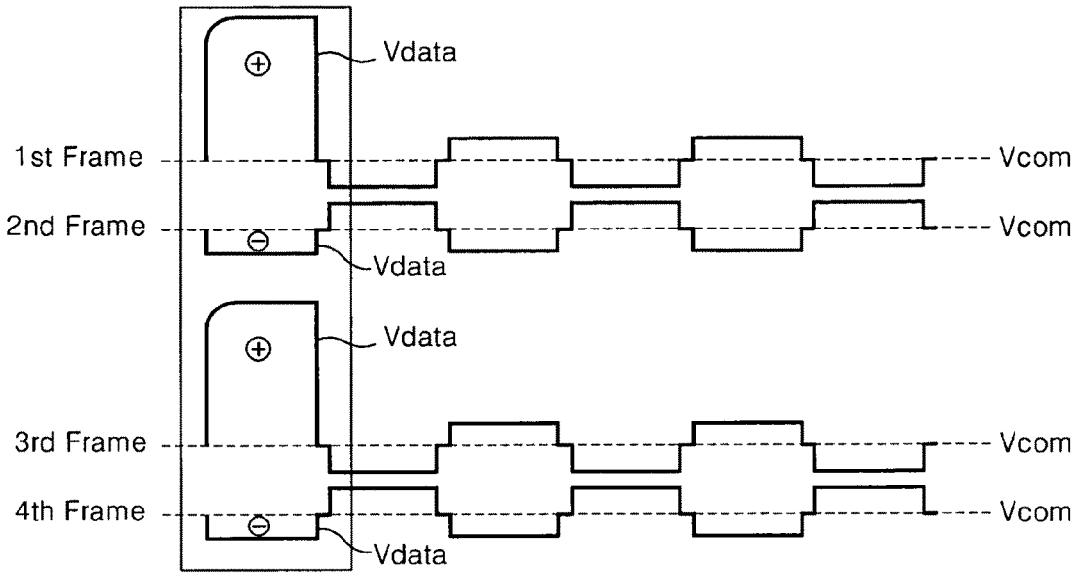
Fig. 2 [Related Art]
FIG. 2 is a waveform diagram showing an example of interlace data.
Figure 3:
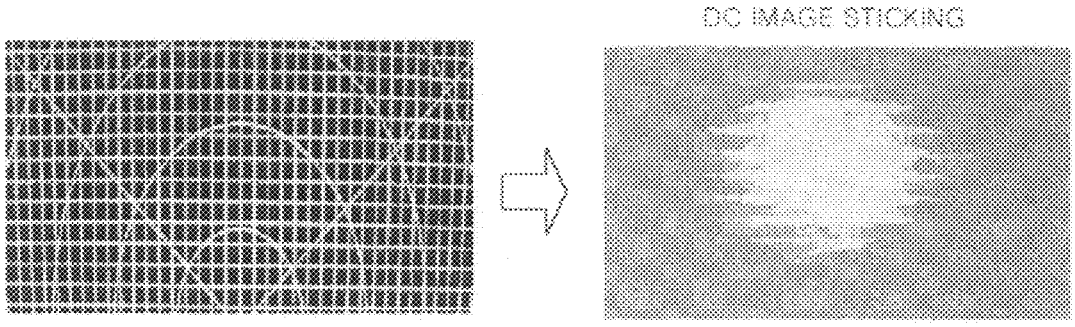
Fig. 3 [Related Art]
FIG. 3 is an experimental result screen showing a DC image sticking caused by the interlace data.
Figure 4:
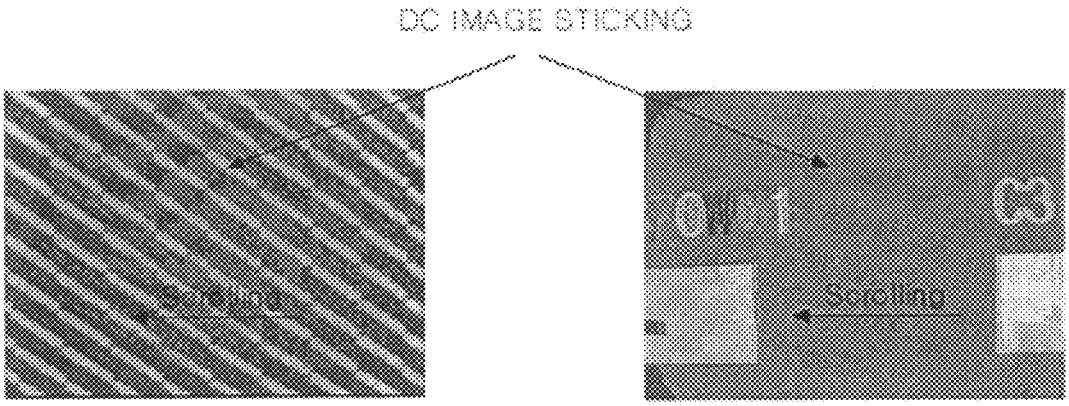
Fig. 4 [Related Art]
FIG. 4 is an experimental result screen showing a DC image sticking caused by scroll data.
Figure 5:
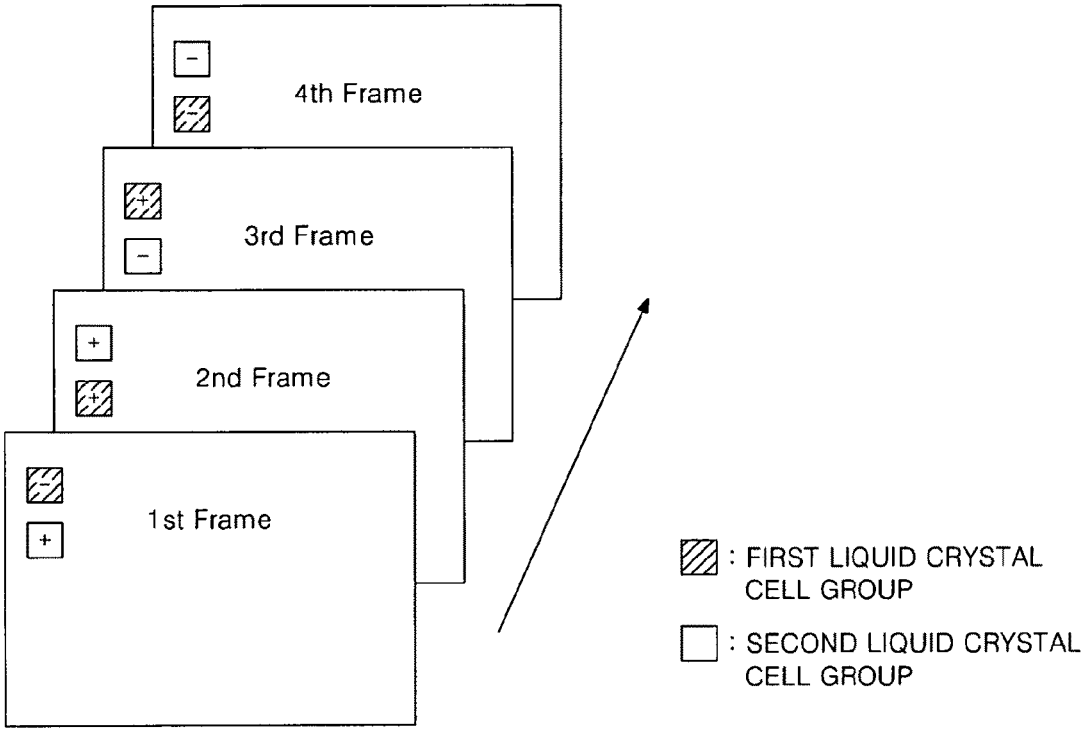
FIG. 5 illustrates an exemplary driving method of a liquid crystal display device according to a first embodiment of the present invention.

As shown in FIG. 5, an exemplary driving method of a liquid crystal display device according to a first embodiment of the present invention drives a first liquid crystal cell group at about half the data voltage polarity frequency of a second liquid crystal cell group between two frame periods. For example, within two frame period, the first liquid crystal cell group may be driven at a data voltage polarity frequency of about 30 Hz and the second liquid crystal cell group may be driven at a data voltage polarity frequency of 60 Hz. Further, within the two frame period, the first liquid crystal cell group may be driven at the data voltage polarity frequency of about 60 Hz and the second liquid crystal cell group may be driven at the data voltage polarity frequency of 120 Hz.

The exemplary driving method of the liquid crystal display device in accordance with the first embodiment of the present invention prevents DC image sticking by supplying a data voltage of which the polarity is inverted every two frame periods to the first liquid crystal cell group, and prevents flicker by supplying a data voltage of which the polarity is inverted every frame period to the second liquid crystal cell group. An explanation of how DC image sticking caused by the first liquid crystal cell group is prevented will be explained in reference to FIG. 6.

Figure 6:
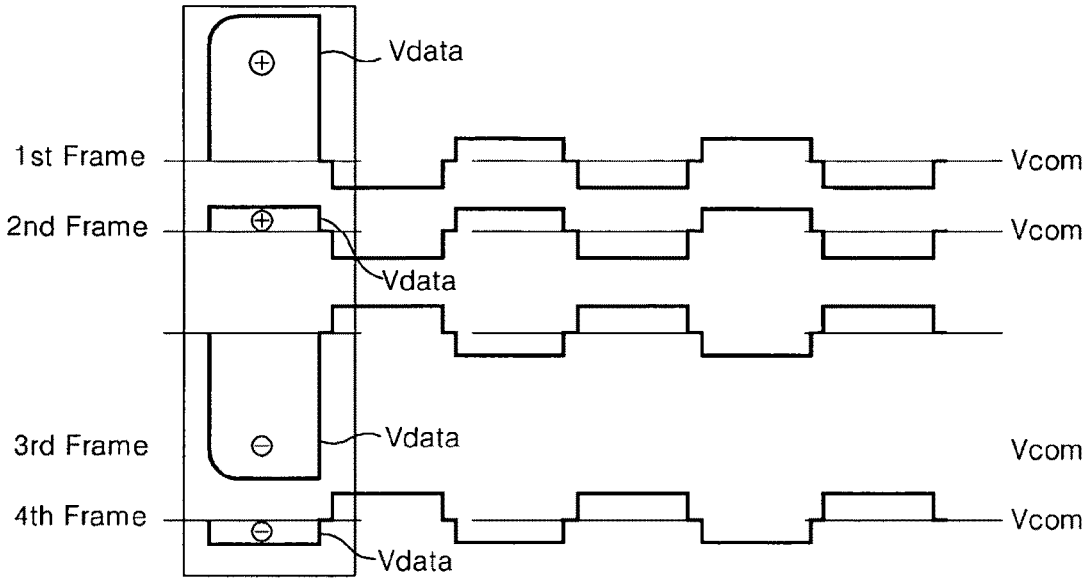
FIG. 6 is a waveform diagram representing a DC image sticking prevention effect by a first liquid crystal cell group shown in FIG. 5.

As shown in FIG. 6, an arbitrary liquid crystal cell Clc in the first liquid crystal cell group is supplied with a high data voltage for an odd-numbered frame period and with a relatively low data voltage for an even-numbered frame period, and the polarities of the data voltages are changed every two frame periods. For example, positive data voltages supplied to a liquid crystal cell Clc of the first liquid crystal cell group for first and second frame periods and negative data voltages supplied to the liquid crystal cell Clc for third and fourth frame periods cancel each other over the four frame periods, thereby preventing any voltage of a biased polarity from accumulating in the liquid crystal cell Clc. Accordingly, in the liquid crystal display device of the present invention, no DC image sticking is generated by the first liquid crystal cell group even in a situation where a data voltage, which is high in voltage and of which the polarity is dominant (e.g., data voltages of an interlace picture) in any one of an odd-numbered frame and an even-numbered frame, as shown in FIG. 6.

In accordance with the exemplary driving method described above, the first liquid crystal cell group may prevent DC image sticking, but because the data voltages of the same polarity are supplied to the liquid crystal cell Clc over two frame periods, flicker may be perceived. Accordingly, the liquid crystal cells Clc of the second liquid crystal cell group are supplied with data voltages of which the polarity is inverted every frame period in which almost no flicker is perceived, thereby minimizing flicker caused by the first liquid crystal cell group. One reason is that the data voltage polarity frequency of the second liquid crystal cell group is perceived as a higher data voltage polarity frequency than the first liquid crystal cell group when viewing a liquid crystal display device in which the first and second liquid crystal cell groups having different data voltage polarity frequencies co-exist because human eyes are more sensitive to changes.

Figure 7:
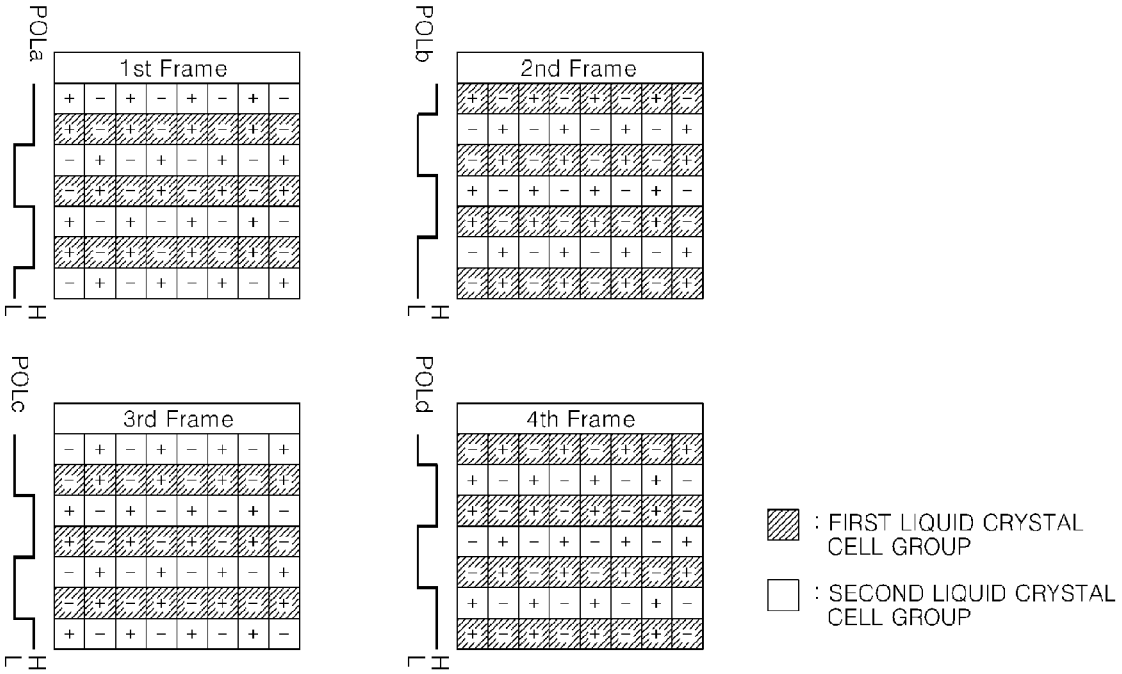
FIGS. 7 and 8 are diagrams illustrating an exemplary polarity pattern of data voltages according to the first embodiment of the present invention.
Figure 8:
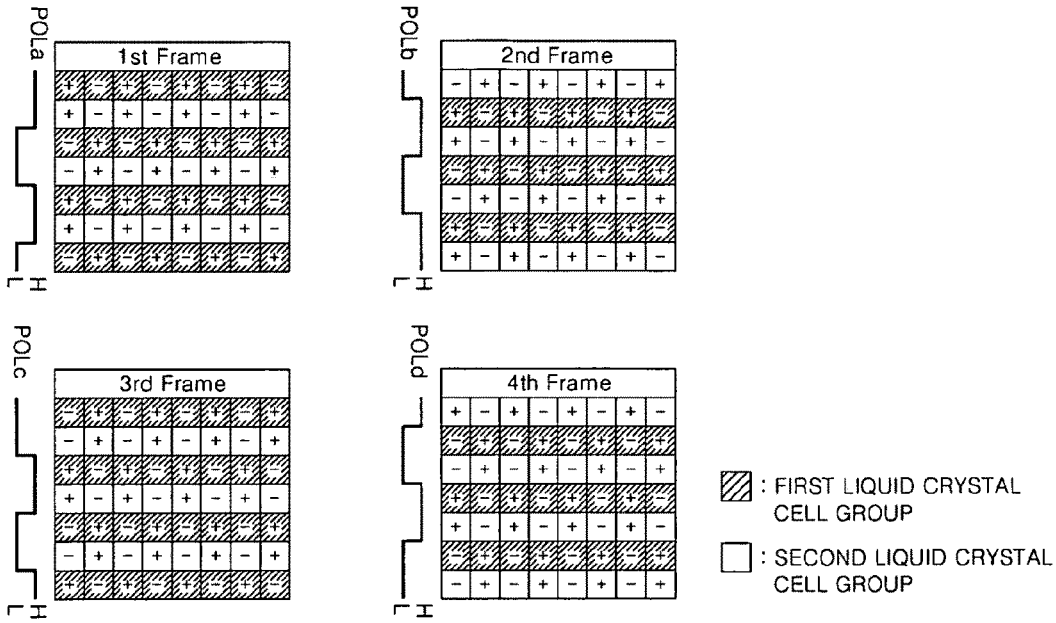

FIGS. 7 to 8 are diagrams representing exemplary polarity patterns of data voltages according to the first embodiment of the present invention. As shown in FIG. 7, an exemplary driving method of a liquid crystal display device according to the first embodiment of the present invention moves the locations of the first and second liquid crystal cell groups for each frame and repeats the polarity pattern over the four frame periods. That is to say, for the (4i+1)th frame period (where i is 0 and a positive integer), the first liquid crystal cell group includes liquid crystal cells Clc of even-numbered horizontal lines and the second liquid crystal cell group includes liquid crystal cells Cls of odd-numbered horizontal lines. For the (4i+1)th frame period, polarities of the data voltages charged in the liquid crystal cells Clc of the first liquid crystal cell group that are adjacent to each other in a vertical direction with liquid crystal cells Clc of the second liquid crystal cell group interposed therebetween are opposite to each other. The polarities of the data voltages charged in the liquid crystal cells Clc of the first liquid crystal cell group that are adjacent to each other in the horizontal direction are also opposite to each other. In the same manner, for the (4i+1)th frame period, the polarities of the data voltages charged in the liquid crystal cells Clc of the second liquid crystal cell group that are adjacent to each other in the vertical direction with liquid crystal cells Clc of the first liquid crystal cell group interposed therebetween are opposite to each other. The polarities of the data voltages charged in the liquid crystal cells Clc of the second liquid crystal cell group that are adjacent to each other in the horizontal direction are also opposite to each other.

For the (4i+2)th frame period, the first liquid crystal cell group includes liquid crystal cells Clc of odd-numbered horizontal lines and the second liquid crystal cell group includes liquid crystal cells Cls of even-numbered horizontal lines. For the (4i+2)th frame period, the polarities of the data voltages charged in the liquid crystal cells Clc of the first liquid crystal cell group that are adjacent to each other in the vertical direction with liquid crystal cells Clc of the second liquid crystal cell group interposed therebetween are opposite to each other. The polarities of the data voltages charged in the liquid crystal cells Clc of the first liquid crystal cell group that are adjacent to each other in the horizontal direction are opposite to each other. In the same manner, for the (4i+2)th frame period, the polarities of the data voltages charged in the liquid crystal cells Clc of the second liquid crystal cell group that are adjacent to each other in the vertical direction with liquid crystal cells Clc of the first liquid crystal cell group interposed therebetween are opposite to each other. The polarities of the data voltages charged in the liquid crystal cells Clc of the second liquid crystal cell group that are adjacent to each other in the horizontal direction are opposite to each other.

For the (4i+3)th frame period, the first liquid crystal cell group includes liquid crystal cells Clc of even-numbered horizontal lines and the second liquid crystal cell group includes liquid crystal cells Cls of odd-numbered horizontal lines. For the (4i+3)th frame period, the polarities of the data voltages charged in the liquid crystal cells Clc of the first liquid crystal cell group that are adjacent to each other in the vertical direction with liquid crystal cells Clc of the second liquid crystal cell group interposed therebetween are opposite to each other. The polarities of the data voltages charged in the liquid crystal cells Clc of the first liquid crystal cell group that are adjacent to each other in the horizontal direction are opposite to each other. In the same manner, for the (4i+3)th frame period, the polarities of the data voltages charged in the liquid crystal cells Clc of the second liquid crystal cell group that are adjacent to each other in the vertical direction with liquid crystal cells Clc of the first liquid crystal cell group interposed therebetween are opposite to each other. The polarities of the data voltages charged in the liquid crystal cells Clc of the second liquid crystal cell group that are adjacent to each other in the horizontal direction are opposite to each other. Looking at the polarity patterns between the (4i+1)th frame period and the (4i+3)th frame period, the location of the first and second liquid crystal cell groups are the same in the (4i+1)th frame period and the (4i+3)th frame period, but the polarities of the data voltages are opposite to each other.

For the (4i+4)th frame period, the first liquid crystal cell group includes liquid crystal cells Clc of odd-numbered horizontal lines and the second liquid crystal cell group includes liquid crystal cells Cls of even-numbered horizontal lines. For the (4i+4)th frame period, the polarities of the data voltages charged in the liquid crystal cells Clc of the first liquid crystal cell group that are adjacent to each other in the vertical direction with liquid crystal cells Clc of the second liquid crystal cell group interposed therebetween are opposite to each other. The polarities of the data voltages charged in the liquid crystal cells Clc of the first liquid crystal cell group that are adjacent to each other in the horizontal direction are opposite to each other. In the same manner, for the (4i+4)th frame period, the polarities of the data voltages charged in the liquid crystal cells Clc of the second liquid crystal cell group that are adjacent to each other in the vertical direction with liquid crystal cells Clc of the first liquid crystal cell group interposed therebetween are opposite to each other. The polarities of the data voltages charged in the liquid crystal cells Clc of the second liquid crystal cell group that are adjacent to each other in the horizontal direction are opposite to each other. Looking at the polarity patterns between the (4i+2)th frame period and the (4i+4)th frame period, the locations of the first and second liquid crystal cell groups are the same in the (4i+2)th frame period and the (4i+4)th frame period, but the polarities of the data voltages are opposite to each other.

To generate these patterns, a first polarity control signal POLa generated in the (4i+1)th frame period has an opposite phase as that of a third polarity control signal POLc generated in the (4i+3)th frame period. A second polarity control signal POLb generated in the (4i+2)th frame period has an opposite phase as that of a fourth polarity control signal POLd generated in the (4i+4)th frame period. The first polarity control signal POLa and the second polarity control signal POLb has a phase difference of about one horizontal period, and the third polarity control signal POLc and the fourth polarity control signal POLd also has a phase difference of about one horizontal period.

To generate the polarity pattern shown in FIG. 8, the second and fourth polarity control signals POLb, POLd of the polarity control signals POLa to POLd have the opposite phase as that of the second and fourth polarity control signals POLb, POLd of FIG. 7. As shown in FIG. 8, for the (4i+1)th frame period, the first liquid crystal cell group includes liquid crystal cells Clc of odd-numbered horizontal lines and the second liquid crystal cell group includes liquid crystal cells Cls of even-numbered horizontal lines. For the (4i+1)th frame period, polarities of the data voltages charged in the liquid crystal cells Clc of the first liquid crystal cell group that are adjacent to each other in a vertical direction with liquid crystal cells Clc of the second liquid crystal cell group interposed therebetween are opposite to each other. The polarities of the data voltages charged in the liquid crystal cells Clc of the first liquid crystal cell group that are adjacent to each other in a horizontal direction are opposite to each other. In the same manner, for the (4i+1)th frame period, the polarities of the data voltages charged in the liquid crystal cells Clc of the second liquid crystal cell group that are adjacent to each other in the vertical direction with liquid crystal cells Clc of the first liquid crystal cell group interposed therebetween are opposite to each other. The polarities of the data voltages charged in the liquid crystal cells Clc of the second liquid crystal cell group that are adjacent to each other in the horizontal direction are opposite to each other.

For the (4i+2)th frame period, the first liquid crystal cell group includes liquid crystal cells Clc of even-numbered horizontal lines and the second liquid crystal cell group includes liquid crystal cells Cls of odd-numbered horizontal lines. For the (4i+2)th frame period, the polarities of the data voltages charged in the liquid crystal cells Clc of the first liquid crystal cell group that are adjacent to each other in the vertical direction with liquid crystal cells Clc of the second liquid crystal cell group interposed therebetween are opposite to each other. The polarities of the data voltages charged in the liquid crystal cells Clc of the first liquid crystal cell group that are adjacent to each other in the horizontal direction are opposite to each other. In the same manner, for the (4i+2)th frame period, the polarities of the data voltages charged in the liquid crystal cells Clc of the second liquid crystal cell group that are adjacent in the vertical direction with liquid crystal cells Clc of the first liquid crystal cell group interposed therebetween are opposite to each other. The polarities of the data voltages charged in the liquid crystal cells Clc of the second liquid crystal cell group that are adjacent to each other in the horizontal direction are opposite to each other.

For the (4i+3)th frame period, the first liquid crystal cell group includes liquid crystal cells Clc of odd-numbered horizontal lines and the second liquid crystal cell group includes liquid crystal cells Cls of even-numbered horizontal lines. For the (4i+3)th frame period, the polarities of the data voltages charged in the liquid crystal cells Clc of the first liquid crystal cell group that are adjacent to each other in the vertical direction with liquid crystal cells Clc of the second liquid crystal cell group interposed therebetween are opposite to each other. The polarities of the data voltages charged in the liquid crystal cells Clc of the first liquid crystal cell group that are adjacent to each other in the horizontal direction are opposite to each other. In the same manner, for the (4i+3)th frame period, the polarities of the data voltages charged in the liquid crystal cells Clc of the second liquid crystal cell group that are adjacent to each other in the vertical direction with liquid crystal cells Clc of the first liquid crystal cell group interposed therebetween are opposite to each other. The polarities of the data voltages charged in the liquid crystal cells Clc of the second liquid crystal cell group that are adjacent to each other in the horizontal direction are opposite to each other. The locations of the first and second liquid crystal cell groups are the same in the (4i+1)th frame period and the (4i+3)th frame period, but the polarities of the data voltages are opposite to each other.

For the (4i+4)th frame period, the first liquid crystal cell group includes liquid crystal cells Clc of even-numbered horizontal lines and the second liquid crystal cell group includes liquid crystal cells Cls of odd-numbered horizontal lines. For the (4i+4)th frame period, the polarities of the data voltages charged in the liquid crystal cells Clc of the first liquid crystal cell group that are adjacent to each other in the vertical direction with liquid crystal cells Clc of the second liquid crystal cell group interposed therebetween are opposite to each other. The polarities of the data voltages charged in the liquid crystal cells Clc of the first liquid crystal cell group that are adjacent to each other in the horizontal direction are opposite to each other. In the same manner, for the (4i+4)th frame period, the polarities of the data voltages charged in the liquid crystal cells Clc of the second liquid crystal cell group that are adjacent to each other in the vertical direction with liquid crystal cells Clc of the first liquid crystal cell group interposed therebetween are opposite to each other. The polarities of the data voltages charged in the liquid crystal cells Clc of the second liquid crystal cell group that are adjacent to each other in the horizontal direction are opposite to each other. The locations of the first and second liquid crystal cell groups are the same in the (4i+2)th frame period and the (4i+4)th frame period, but the polarities of the data voltages are opposite to each other.

In this manner, the liquid crystal cells Clc of the first liquid crystal cell group have a relatively long polarity change cycle (i.e., two frame periods in this instance). Thus, it is possible that flicker may be perceived if the liquid crystal cells are spatially arranged together to form concentrated areas having relatively long polarity change cycles. Accordingly, in the driving method of the liquid crystal display device according to the exemplary embodiment of the present invention as shown in FIGS. 7 and 8, the liquid crystal cells Clc of the first liquid crystal cell group are controlled such that the polarity of the data voltages do not repeat more than two consecutive horizontal lines in each frame period.

As explained above, the liquid crystal cells Clc of the first liquid crystal cell group have a relatively long polarity change cycle. Thus, if the location of the cell group is in the same place for more than three frame periods, a difference in brightness compared to other horizontal lines may occur, thereby creating a rippling noise effect. Accordingly, the driving method of the liquid crystal display device according to the exemplary embodiment of the present invention as shown in FIGS. 7 and 8 controls the location of the first liquid crystal cell group and the second liquid crystal cell group to alternate for each frame.

Figure 9:
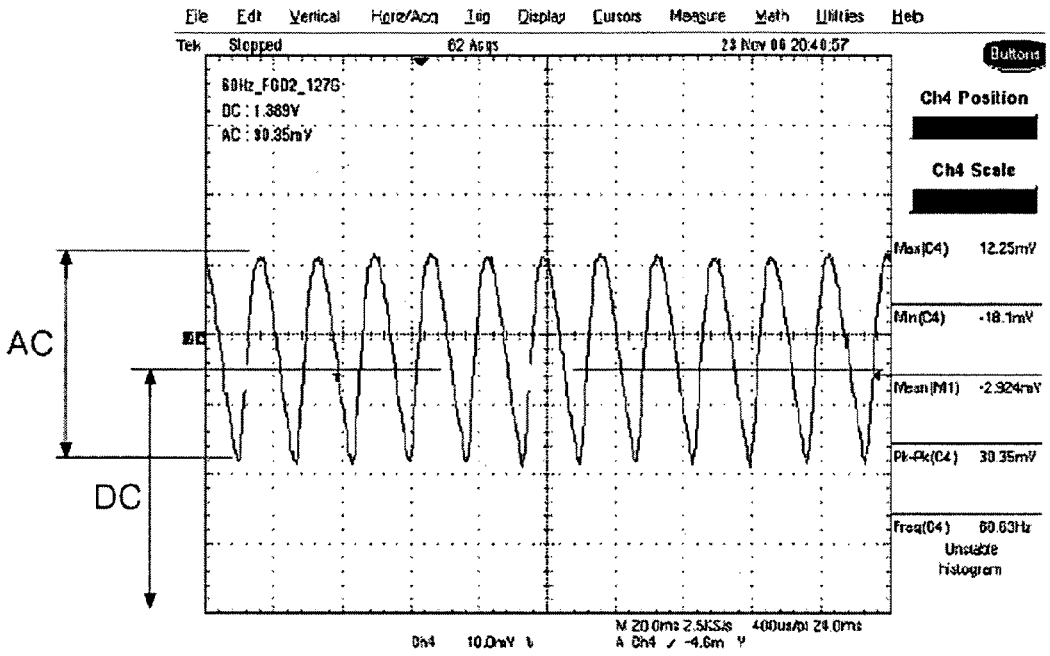
FIG. 9 is a waveform diagram representing a DC offset value and an AC value of a data voltage measured in a liquid crystal display panel which is supplied with the data voltages of FIGS. 7 and 8.

FIG. 9 illustrates a result of an experiment of supplying data voltages of 127 gray levels to a liquid crystal display panel with a polarity pattern shown in FIGS. 7 and 8 and measuring a voltage waveform of the liquid crystal display panel. In this experiment, the second liquid crystal cell group of the liquid crystal display panel was supplied with the data voltage of which the polarity was changed at a frequency of 60 Hz within two frame period, and the first liquid crystal cell group was supplied with the data voltage of which the polarity was changed at a frequency of 30 Hz. However, because the faster frequency of 60 Hz was perceived to be dominant, the frequency of the data voltage measured in the liquid crystal display panel was measured to be about 60 Hz. An AC voltage value (i.e., amplitude) of the data voltage was about 30.35 mV, and a DC offset value between the center of the AC voltage and a ground voltage GND was measured to be about 1.389V. Further, a light waveform measured by installing an optical sensor on a sample liquid crystal display panel was also about 60 Hz due to the dominant frequency of the second liquid crystal cell group. This is because the light waveform measured in the liquid crystal display panel is determined by a light change cycle of the second liquid crystal cell group of which the frequency is faster than that of the first liquid crystal cell group.

Figure 10:
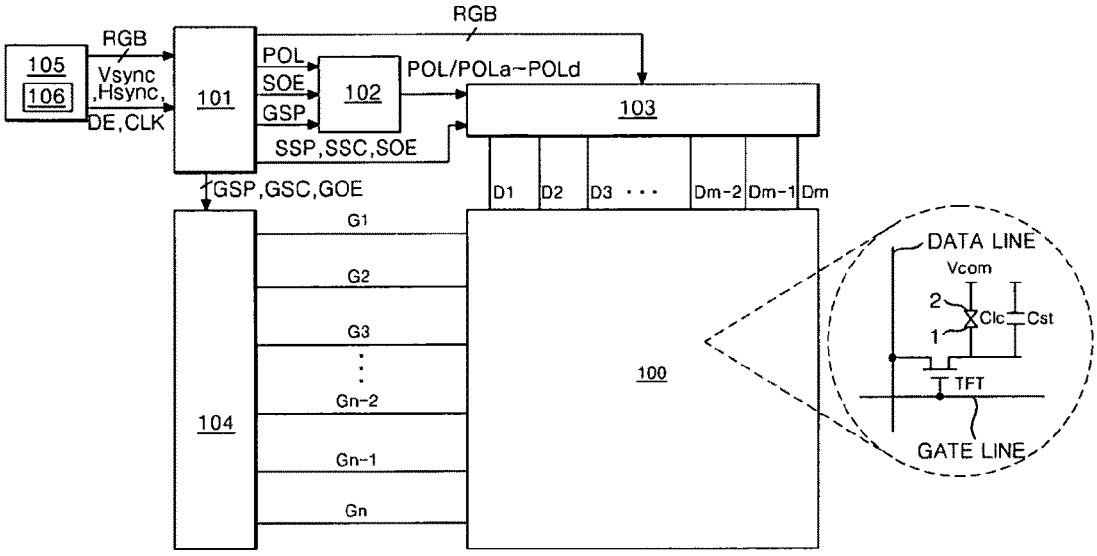
FIG. 10 is a block diagram illustrating an exemplary liquid crystal display device according to the first embodiment of the present invention.

FIGS. 10 to 14 illustrate an exemplary liquid crystal display device according to the first embodiment of the present invention. As shown in FIG. 10, an exemplary liquid crystal display device according to the first embodiment of the present invention includes a liquid crystal display panel 100, a timing controller 101, a logic circuit 102, a data drive circuit 103, and a gate drive circuit 104.

In the liquid crystal display panel 100, liquid crystal molecules are injected between two glass substrates. The liquid crystal display panel 100 includes m×n number of liquid crystal cells Clc arranged in a matrix pattern by m-number of data lines Dl to Dm crossing n-number of gate lines G1 to Gn. The liquid crystal cells Clc are arranged into first and second liquid crystal cell groups that are driven at different data voltage polarity frequencies within two frame periods as described above.

On the lower glass substrate of the liquid crystal display panel 100, there are formed data lines D1 to Dm, gate lines G1 to Gn, TFTs, pixel electrodes 1 of the liquid crystal cells Clc connected to the TFTs, storage capacitors Cst, and other components. On the upper glass substrate of the liquid crystal display panel 100, there are formed a black matrix, color filters, and common electrodes 2. The common electrode 2 is formed on the upper glass substrate in a vertical electric field driving method such as a TN (Twisted Nematic) mode and a VA (Vertical Alignment) mode. Alternatively, the common electrode 2 is formed together with the pixel electrode 1 on the lower glass substrate in a horizontal electric field driving method such as an IPS (In-Plane Switching) mode and an FFS (Fringe Field Switching) mode. Polarizers of which the optical axes cross each other perpendicularly are placed to the upper glass substrate and the lower glass substrate of the liquid crystal display panel 100, and alignment films for setting the pre-tilt angle of liquid crystals are formed on the internal surfaces that face the liquid crystals.

The timing controller 101 receives timing signals, such as vertical/horizontal synchronization signals Vsync, Hsync, data enables, clock signals, and other signals to generate control signals for controlling the operation timing of the logic circuit 102, the gate drive circuit 104, and the data drive circuit 103. The control signals include a gate start pulse GSP, a gate shift clock signal GSC, a gate output enable signal GOE, a source start pulse SSP, a source sampling clock SSC, a source output enable signal SOE, and a reference polarity control signal POL. The gate start pulse GSP indicates a start horizontal line from which a scan starts among a first vertical period when an image is displayed. The gate shift clock signal GSC is input to a shift register within the gate drive circuit 104 and is generated to have a pulse width corresponding to the on-period of the TFT as a timing control signal for sequentially shifting the gate start pulse GSP. The gate output enable signal GOE indicates the output of the gate drive circuit 104. The source start pulse SSP indicates a start pixel in a first horizontal line in which data are to be displayed. The source sampling clock SSC indicates a latch operation of the data within the data drive circuit 103 on the basis of a rising or falling edge. The source output enable signal SOE indicates the output of the data drive circuit 103. The reference polarity control signal POL indicates the polarity of the data voltages that are to be supplied to the liquid crystal cells Clc of the liquid crystal display panel 100. The reference polarity control signal POL is generated as any one of a one-dot and two-dot inversion control signal. One dot inversion polarity control signal is in which the logic is inverted for each horizontal period and two dot inversion polarity control signal is in which the logic is inverted for each two horizontal periods.

The logic circuit 102 receives the gate start pulse GSP, the source output enable signal SOE, and the reference polarity control signal POL and selectively outputs either the reference polarity control signal POL, or the polarity control signals POLa to POLd in order to prevent the residual images (i.e., DC sticking) and flicker.

The data drive circuit 103 latches the digital video data RGB under control of the timing controller 101. The data drive circuit 103 converts the digital video data into an analog positive/negative gamma compensation voltage in response to the polarity control signal POL/POLa-POLd from the timing controller 101 to generate a positive/negative analog data voltage, thereby supplying the data voltage to the data lines D1 to Dm.

The gate drive circuit 104 includes of a plurality of gate drive ICs, each including a shift register, a level shifter for converting the swing width of the output signal of the shift register into a swing width that is suitable for driving the TFT of the liquid crystal cell, and an output buffer connected between the level shifter and the gate line G1 to Gn. The gate drive circuit 104 sequentially outputs scan pulses that have pulse widths of about one horizontal period. The logic circuit 102 may be embedded within the timing controller 101.

The exemplary liquid crystal display device according to the first embodiment of the present invention further includes a video source 105, which supplies the digital video data RGB and the timing signals Vsync, Hsync, DE, CLK to the timing controller 101. The video source 105 includes a broadcasting signal, an external device interface circuit, a graphic processing circuit, a line memory 106, and other components. The video source 105 extracts the video data from an image source input from the external device or the broadcasting signal and converts the video data into the digital data to supply to the timing controller 101. Interlace broadcasting signal received in the video source 105 is stored in the line memory, and then the stored signal is output. The video data of interlaced broadcasting signal exist only in the odd-numbered lines for odd-numbered frame periods and only in the even-numbered lines for even-numbered frame periods. Accordingly, if the interlace broadcasting signal is received, the video source 105 generates black data value or an average value of the effective data stored at the line memory 106 as even-numbered line data for odd-numbered frame periods and as odd-numbered line data for even-numbered frame periods. The video source 105 also supplies power and the timing signals Vsync, Hsync, DE, CLK together with the digital video data to the timing controller 101.

Figure 11:
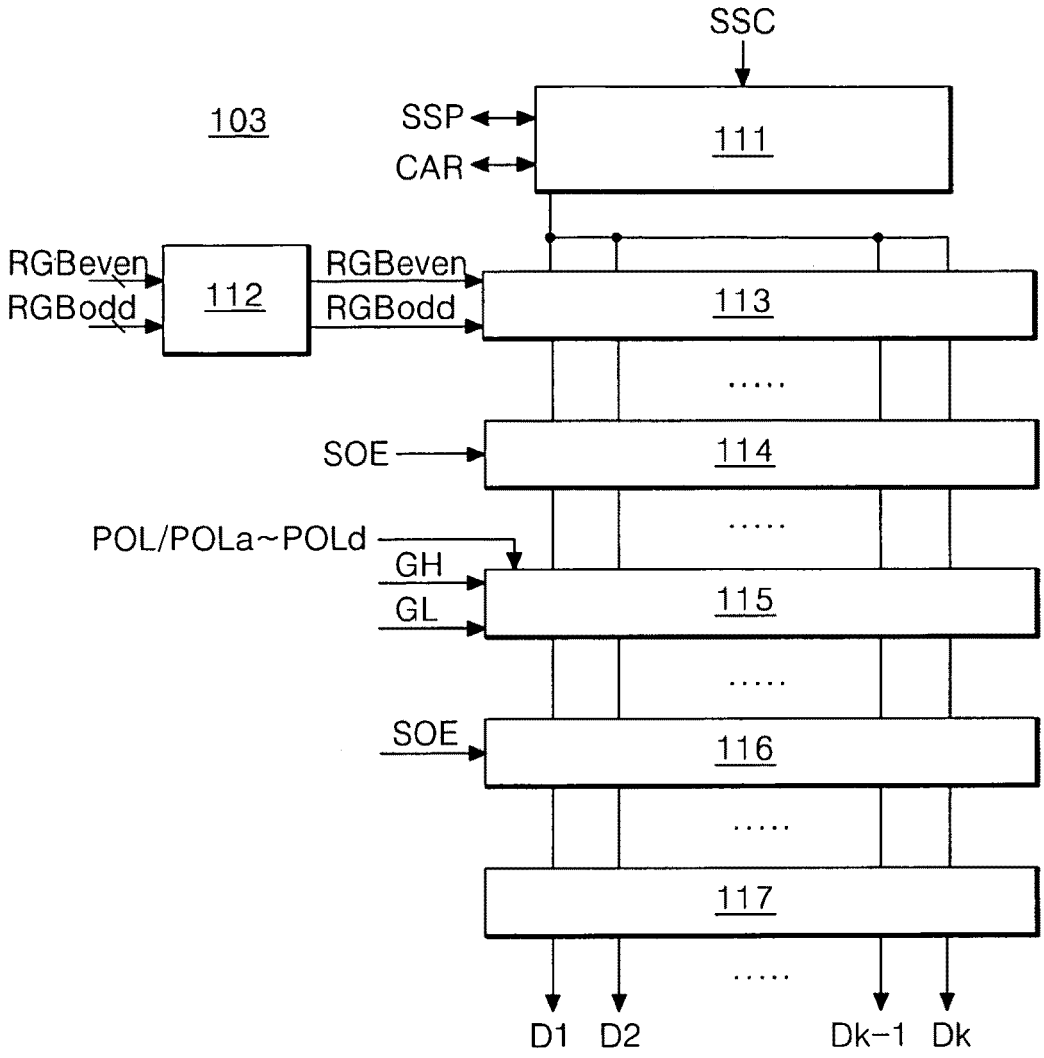
FIG. 11 is a block diagram illustrating an exemplary data drive circuit shown in FIG. 10.
Figure 12:
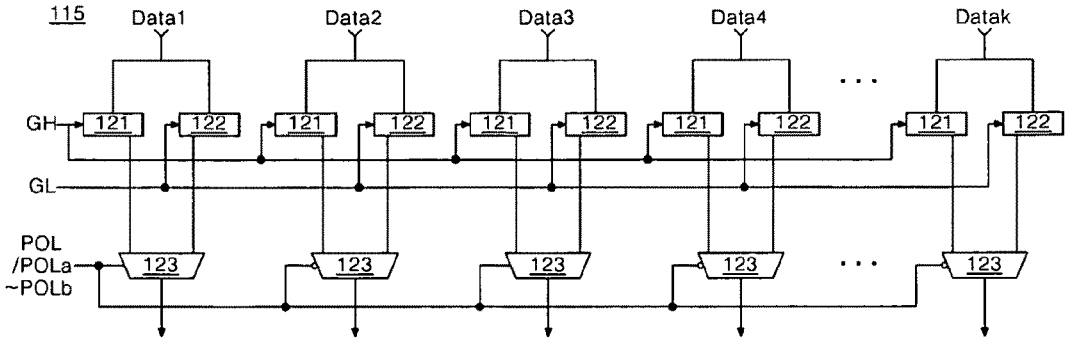
FIG. 12 is an exemplary circuit diagram illustrating the digital/analog converter shown in FIG. 11.

FIGS. 11 and 12 illustrate exemplary circuit diagrams of the data drive circuit 103. As shown in FIGS. 11 and 12, the data drive circuit 103 includes a plurality of integrated circuits (hereinafter, referred to as "IC") of which each IC drives k (where k is an integer less than m) number of data lines D1 to Dk. Each IC includes a shift register 111, a data register 112, a first latch 113, a second latch 114, a digital/analog converter (hereinafter, referred to as "DAC") 115, a charge share circuit 116, and an output circuit 117.

The shift register 111 shifts the source start pulse SSP from the timing controller 101 in accordance with the source sampling clock SSC to generate a sampling signal. Further, the shift register 111 shifts the source start pulse SSP to transmit a carry signal CAR to the shift register 111 of the next stage IC. The data register 112 temporarily stores an odd-numbered digital video data RGBodd and an even-numbered digital video data RGBeven, which are divided by the timing controller 101, and supplies the stored data RGBodd, RGBeven to the first latch 113. The first latch 113 samples the digital video data RGBodd, RGBeven from the data register 112 in response to the sampling signal sequentially input from the shift register 111, latches the data RGBodd, RGBeven for each horizontal line, and outputs the data of one horizontal line portion at the same time. The second latch 114 outputs the digital video data that are latched at the same time as the second latch 114 of other ICs during a low logic period of the source output enable signal SOE after latching the data of one horizontal line portion inputted from the first latch 113.

The DAC 115 includes a P-decoder PDEC 121 which is supplied with a positive gamma reference voltage GH, an N-decoder NDEC 122 which is supplied with a negative gamma reference voltage GL, and a multiplexer which selects between the output of the P-decoder 121 and the output of the N-decoder 122 in response to the polarity control signals POL/POLa-POLd. The P-decoder 121 decodes the digital video data input from the second latch 114 to output positive gamma compensation voltages corresponding to the gray level value of the data, and the N-decoder 122 decodes the digital video data input from the second latch 114 to output negative gamma compensation voltages corresponding to the gray level value of the data. The multiplexer 123 alternately selects between the positive gamma compensation voltage and the negative gamma compensation voltage in response to the polarity control signal POL/POLa~POLd, and outputs the selected positive/negative gamma compensation voltage as an analog data voltage. The charge share circuit 116 shorts adjacent data output channels during a high logic period of the source output enable signal SOE to output an average value of the adjacent data voltages, or alternatively supplies common voltages Vcom to the data output channels during the high logic period of the source output enable signal SOE to reduce a rapid change of the positive and negative data voltages. The output circuit 117 includes a buffer and minimizes a signal attenuation of the analog data voltage supplied to the data line D1 to Dk.

Figure 13:
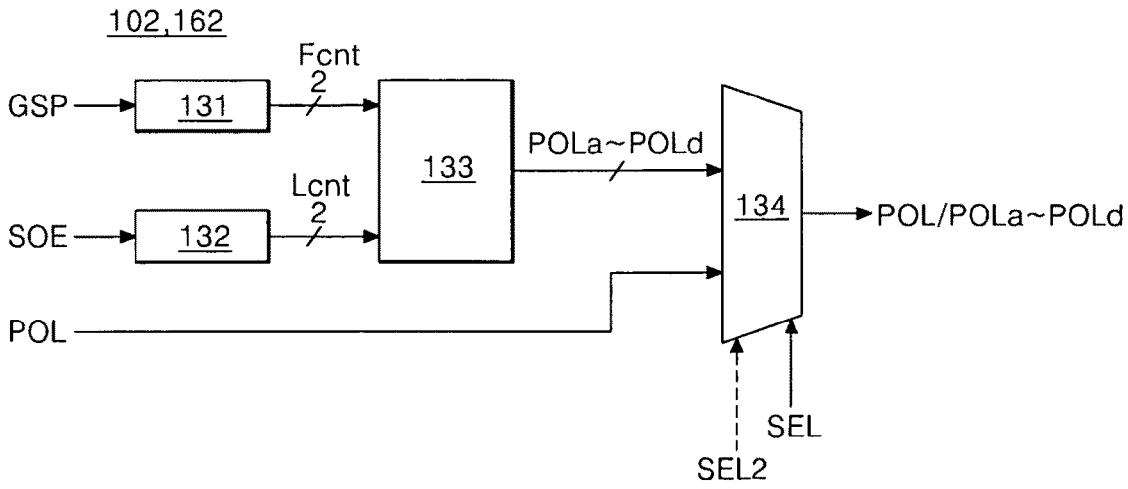
FIG. 13 is a block diagram illustrating an exemplary logic circuit shown in FIG. 10.
Figure 14:
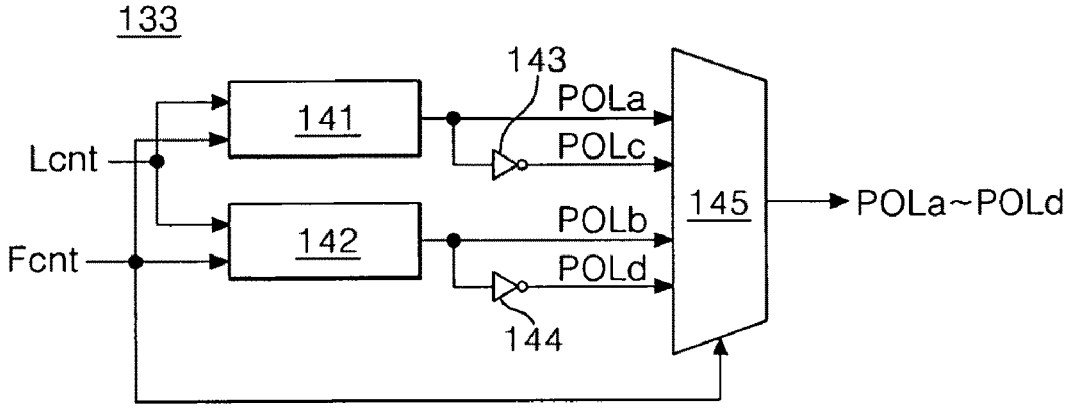
FIG. 14 is a block diagram illustrating an exemplary POL generation circuit shown in FIG. 13.

FIGS. 13 and 14 illustrate exemplary circuit diagrams of the logic circuit 102. As shown in FIGS. 13 and 14, the logic circuit 102 includes a frame counter 131, a line counter 132, a POL generation circuit 133, and a multiplexer 134.

The frame counter 131 outputs a frame count information Fcnt, which indicates the number of frames of a picture that is to be displayed in the liquid crystal display panel 100, in response to the gate start pulse GSP generated once for one frame period at the same time as a start of the frame period. The frame count information Fcnt may be generated as a 2-bit information, for example, so as to be able to identify each of four frame periods when generating the polarity patterns of the data voltages as shown in FIGS. 7 and 8. Different number of bits and frame periods may be used without departing from the scope of the present invention.

The line counter 132 outputs a line count information Lcnt indicating a horizontal line that is to be displayed in the liquid crystal display panel 100 in response to the source output enable signal SOE that indicates a point of time when the data voltage is supplied to each horizontal line. The line count information Lcnt is generated as a 2-bit information because the polarity of the data voltage displayed in the liquid crystal display panel 100 is inverted for each horizontal line or every two horizontal lines as shown in the polarity patterns of the data voltages of FIGS. 7 and 8.

For the timing signals to be supplied to the frame counter 131 and the line counter 132, a clock generated from an internal oscillator of the timing controller 101 may be used. However, the clock may increase electromagnetic interference (EMI) between the timing controller 101 and the logic circuit 102 because the high frequency of the clock. In accordance with the present invention, an increase of EMI between the timing controller 101 and the logic circuit 102 may be reduced by using the source output enable signal SOE and the gate start pulse GSP as operation timing signals of the frame counter 131 and the line counter 132 since the frequency of these signals is lower than that of the clock generated in the internal oscillator of the timing controller 101.

The POL generation circuit 133 includes a first POL generation circuit 141, a second POL generation circuit 142, first and second inverters 143, 144, and a multiplexer 145. The first POL generation circuit 141 generates a first polarity control signal POLa, of which the polarity is inverted for each two horizontal periods, on the basis of the line count information Lcnt. The first inverter 143 inverts the first polarity control signal POLa to generate a third polarity control signal POLc. The second POL generation circuit 142 generates a second polarity control signal POLb, of which the polarity is inverted for each two horizontal periods and has a phase difference of about one horizontal period compared to the first polarity control signal POLa, on the basis of the line count information Lcnt. The second inverter 144 inverts the second polarity control signal POLb to generate a fourth polarity control signal POLd. Each of the first and second POL generation circuits 141, 142 inverts the polarities of the polarity control signals POLb, POLc for each frame period in response to the frame count information Fcnt. The multiplexer 145 outputs the first polarity control signal POLa for the (4i+1)th frame period in response to the frame count information Fcnt of 2-bits, for example, then outputs the second polarity control signal POLb for the (4i+2)th frame period, then outputs the third polarity control signal POLc for the (4i+3)th frame period, and then outputs the fourth polarity control signal POLd for the (4i+4)th frame period.

The multiplexer 134 selects the polarity control signals POLa to POLd from the POL generation circuit 133 corresponding to each frame period as in FIGS. 7 and 8 in accordance with a logic value supplied to a control terminal connected to an option pin. The option pin is connected to the control terminal of the multiplexer 134 and may be selectively connected to a ground voltage GND or the power supply voltage Vcc by a manufacturer. For example, if the option pin is connected to the ground voltage GND and the control terminal of the multiplexer 134, the multiplexer 134 has a selection control signal SEL of "0" supplied to its own control terminal, thereby outputting the reference polarity control signal POL. If the option pin is connected to the power supply voltage and the control terminal of the multiplexer 134, the multiplexer 134 has a selection control signal SEL of "1" supplied to its own control terminal, thereby outputting the polarity control signals POLa to POLd from the POL generation circuit 133. The selection control signal SEL of the multiplexer 134 may be replaced with a user selection signal, which is input through a user interface, or a selection control signal, which is automatically generated from the timing controller 101 or the video source 105 in accordance with an analysis result of data.

Figure 15:
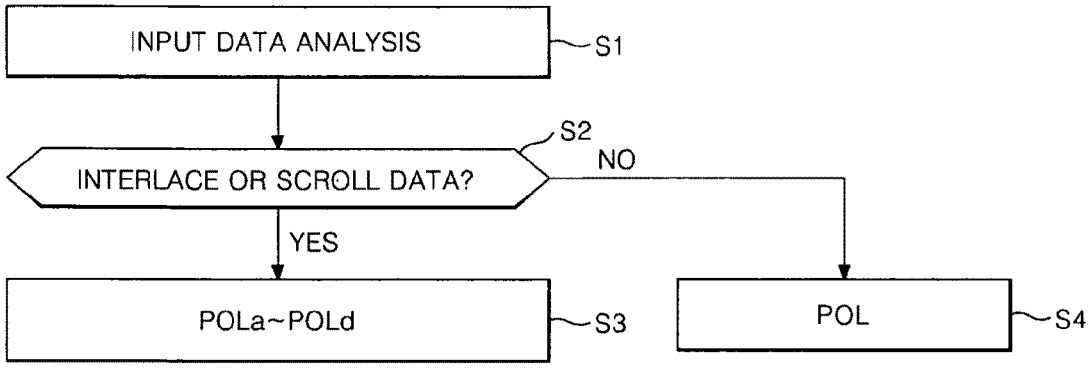
FIG. 15 is a flow chart illustrating an exemplary driving method of a liquid crystal display device according to a second embodiment of the present invention.

FIG. 15 is a flow chart illustrating an exemplary driving method of a liquid crystal display device according to a second embodiment of the present invention. As shown in FIG. 15, the exemplary driving method of the liquid crystal display device according to the second embodiment of the present invention analyzes input data and determines whether the input data is data with which DC image sticking is likely to occur, such as interlace data or scroll data. (S1, S2) In the step S2, if the currently input data is judged to be data with which DC image sticking may occur, the second embodiment of the present invention sequentially generates the first to fourth polarity control signals POLa to POLd for each frame period and controls the data voltage polarity frequency of the first liquid crystal cell group to be lower than the data voltage polarity frequency of the second liquid crystal cell group between two frame periods. (S3) In step S2, if the currently input data is determined to be data with which the DC image sticking will not occur, the second embodiment of the present invention generates the reference polarity control signal POL in all frame periods so that the data voltage polarity frequency of the first and second liquid crystal cell group will be the same. (S4)

Figure 16:
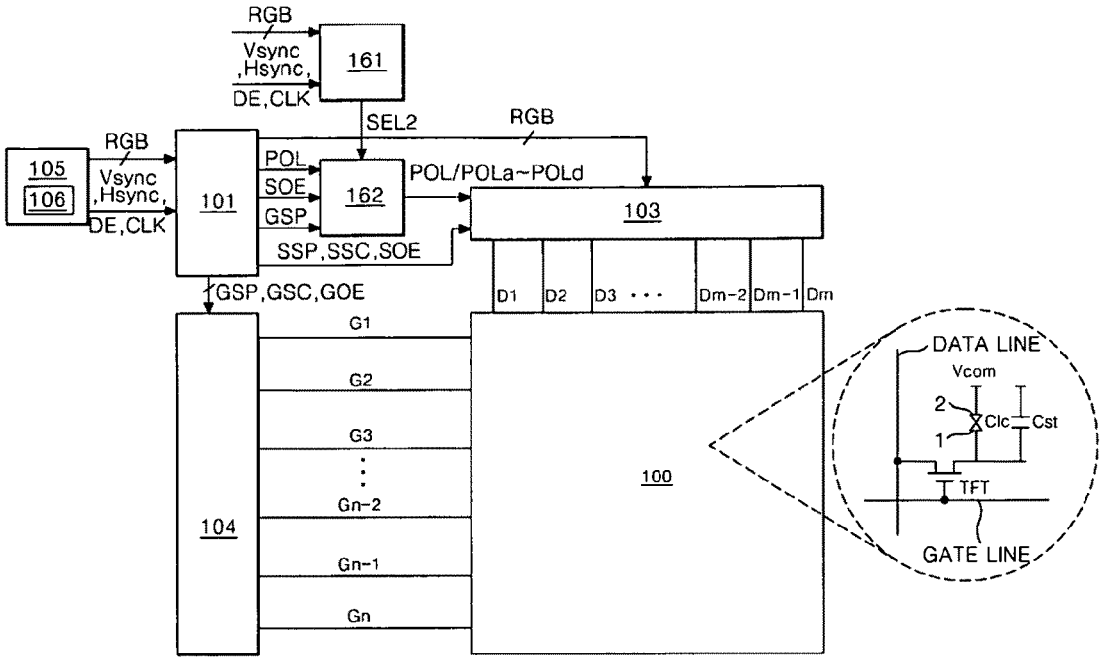
FIG. 16 is a block diagram illustrating an exemplary liquid crystal display device according to the second embodiment of the present invention.

FIG. 16 represents an exemplary liquid crystal display device according to the second embodiment of the present invention. As shown in FIG. 16, the liquid crystal display device according to the second embodiment of the present invention includes a video source 105, a liquid crystal display panel 100, an image analyzing circuit 161, a timing controller 101, a logic circuit 162, a data drive circuit 103, and a gate drive circuit 104. In this exemplary embodiment, the video source 105, the liquid crystal display panel 100, the timing controller 101, the data drive circuit 103, and the gate drive circuit 104 are substantially the same as the foregoing embodiment. Thus, the same reference numerals are given to the previously described components and a detail description thereof is omitted.

The image analyzing circuit 161 judges whether the digital video data of the currently input image is data with which DC image sticking will likely occur. The image analyzing circuit 161 compares the data between adjacent lines in one frame image and deems the currently input data to be the interlace data if the data between the lines is greater than a designated threshold value. Further, the image analyzing circuit 161 compares the data of each pixel by the unit of a frame and detects a moving picture in a display image and the speed of the moving picture. If the picture moves at a pre-set speed, the frame data that includes the moving picture is deemed to be scroll data. As a result of the image analysis, the image analyzing circuit 161 generates a selection signal SEL2 that indicates the currently input data is interlace data or scroll data and controls the logic circuit 162 using the selection signal SEL2.

The logic circuit 162 sequentially generates the first to fourth polarity control signals POLa to POLd for the (4i+1)th to (4i+4)th frame periods as shown in FIG. 13, in response to a first logic value of the selection signal SEL2 from the image analyzing circuit 161. Further, the logic circuit 162 transmits the reference polarity control signal POL to the data drive circuit 103 when the currently input data is deemed not to be interlace data or scroll data, in response to a second logic value of the selection signal SEL2. The timing controller 101, the image analyzing circuit 161, and the logic circuit 162 might be integrated into one chip.

Figure 17:
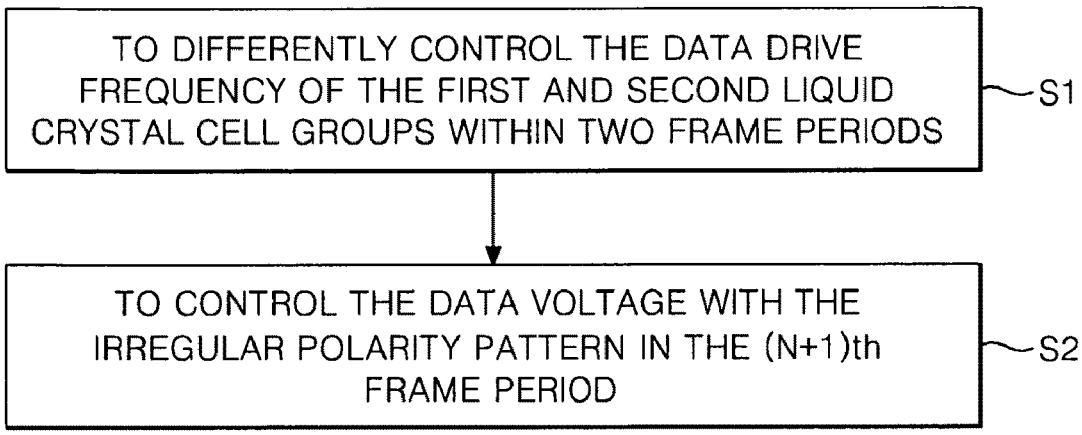
FIG. 17 is a flow chart illustrating an exemplary driving method of a liquid crystal display device according to a third embodiment of the present invention.
Figure 18:
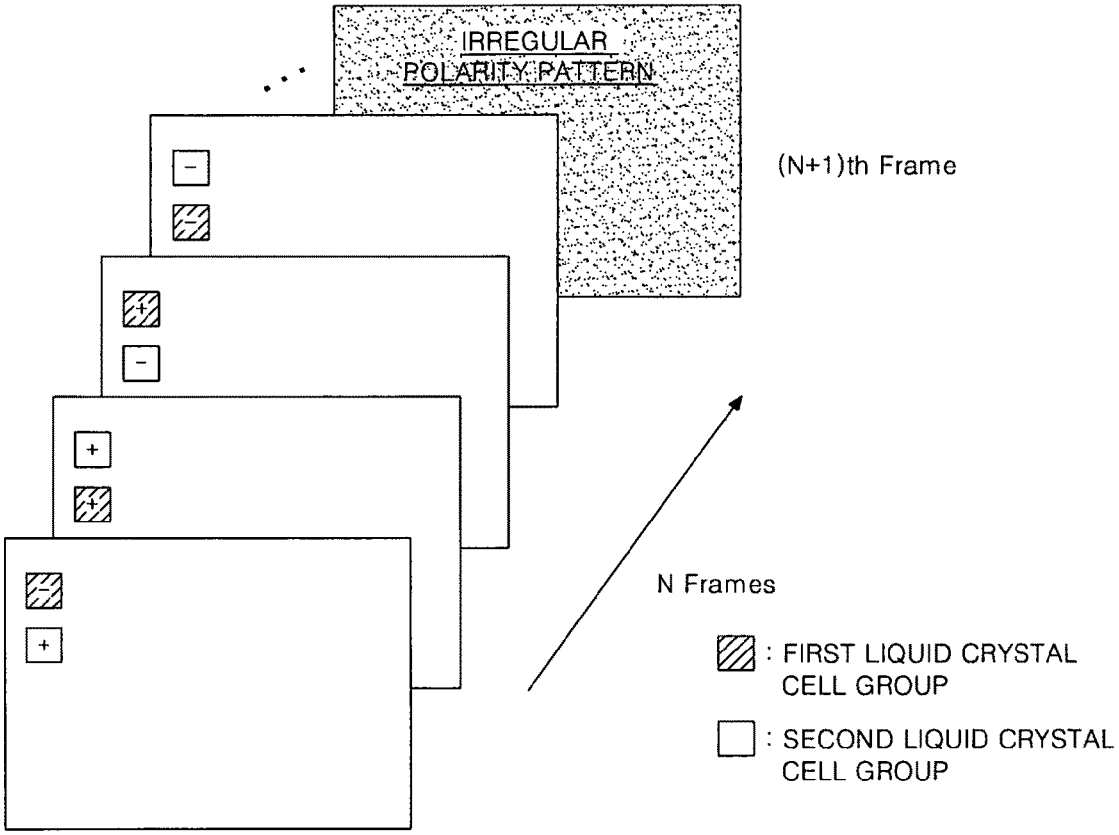
FIG. 18 is a diagram illustrating an exemplary polarity pattern of data voltages charged in first and second liquid crystal cell groups in the exemplary driving method of the liquid crystal display device according to the third embodiment of the present invention.
Figure 19A:
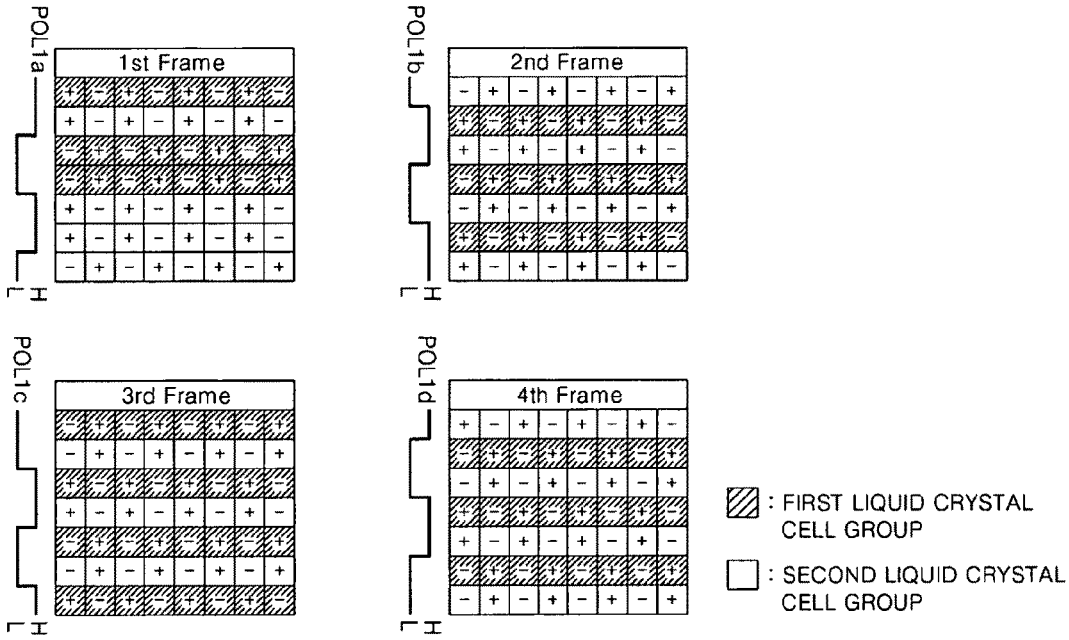
FIGS. 19A to 19E are diagrams illustrating an exemplary polarity pattern of the data voltages in the driving method of the liquid crystal display device according to the third embodiment of the present invention.
Figure 19B:
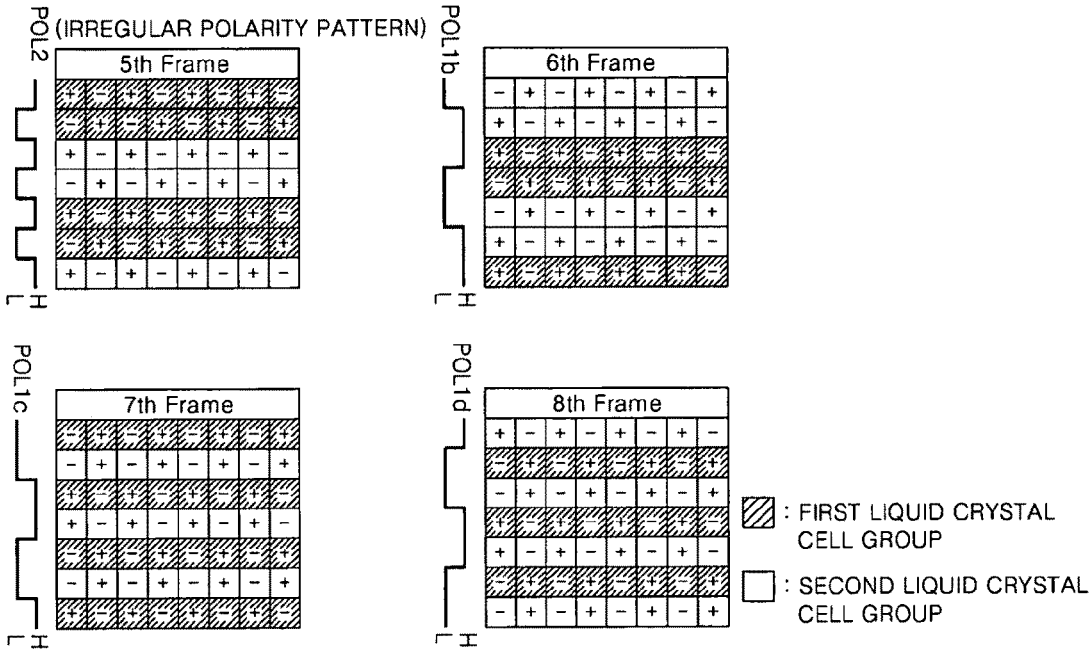
Figure 19C:
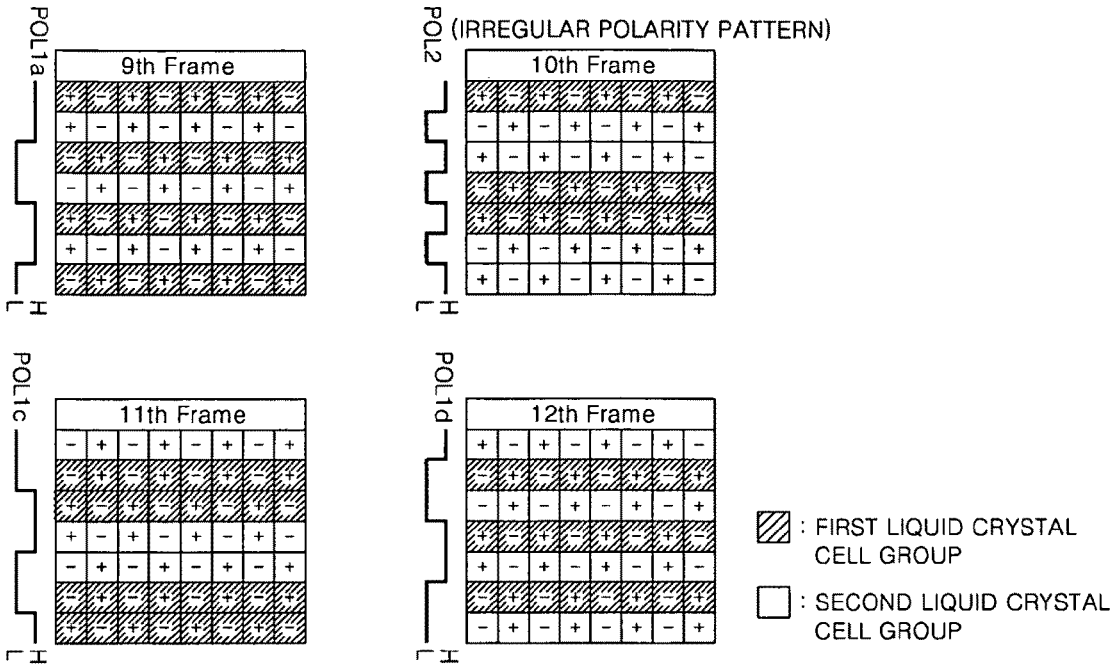
Figure 19D:
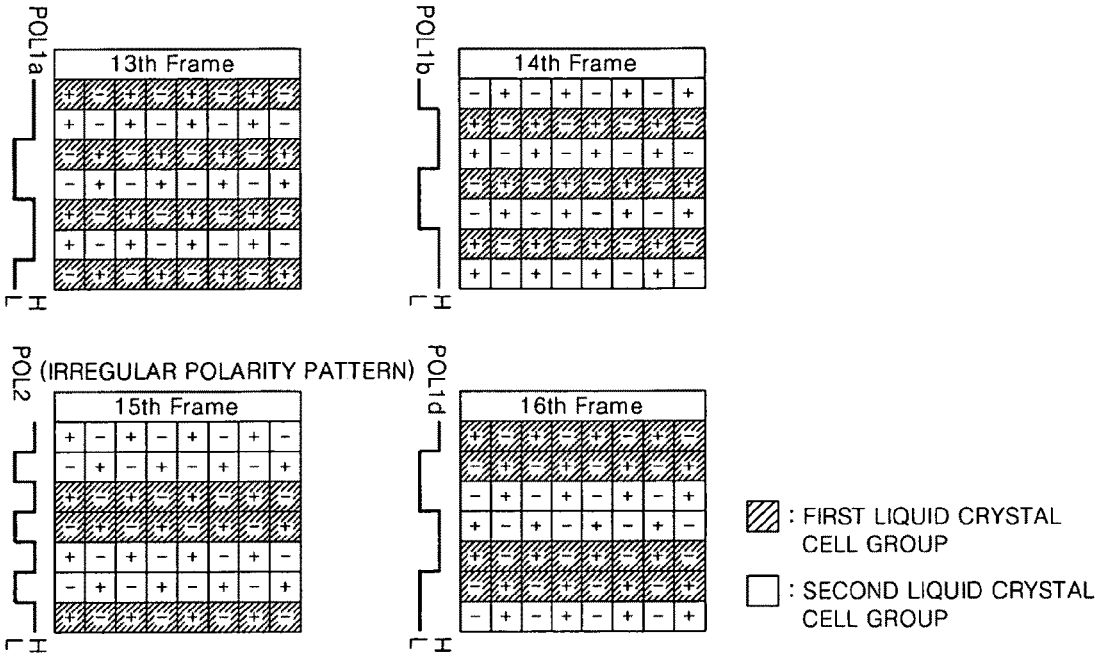
Figure 19E:
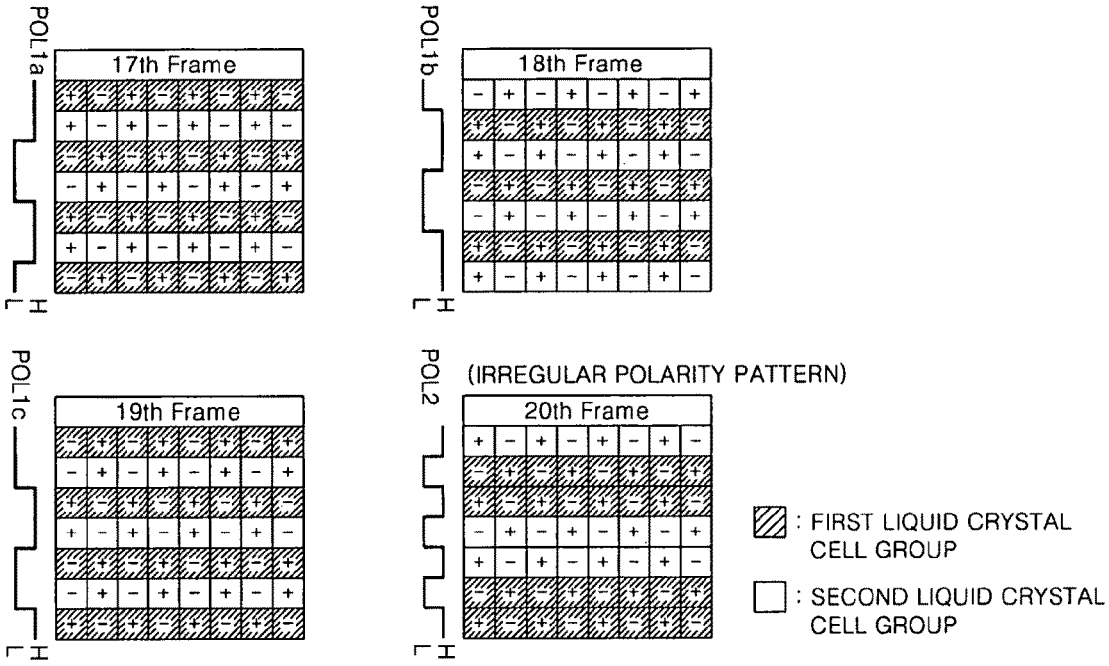

As shown in FIGS. 17 and 18, an exemplary driving method of a liquid crystal display device according to a third embodiment of the present invention controls the data voltage polarity frequency of the first liquid crystal cell group to be lower than the data voltage polarity frequency of the second liquid crystal cell group between two frame periods for N number of frame periods (where N is a positive integer of not less than 2). (Si) Each of the first and second liquid crystal cell groups includes a plurality of liquid crystal cells Clc.

The exemplary driving method of the liquid crystal display device according to the third embodiment of the present invention supplies a data voltage having a polarity pattern that is different than the polarity pattern supplied during N frame periods to the first and second liquid crystal cell groups at the (N+1)th frame period. (S2) Hereinafter, the polarity pattern supplied at the (N+1)th frame period is referred to as an "irregular polarity pattern." The irregular polarity pattern is a polarity pattern supplied to the liquid crystal cells Clc that makes the polarity pattern being supplied to be come irregular, i.e., a polarity pattern that is different from the polarity pattern of the data voltage supplied to the liquid crystal cells of the first and second liquid crystal cell groups for the N frame periods prior to the (N+1)th frame period.

FIGS. 19A to 19E illustrate an example of an irregular polarity pattern periodically inserted into a polarity pattern of data voltages. As shown in FIGS. 19A to 19E, the exemplary driving method of the liquid crystal display device according to the third embodiment of the present invention repeats the polarity pattern of the data voltages over 20 frame periods. However, the polarity pattern may be repeated over other number of frame periods without departing from the scope of the present invention.

In each of the (4i+1)th to (4i+4)th frame periods (where i is a 0 and positive integer), the liquid crystal cells Clc of the first and second liquid crystal cell groups are charged with data voltages having a polarity pattern where the polarities of the data voltages are inverted at every two horizontal periods in a vertical direction by the first polarity control signals POL1*a* to POL1*d* of which the logics are inverted for every two horizontal periods. In addition, the polarities of the horizontally adjacent data voltages are inverted. The first polarity control signals POL1*a* to POL1*d* generated for the (4i+1)th to (4i+4)th frame periods basically employs a vertical two-dot inversion method where the logic is inverted every two horizontal periods.

In the (5i)th frame period (where i is a positive integer), the liquid crystal cells Clc of the first and second liquid crystal cell groups are charged with data voltages having an irregular polarity pattern, e.g., a one-dot inversion type. That is to say, for the (5i)th frame period, the liquid crystal cells Clc of the first and second liquid crystal cell groups are charged with data voltages having a polarity pattern where the polarities of the data voltages are inverted for each horizontal period in the vertical direction by a second polarity control signal POL2, of which the logics are inverted every horizontal period. In addition the polarities of the horizontally adjacent data voltages are inverted. Accordingly, the first polarity control signals POL1*a* to POL1*d* are replaced with the second polarity control signal POL2 in the (5i)th frame period.

In each of the first, fourth, sixth, ninth, eleventh, fourteenth, sixteenth, nineteenth and twentieth frame periods, some of the liquid crystal cells Clc of the first and second liquid crystal cell groups maintain their locations and others are moved to another horizontal line in the next frame period. Therefore, in each of the third to eighth frame periods, thirteenth to eighteenth frame periods, the locations of the liquid crystal cells Clc of the first and second liquid crystal cell groups in the previous frame do not overlap with their locations in the next frame.

The (1a)th polarity control signal POL1*a* generated in the (4i+1)th frame period has an opposite phase as that of the (1c)th polarity control signal POL1*c* generated in the (4i+3)th frame period. The (1b)th polarity control signal POL1*b* generated in the (4i+2)th frame period has an opposite phase as that of the (1d)th polarity control signal POL1*d* generated in the (4i+4)th frame period. The (1a)th polarity control signal POL1*a* and the (1b)th polarity control signal POL1*b* have a phase difference of one horizontal period, and the (1c)th polarity control signal POL1*c* and the (1d)th polarity control signal POL1*d* also have a phase difference of horizontal period.

The exemplary driving method of the liquid crystal display device according to the third embodiment of the present invention controls the number of frame periods when the locations of the horizontal lines where there are the liquid crystal cells Clc of the first liquid crystal cell group are continuous to be not greater than 2, as shown in FIGS. 19A to 19E. The liquid crystal cells Clc of the first liquid crystal cell group have a relatively long polarity change cycle. Thus, if the location of the first liquid crystal cell group is the same for more than three frame periods, a difference in brightness compared to another horizontal line may occur, thereby creating a rippling noise effect.

Figure 20:
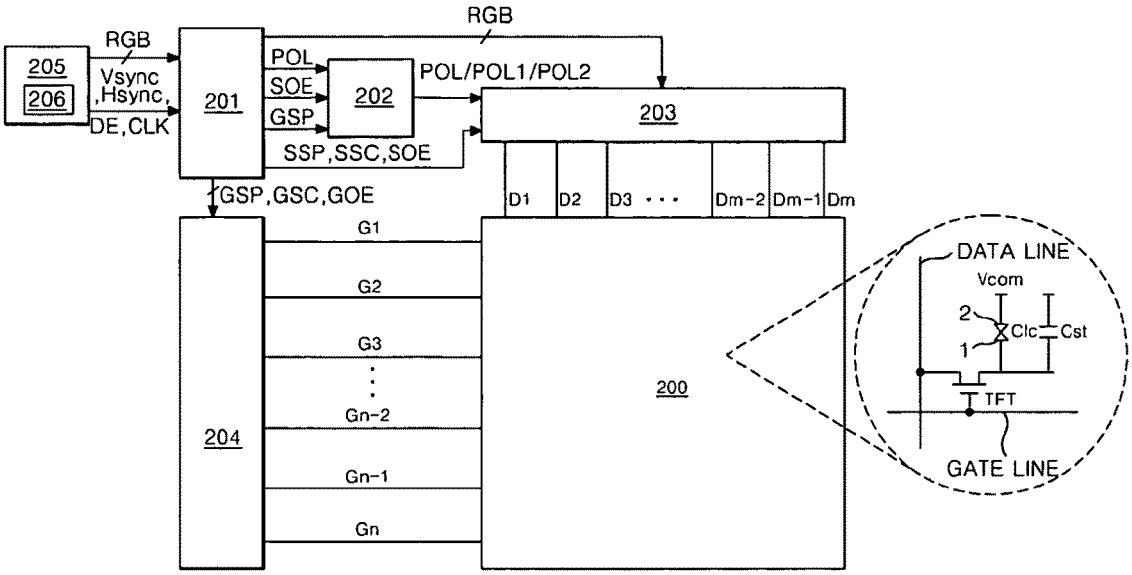
FIG. 20 is a block diagram illustrating an exemplary liquid crystal display device according to the third embodiment of the present invention.
Figure 21:
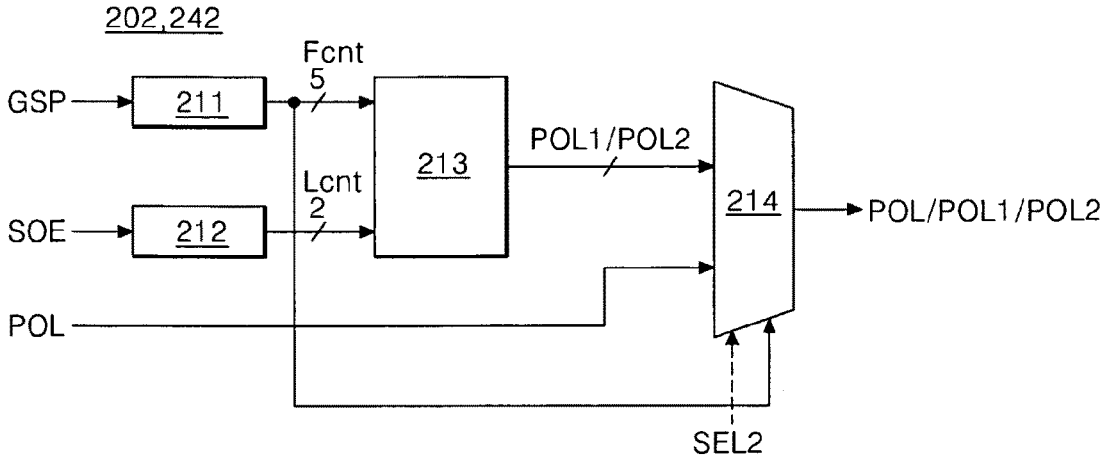
FIG. 21 is a block diagram illustrating an exemplary logic circuit shown in FIG. 20.

FIGS. 20 to 21 illustrate an exemplary liquid crystal display device according to the third embodiment of the present invention. As shown in FIG. 20, the exemplary liquid crystal display device according to the third embodiment of the present invention includes a liquid crystal display panel 200, a timing controller 201, a logic circuit 202, a data drive circuit 203, a gate drive circuit 204, and a video source 205. The video source 205 includes a line memory 206 for storing interlace data. The liquid crystal display panel 200, the timing controller 201, the data drive circuit 203, the gate drive circuit 204, and the video source 205 are substantially the same as those of the foregoing embodiments. Thus, a detail description thereof is omitted.

The logic circuit 202 receives gate start pulse GSP, source output enable signal SOE and reference polarity control signal POL, and generates first polarity control signal POL1 for the (4i+1)th to (4i+4)th frame periods and second polarity control signal POL2 for the (5i)th frame period. The first polarity control signal POL1 includes the (1a)th polarity control signal POL1*a* generated for the (4i+1)th frame period, the (1b)th polarity control signal POL1*b* generated for the (4i+2)th frame period, the (1c)th polarity control signal POL1*c* generated for the (4i+3)th frame period, and the (1d)th polarity control signal POL1*d* generated for the (4i+4)th frame period. Further, the logic circuit 202 may selectively transmit the reference polarity control signal POL to the data drive circuit 203 for all of the frame periods.

Figure 22:
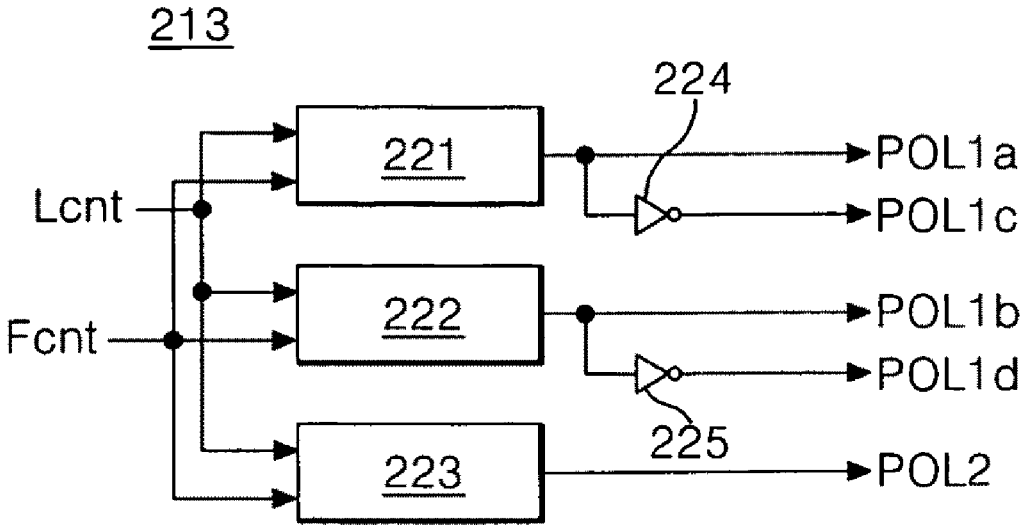
FIG. 22 is a block diagram illustrating an exemplary POL generation circuit shown in FIG. 21.

FIGS. 21 and 22 are exemplary circuit diagrams illustrating the logic circuit 202 shown in FIG. 20. As shown in FIGS. 21 and 22, the logic circuit 202 includes a frame counter 211, a line counter 212, a POL generation circuit 213, and a multiplexer 214.

The frame counter 211 outputs a frame count information Fcnt indicating the number of frames of a picture that is to be displayed in the liquid crystal display panel 200 in response to the gate start pulse GSP that is generated once for one frame period at the same time as a start of the frame period. The frame count information Fcnt is generated as a 2-bit information so as to be able to identify each of the 20 frame periods as shown in FIGS. 7 and 8, for example. Different number of bits may be used without departing from the scope of the invention.

The line counter 212 outputs a line count information Lcnt indicating a horizontal line that is to be displayed in the liquid crystal display panel 200 in response to the source output enable signal SOE that indicates a point of time when the data voltage is supplied to each horizontal line. The line count information Lcnt is generated as a 2-bit information because the polarity of the data voltage displayed in the liquid crystal display panel 200 is inverted every horizontal line or every two horizontal lines as shown in FIGS. 7 and 8, for example. Different number of bits may be used without departing from the scope of the invention.

For the timing signal to be supplied to the frame counter 211 and the line counter 212, a clock generated from an internal oscillator of the timing controller 201 may be used. However, the clock may increase EMI between the timing controller 201 and the logic circuit 202 because of the high frequency of the clock. In accordance with the present invention, an increase of EMI between the timing controller 201 and the logic circuit 202 may be reduced by using the source output enable signal SOE and the gate start pulse GSP as operation timing signals of the frame counter 211 and the line counter 212 since the frequency of these signals is lower than the clock generated by the internal oscillator of the timing controller 201.

The POL generation circuit 213 includes a first POL generation circuit 221, a second POL generation circuit 222, a third POL generation circuit 223, and first and second inverters 224, 225. The first POL generation circuit 221 generates the (1a)th polarity control signal POL1*a*, the polarity of which is inverted every two horizontal periods on the basis of the line count information Lcnt. The first inverter 224 inverts the (1a)th polarity control signal POL1*a* to generate the (1c)th polarity control signal POL1*c*. The second POL generation circuit 222 generates the (1b)th polarity control signal POL1*b*, the polarity of which is inverted every two horizontal periods and has a phase difference of about one horizontal period in comparison with the (1a)th polarity control signal POL1*a* on the basis of the line count information Lcnt. The second inverter 225 inverts the (1b)th polarity control signal POL1*b* to generate the (1d)th polarity control signal POL1*d*. The third POL generation circuit 223 generates the second polarity control signal POL2, the polarity of which is inverted every horizontal period on the basis of the line count information. Each of the first to third POL generation circuits 221, 222, 223 inverts the polarities of the polarity control signals POL1*a* to POL1*d*, POL2 for each frame period in response to the frame count information Fcnt.

The multiplexer 214 selects the polarity control signal POL1, POL2 from the POL generation circuit 213 corresponding to each frame period, as shown in FIGS. 19A to 19E, in response to the frame count information Fcnt. The multiplexer 214 may output the reference polarity control signal POL in all of the frame period through a separate option pin selected by a manufacturer. The option pin is connected to an option control terminal of the multiplexer 214 and is selectively connected to a ground voltage GND or a power supply voltage Vcc, thereby fixing the output of the multiplexer 214 to the reference polarity control signal POL.

Figure 23:
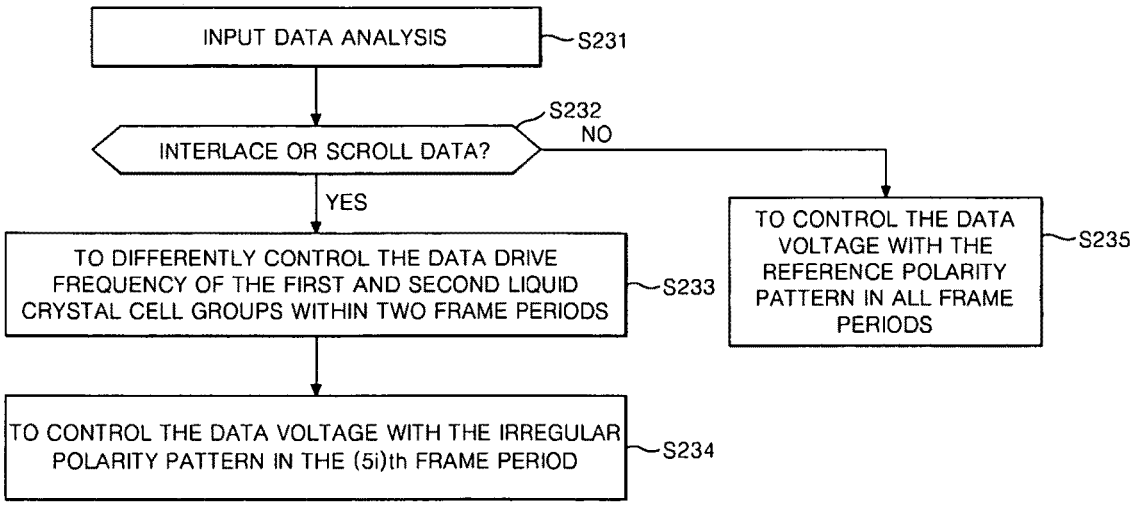
FIG. 23 is a flow chart illustrating an exemplary driving method of a liquid crystal display device according to a fourth embodiment of the present invention.

FIG. 23 is a flow chart illustrating an exemplary driving method of a liquid crystal display device according to a fourth embodiment of the present invention. As shown in FIG. 23, the driving method of the liquid crystal display device according to the fourth embodiment of the present invention analyzes input data and determines whether the input data is data with which DC image sticking is likely to occur, such as interlace data or scroll data. (S231, S232) In the step S232, if the currently input data is deemed to be data with which the DC image sticking will likely occur, the fourth embodiment of the present invention supplies the data voltage, the polarities of which are inverted every two frame periods, to the first liquid crystal cell group, which exists in the liquid crystal display panel for N number of frame periods, and controls the data voltage polarity frequency of the second liquid crystal cell group to be higher than the data voltage polarity frequency of the first liquid crystal cell group between two frame periods. (S233) Subsequently, the fourth embodiment of the present invention controls the polarity of the data voltage using an irregular polarity pattern for the (5i)th frame period. (S234) Accordingly, if the input data is deemed to be data with which DC image sticking will likely occur, such as interlace data and scroll data, the forth embodiment of the present invention controls the data voltage polarity frequency of the first liquid crystal cell group to be lower than the data voltage polarity frequency of the second liquid crystal cell group between two frame periods. In the step S232, if the currently input data is deemed to be data with which the DC image sticking will not be generated, the fourth embodiment of the present invention generates the reference polarity control signal POL in all of the frame periods to control the data voltage polarity frequency of the first and second liquid crystal cell groups to be the same. (S235)

Figure 24:
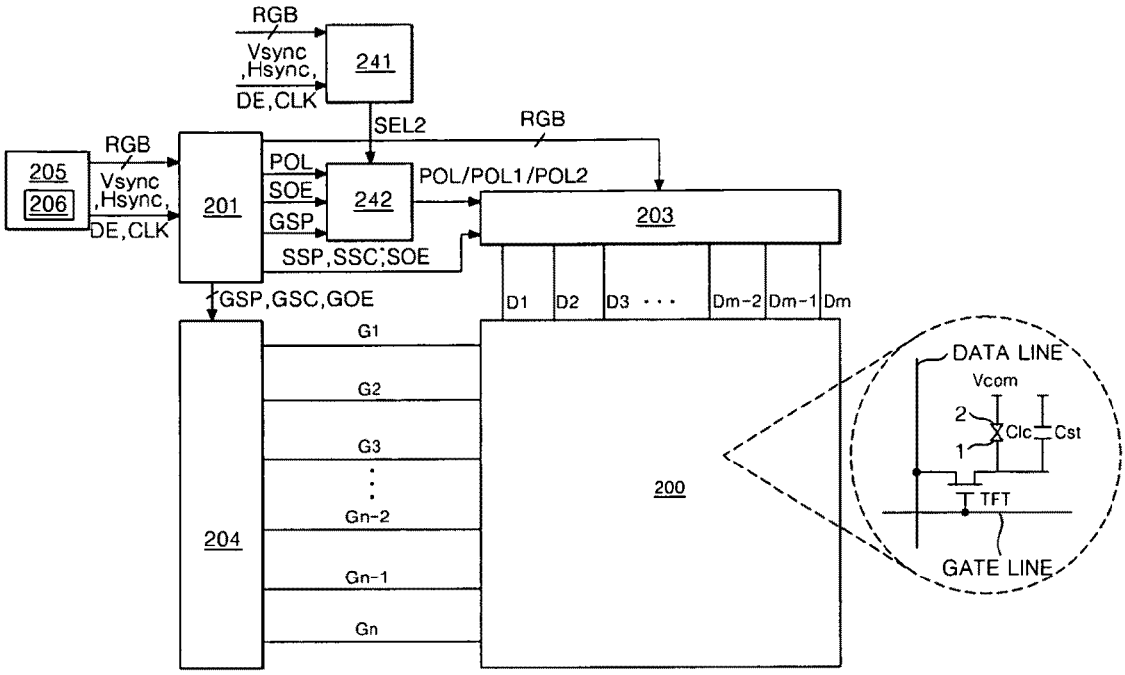
FIG. 24 is a block diagram illustrating an exemplary liquid crystal display device according to the fourth embodiment of the present invention.

FIG. 24 illustrates an exemplary liquid crystal display device according to the fourth embodiment of the present invention. As shown in FIG. 24, the liquid crystal display device according to the fourth embodiment of the present invention includes a video source 205, a liquid crystal display panel 200, an image analyzing circuit 241, a timing controller 201, a logic circuit 242, a data drive circuit 203, and a gate drive circuit 204. In this exemplary embodiment, the video source 205, the liquid crystal display panel 200, the timing controller 201, the data drive circuit 203, and the gate drive circuit 204 are substantially the same as the foregoing embodiments. Thus, the same reference numerals are given to the same components and a detail description thereof are omitted.

The image analyzing circuit 241 judges whether the digital video data of the currently input image is data with which DC image sticking will likely occur. The image analyzing circuit 241 compares the data between adjacent lines in one frame image and determines the currently input data to be interlace data if the data between the lines is more than a designated threshold value. Further, the image analyzing circuit 241 compares the data of each pixel by the unit of a frame and detects a moving picture in a display image and the speed of the moving picture. If the picture moves at a pre-set speed, the frame data including the moving picture is deemed to be scroll data. From the result of the image analysis, the image analyzing circuit 241 generates a selection signal SEL2 indicating presence of interlace data or scroll data, and controls the logic circuit 242 to generate the selection signal SEL2.

The logic circuit 242 sequentially generates the first polarity control signals POL1*a* to POL1*d* for the (4i+1)th to (4i+4)th frame periods, as shown in FIG. 13, in response to a first logic value of the selection signal SEL2 from the image analyzing circuit 241 and sequentially generates the second polarity control signal POL2 for the (5i)th frame period. When data that does not generate DC image sticking are input, the logic circuit 242 transmits the reference polarity control signal POL to the data drive circuit 203 in response to a second logic value of the selection signal SEL2. The timing controller 201, the image analyzing circuit 241, and the logic circuit 242 may be integrated into one chip.

Figure 25:
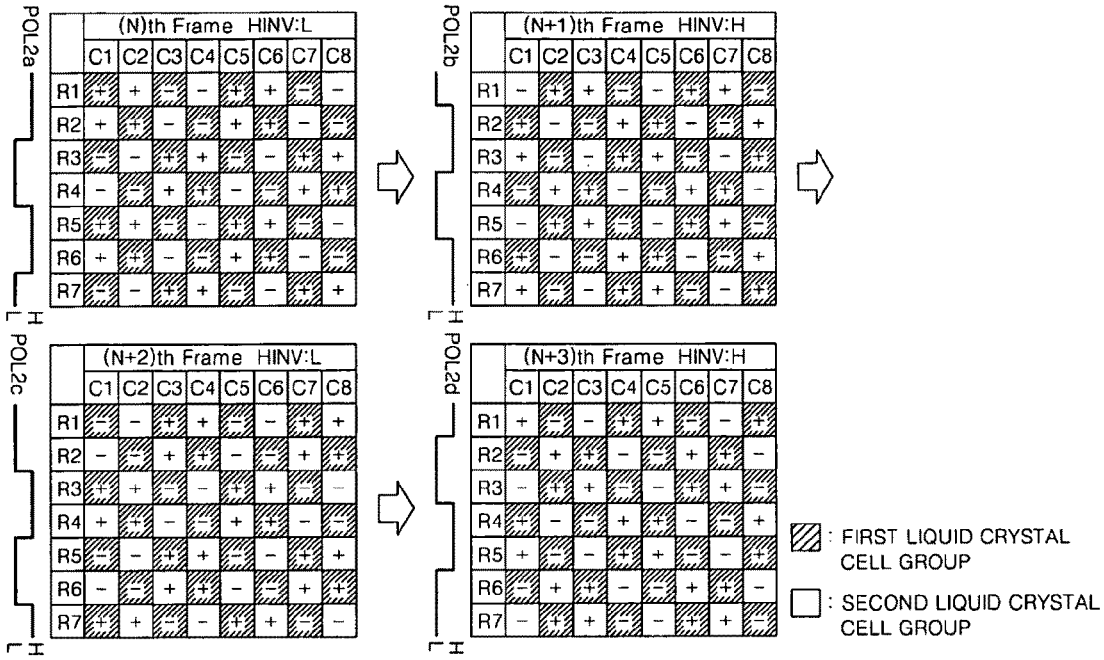
FIG. 25 is a diagram illustrating an exemplary polarity pattern of data voltages supplied to a liquid crystal display device according to a fifth embodiment of the present invention.

FIG. 25 illustrates an exemplary polarity pattern of data voltages supplied to a liquid crystal display device according to a fifth embodiment of the present invention. As shown in FIG. 25, an exemplary driving method of the liquid crystal display device according to the fifth embodiment of the present invention inverts the polarity of the data voltage charged in the liquid crystal cell Clc every two frame periods and controls a polarity inversion cycle of the data voltages supplied to the horizontally adjacent liquid crystal cells to be alternating.

For example, for the Nth frame period, positive (+) data voltages are supplied to the liquid crystal cells arranged on the (4j+1)th and (4j+2)th horizontal lines (where j is 0 and a positive integer) R1, R2, R5, R6 in the (4i+1)th and (4i+2)th vertical lines Cl, C2, C5, C6, and negative (−) data voltages are supplied to the liquid crystal cells arranged on the (4j+1)th and (4j+2)th horizontal lines R1, R2, R5, R6 in the (4i+3)th and (4i+4)th vertical lines C3, C4, C7, C8. For the Nth frame period, negative (−) data voltages are supplied to the liquid crystal cells arranged on the (4j+3)th and (4j+4)th horizontal lines R3, R4, R7 in the (4i+1)th and (4i+2)th vertical lines Cl, C2, C5, C6, and positive (+) data voltages are supplied to the liquid crystal cells arranged on the (4j+3)th and (4j+4)th horizontal lines R3, R4, R7 in the (4i+3)th and (4i+4)th vertical lines C3, C4, C7, C8.

For the (N+1)th frame period, positive (+) data voltages are supplied to the liquid crystal cells arranged on the (4j+1)th and (4j+4)th horizontal lines R1, R4, R5 in the (4i+2)th and (4i+3)th vertical lines C2, C3, C6, C7, and negative (−) data voltages are supplied to the liquid crystal cells arranged on the (4j+1)th and (4j+4)th horizontal lines R1, R4, R5 in the (4i+1)th and (4i+4)th vertical lines C1, C4, C5, C8. For the (N+1)th frame period, negative (−) data voltages are supplied to the liquid crystal cells arranged on the (4j+2)th and (4j+3)th horizontal lines R2, R3, R6, R7 in the (4i+2)th and (4i+3)th vertical lines C2, C3, C6, C7, and positive (+) data voltages are supplied to the liquid crystal cells arranged on the (4j+2)th and (4j+3)th horizontal lines R2, R3, R6, R7 in the (4i+1)th and (4i+4)th vertical lines C1, C4, C5, C8.

For the (N+2)th frame period, positive (+) data voltages are supplied to the liquid crystal cells arranged on the (4j+1)th and (4j+2)th horizontal lines R1, R2, R5, R6 in the (4i+3)th and (4i+4)th vertical lines C3, C4, C7, C8, and negative (−) data voltages are supplied to the liquid crystal cells arranged on the (4j+1)th and (4j+2)th horizontal lines R1, R2, R5, R6 in the (4i+1)th and (4i+2)th vertical lines C1, C2, C5, C6. For the (N+2)th frame period, negative (−) data voltages are supplied to the liquid crystal cells arranged on the (4j+3)th and (4j+4)th horizontal lines R3, R4, R7 in the (4i+3)th and (4i+4)th vertical lines C3, C4, C7, C8, and positive (+) data voltages are supplied to the liquid crystal cells arranged on the (4j+3)th and (4j+4)th horizontal lines R3, R4, R7 in the (4i+1)th and (4i+2)th vertical lines C1, C2, C5, C6.

For the (N+3)th frame period, positive (+) data voltages are supplied to the liquid crystal cells arranged on the (4j+1)th and (4j+4)th horizontal lines R1, R4, R5 in the (4i+1)th and (4i+4)th vertical lines C1, C4, C5, C8, and negative (−) data voltages are supplied to the liquid crystal cells arranged on the (4j+1)th and (4j+4)th horizontal lines R1, R4, R5 in the (4i+2)th and (4i+3)th vertical lines C2, C3, C6, C7. For the (N+3)th frame period, negative (−) data voltages are supplied to the liquid crystal cells arranged on the (4j+2)th and (4j+3)th horizontal lines R2, R3, R6, R7 in the (4i+1)th and (4i+4)th vertical lines C1, C4, C5, C8, and positive (+) data voltages are supplied to the liquid crystal cells arranged on the (4j+2)th and (4j+3)th horizontal lines R2, R3, R6, R7 in the (4i+2)th and (4i+3)th vertical lines C2, C3, C6, C7.

In the (N+4)th frame period, the liquid crystal cells are supplied with the data voltages of the same polarity pattern as the Nth frame period. In the (N+5)th frame period, the liquid crystal cells are supplied with the data voltages of the same polarity pattern as the (N+1)th frame period. In the (N+6)th frame period, the liquid crystal cells are supplied with the data voltages of the same polarity pattern as the (N+2)th frame period. In the (N+7)th frame period, the liquid crystal cells are supplied with the data voltages of the same polarity pattern as the (N+3)th frame period. In each frame period, the liquid crystal cells of the first liquid crystal cell group are arranged to alternate with the liquid crystal cells of the second liquid crystal cell group in both horizontal and vertical directions and the locations thereof are changed for each frame period.

As shown in FIG. 25, in accordance with the fifth embodiment of the present invention, the liquid crystal cells are supplied with data voltages having polarities that are inverted every two liquid crystal cells adjacent in the horizontal and vertical directions (i.e., two-dot inversion), and the liquid crystal cells of the first liquid crystal cell group are arranged in alternating fashion with the liquid crystal cells of the second liquid crystal cell group in each of the horizontal and vertical directions (one-dot inversion). The first liquid crystal cell group prevents DC image sticking and the second liquid crystal cell group prevents flicker by increasing the spatial frequency at which the polarity of the data voltage is changed on a screen of the liquid crystal display panel.

Figure 26:
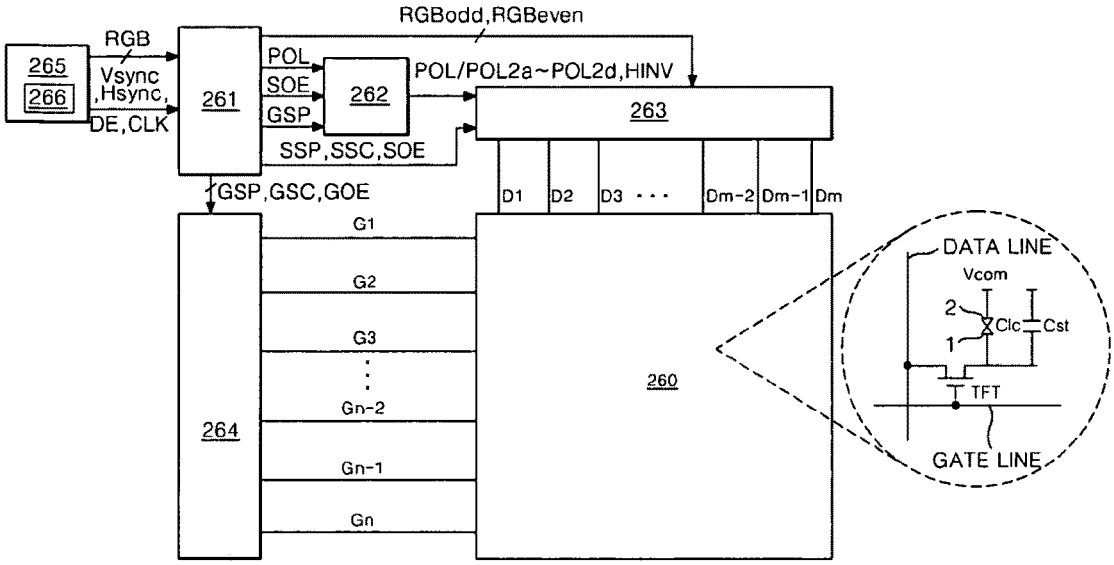
FIG. 26 is a block diagram illustrating an exemplary liquid crystal display device according to the fifth embodiment of the present invention.

FIGS. 26 to 30 illustrate an exemplary liquid crystal display device according to the fifth embodiment of the present invention. As shown in FIG. 26, the exemplary liquid crystal display device according to the fifth embodiment of the present invention includes a liquid crystal display panel 260, a timing controller 261, a logic circuit 262, a data drive circuit 263, a gate drive circuit 264, and a video source 265. The video source 265 includes a line memory 266 for storing interlace data. The liquid crystal display panel 260, the timing controller 261, the gate drive circuit 264, and the video source 265 are substantially the same as those of the foregoing embodiments. Thus, a detailed description thereof is omitted.

[The logic circuit 262 receives the gate start pulse GSP, the source output enable signal SOE, and the reference polarity control signal POL, and sequentially outputs the polarity control signal POL2*a* to POL2*d*, as shown in FIG. 25, or outputs the reference polarity control signal POL. The polarity control signals POL2*a* to POL2*d*, as shown in FIG. 25, shift the polarities of the data voltages by one liquid crystal cell, i.e., one-dot, in a vertical line direction for each frame. Further, the logic circuit 262 generates a horizontal output inversion signal HINV for inverting the polarities of the data voltages output from some of the output channels among the output channels of the data drive circuit and shifts the polarities of the data voltages by one liquid crystal cell, i.e., one-dot, in a horizontal line direction for each frame. The logic circuit 262 may be embedded within the timing controller 261.

The data drive circuit 263 latches the digital video data RGBodd, RGBeven under control of the timing controller 261, converts the digital video data RGBodd, RGBeven into positive/negative gamma compensation voltages in response to the polarity control signal POL/POL2*a*-POL2*d* from the logic circuit 262 to generate positive/negative analog data voltages, and then supplies the data voltages to the data lines D1 to Dm. The data drive circuit 263 inverts the polarity of the data voltage for each horizontal period or every two horizontal periods in response to the polarity control signals POL/POL2*a*-POL2*d* from the logic circuit 262. Further, the data drive circuit 263 inverts the polarities of the data voltages output through some of the adjacent output channels in response to the horizontal output inversion signal HINV from the logic circuit 262.

Figure 27:
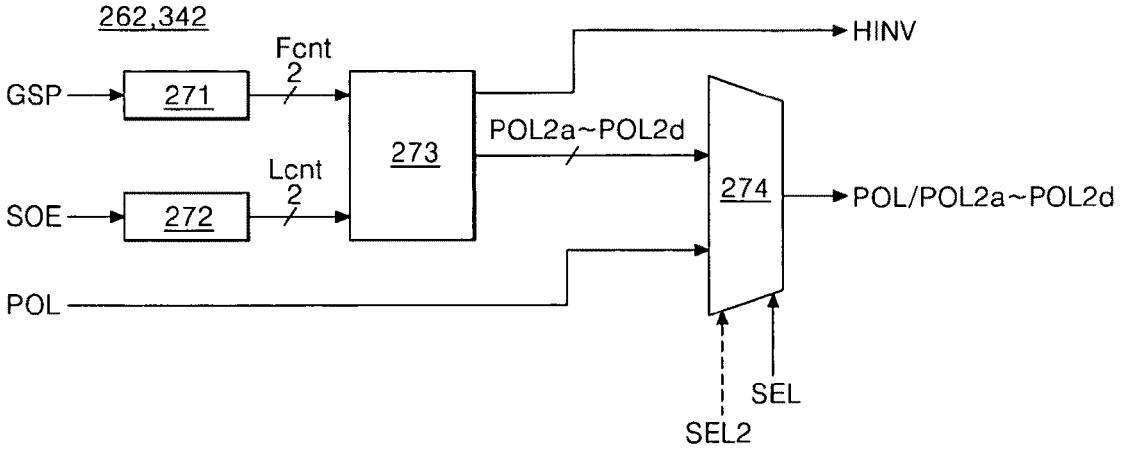
FIG. 27 is a block diagram illustrating an exemplary logic circuit shown in FIG. 26.
Figure 28:
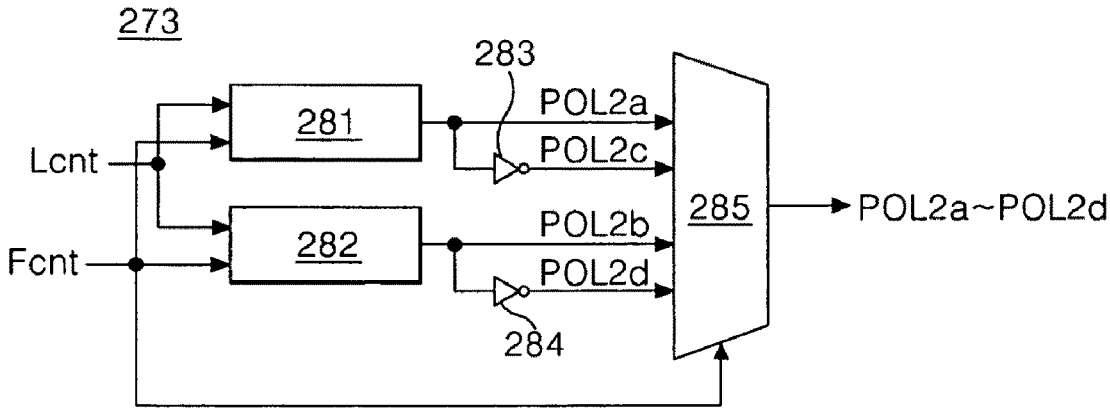
FIG. 28 is a block diagram illustrating an exemplary POL generation circuit shown in FIG. 27.

FIGS. 27 and 28 are exemplary circuit diagrams illustrating the logic circuit 262 shown in FIG. 26. As shown in FIGS. 27 and 28, the logic circuit 262 includes a frame counter 271, a line counter 272, a POL generation circuit 273, and a multiplexer 274. The frame counter 271 outputs a frame count information Fcnt indicating the number of frames of a picture that is to be displayed in the liquid crystal display panel 260 in response to the gate start pulse GSP that is generated once for one frame period at the same time as a start of the frame period. The frame count information Fcnt is generated as a 2-bit information so as to be able to identify each of 4 frame periods when assuming that the polarity pattern of the data voltages are generated for each four frame periods, as shown in FIGS. 7 and 15, for example. However, different number of bits may be used without departing from the scope of the invention.

The line counter 272 outputs a line count information Lcnt indicating a row, i.e., a horizontal line, in which the data are to be displayed in the liquid crystal display panel 260 in response to the source output enable signal SOE that indicates a point of time when the data voltage is output from the data drive circuit 263 for each horizontal period. The line count information Lcnt is generated as a 2-bit information. However, different number of bits may be used without departing from the scope of the invention.

The POL generation circuit 273 generates the horizontal output inversion signal HINV of 1 bit, for example, using the frame count information Fcnt and sequentially generates the first to fourth polarity control signals POL2*a* to POL2*d* using a first POL generation circuit 281, a second POL generation circuit 282, first and second inverters 283, 284, and a multiplexer 285. The logic of the horizontal output inversion signal HINV is inverted for each frame period, as shown in FIG. 32, for example, and controls the output of the data drive circuit 263 so that the polarity pattern of horizontal two-dot and vertical two-dot directions, as shown in FIG. 25, may be shifted in the row direction.

Figure 32:
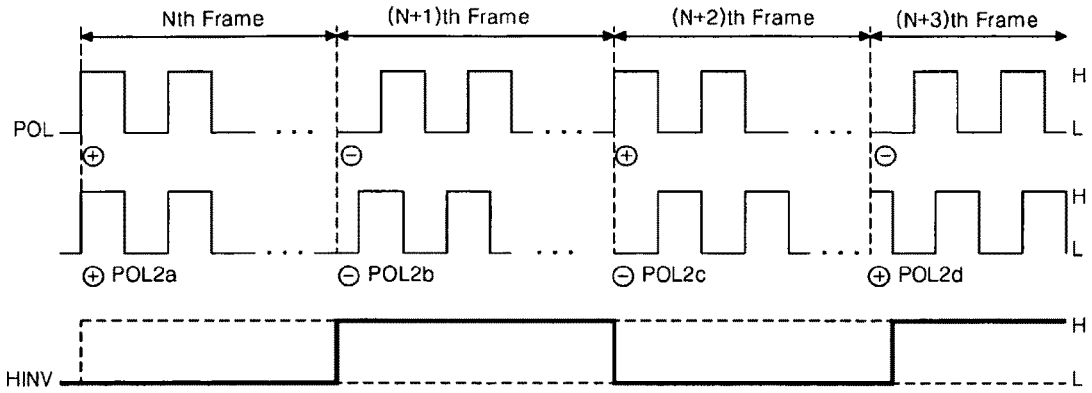
FIG. 32 is a waveform diagram illustrating an exemplary reference polarity control signal, first to fourth polarity control signals, and a horizontal output inversion signal.

In order to generate the polarity pattern as shown in FIG. 25, the horizontal output inversion signal HINV is generated to have a low logic in the Nth and (N+2)th frame periods and is generated to have a high logic in the (N+1)th and (N+3)th frame periods, as shown by a solid line waveform in FIG. 32, for example. The horizontal two dot inversion method includes supplying the liquid crystal cells with the data voltages having polarities that are inverted for each two liquid crystal cells, i.e., two-dots, adjacent in the horizontal direction, as shown in FIG. 25. The vertical two-dot inversion method is an inversion method includes supplying the liquid crystal cells with the data voltages having polarities that are inverted for each two liquid crystal cells, i.e., two-dots, adjacent in the vertical direction, as shown in FIGS. 7 and 15.

The first POL generation circuit 281 generates the first polarity control signal POL2*a*, the logic of which is inverted in accordance with the line count information Lcnt and the frame count information Fcnt. The first polarity control signal POL2*a* is generated to have high logic that indicates a positive (+) polarity of the data voltage in the first horizontal line R1 and the second horizontal line R2 and has its logic inverted every two rows from the first row to the nth row as shown in FIGS. 7 and 15, for example. The first inverter 283 inverts the first polarity control signal POL2*a* to generated a third polarity control signal POL2*c* which has an opposite phase as that of the first polarity control signal POL2*a*. Accordingly, the third polarity control signal POL2*c* is generated to have the low logic indicating a negative (−) polarity of the data voltage in the first horizontal line R1 and the second horizontal line R2 and its logic inverted every two rows from the first row to the nth row.

The second POL generation circuit 282 generates the second polarity control signal POL2*b*, the logic of which is inverted in accordance with the line count information Lcnt and the frame count information Fcnt. The second polarity control signal POL2*b* is generated to have low logic indicating the negative (−) polarity of the data voltage in the first horizontal line R1 and has its logic inverted every two rows from the second row to the nth row, as shown in FIGS. 7 and 15, for example. The second inverter 284 inverts the second polarity control signal POL2*b* to generated a fourth polarity control signal POL2*d* which has an opposite phase as that of the second polarity control signal POL2*b*. Accordingly, the fourth polarity control signal POL2*d* is generated to have high logic indicating the positive (+) polarity of the data voltage in the first horizontal line R1 and its logic inverted every two rows from the second row to the nth row.

The multiplexer 285 outputs the first polarity control signal POL2*a* for the Nth frame period in response to the frame count information Fcnt of 2-bits, for example, and outputs the second polarity control signal POL2*b* for the (N+1)th frame period, then outputs the third polarity control signal POL2*c* for the (N+2)th frame period, and then outputs the fourth polarity control signal POL2*d* for the (N+3)th frame period.

Any one of the first to fourth polarity control signals POL2*a* to POL2*d* output from the POL generation circuit 273 and the reference polarity control signal POL generated by an internal circuit of the timing controller 261 may be selected by the multiplexer 274. The multiplexer 274 selects the polarity control signals POL2*a* to POL2*d*, POL to be supplied to the data drive circuit 263 in accordance with a logic value of a control terminal connected to a POL selection option pin. The POL selection option pin is connected to the control terminal of the multiplexer 274 and may be selectively connected to a ground voltage GND or the power supply voltage Vcc by a manufacturer or a user. For example, if the POL selection option pin is connected to the ground voltage GND and the control terminal of the multiplexer 274, the multiplexer 274 has a selection control signal SEL of "0" supplied to its own control terminal, thereby outputting the reference polarity control signal POL. if the POL selection option pin is connected to the power supply voltage Vcc and the control terminal of the multiplexer 274, the multiplexer 274 has a selection control signal SEL of "1" supplied to its own control terminal, thereby outputting the first to fourth polarity control signals POL2*a* to POL2*d* from the POL generation circuit 273. The selection control signal SEL of the multiplexer 274 may be replaced with a user selection signal, which is input through a user interface, or a selection control signal, which is automatically generated in accordance with an analysis result of data.

Figure 29:
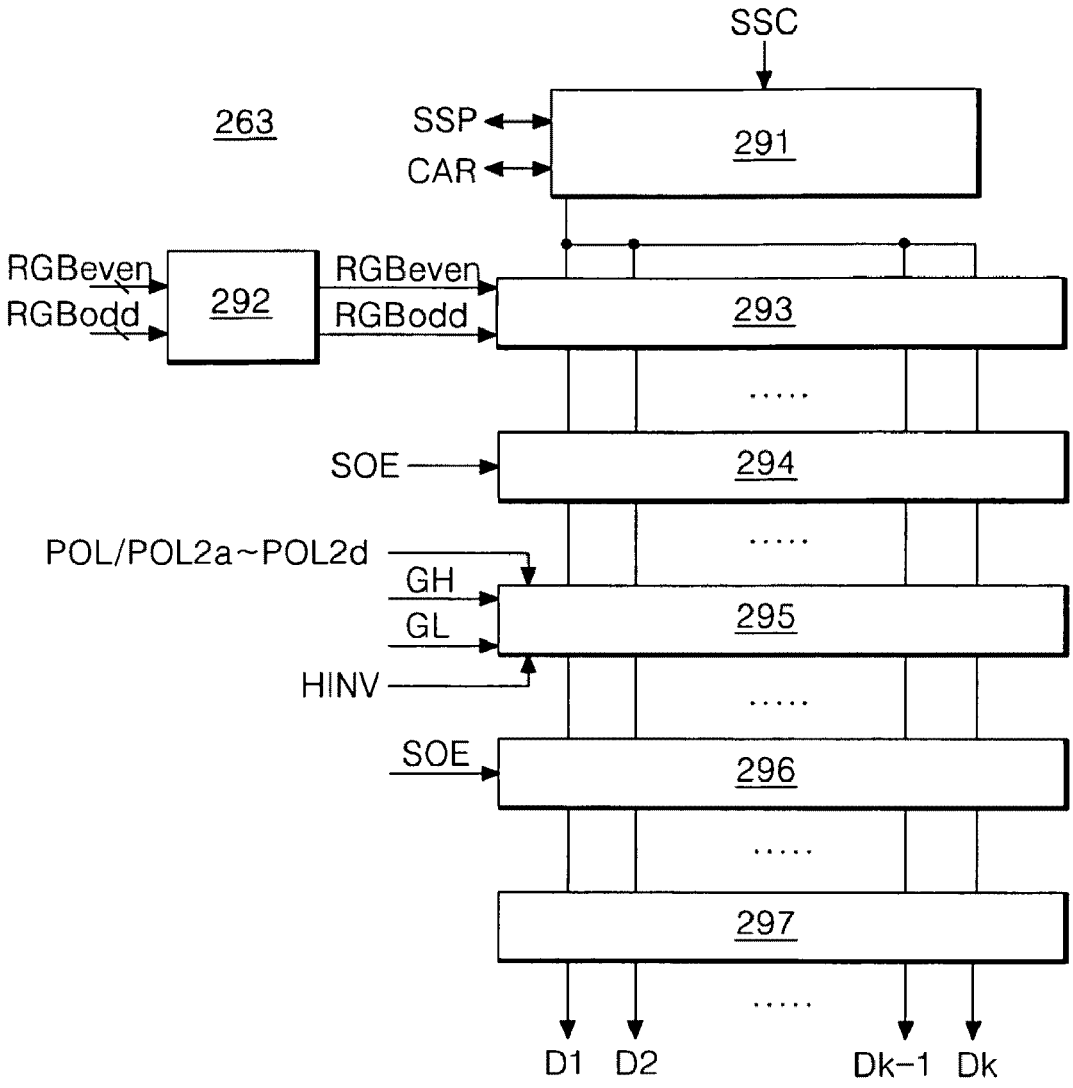
FIG. 29 is a block diagram illustrating an exemplary data drive circuit shown in FIG. 26.
Figure 30:
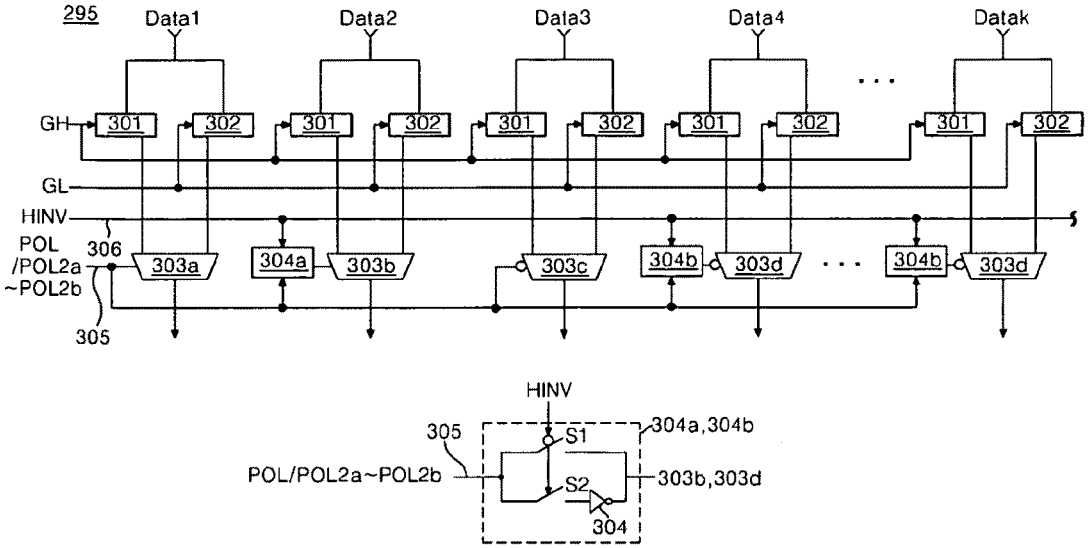
FIG. 30 is an exemplary circuit diagram illustrating the digital/analog converter shown in FIG. 29.

FIGS. 29 and 30 are exemplary circuit diagrams illustrating the data drive circuit 263. As shown in FIGS. 29 and 30, the data drive circuit 263 includes a plurality of integrated circuits ("ICs") of which each drives k number of data lines D1 to Dk (where k is an integer less than m). Each IC includes a shift register 291, a data register 292, a first latch 293, a second latch 294, a digital/analog converter (hereinafter, referred to as "DAC") 295, a charge share circuit 296, and an output circuit 297.

The shift register 291 shifts the source start pulse SSP from the timing controller 261 in accordance with the source sampling clock SSC to generate a sampling signal. Further, the shift register 291 shifts the source start pulse SSP to transmit a carry signal CAR to the shift register 291 of the next stage IC. The data register 292 temporarily stores an odd-numbered digital video data RGBodd and an even-numbered digital video data RGBeven which are divided by the timing controller 261 and supplies the stored data RGBodd, RGBeven to the first latch 293. The first latch 293 samples the digital video data RGBodd, RGBeven from the data register 292 in response to the sampling signal sequentially input from the shift register 291, latches the data RGBodd, RGBeven for each horizontal line, and outputs the data of one horizontal line portion at the same time. The second latch 294 outputs the digital video data which are latched at the same time as the second latch 294 of other ICs for a low logic period of the source output enable signal SOE after latching the data of one horizontal line portion inputted from the first latch 293.

The DAC 295 includes a P-decoder PDEC 301 which is supplied with a positive gamma reference voltage GH, an N-decoder NDEC 302 which is supplied with a negative gamma reference voltage GL, first to fourth multiplexers 303*a* to 303*d* which select between the output of the P-decoder 301 and the output of the N-decoder 302 in response to the polarity control signals POL/POL2*a*-POL2*d*, and horizontal output inversion circuits 304*a*, 304*b* which invert the logic of the polarity control signal POL/POL2*a*-POL2*b* supplied to the control terminal of the second and fourth multiplexers 303*b*, 303*d* in response to the horizontal output inversion signal HINV, as shown in FIG. 30. The P-decoder 301 decodes the digital video data input from the second latch 294 to output positive gamma compensation voltage corresponding to the gray level value of the data, and the N-decoder 302 decodes the digital video data input from the second latch 294 to output negative gamma compensation voltage corresponding to the gray level value of the data.

The multiplexer 303 includes the first and third multiplexers 303*a*, 303*c* directly controlled by the polarity control signal POL/POL2*a*-POL2*d*, and the second and fourth multiplexers 303*b*, 303*d* controlled by the output of the horizontal output inversion circuits 304*a*, 304*b*. The first multiplexer 303*a* alternately selects between the positive gamma compensation voltage and the negative gamma compensation voltage every two horizontal periods in response to the polarity control signal POL/POL2*a*-POL2*d* supplied to its own non-inversion control terminal and outputs the selected positive/negative gamma compensation voltage as the analog data voltage. The second multiplexer 303*b* alternately selects between the positive gamma compensation voltage and the negative gamma compensation voltage every two horizontal periods in response to the output of the horizontal output inversion circuit 304*a* supplied to its own non-inversion control terminal and outputs the selected positive/negative gamma compensation voltage as the analog data voltage. The third multiplexer 303*c* alternately selects between the positive gamma compensation voltage and the negative gamma compensation voltage every two horizontal periods in response to the polarity control signal POL/POL2*a*-POL2*d* supplied to its own inversion control terminal and outputs the selected positive/negative gamma compensation voltage as the analog data voltage. The fourth multiplexer 303*d* alternately selects between the positive gamma compensation voltage and the negative gamma compensation voltage every two horizontal periods in response to the output of the horizontal output inversion circuit 304*b* supplied to its own inversion control terminal, and outputs the selected positive/negative gamma compensation voltage as the analog data voltage.

The horizontal output inversion circuit 304*a*, 304*b* includes switch devices S1, S2 and an inverter 304. The horizontal output inversion circuit 304*a*, 304*b* controls the logic value of the selection control signal supplied to the non-inversion control terminal of the second multiplexer 303*b* and the inversion control terminal of the fourth multiplexer 303*d* in response to the horizontal polarity inversion signal HINV. The input terminal of the first switch device S1 is connected to a polarity control signal supply line 305, and the output terminal of the first switch device S1 is connected to the inversion/non-inversion control terminal of the second or fourth multiplexer 303*b*, 303*d*. The non-inversion control terminal of the first switch device S1 is connected to the horizontal output inversion signal supply line 306. The input terminal of the second switch device S2 is connected to the polarity control signal supply line 305 and the output terminal of the second switch device S2 is connected to the inverter 304. The inversion control terminal of the second switch device S2 is connected to a horizontal output inversion signal supply line 306. The inverter 304 is connected to the output terminal of the second switch device S2 and the inversion/non-inversion control terminal of the second or fourth multiplexer 303*b*, 303*d*.

Figure 31:
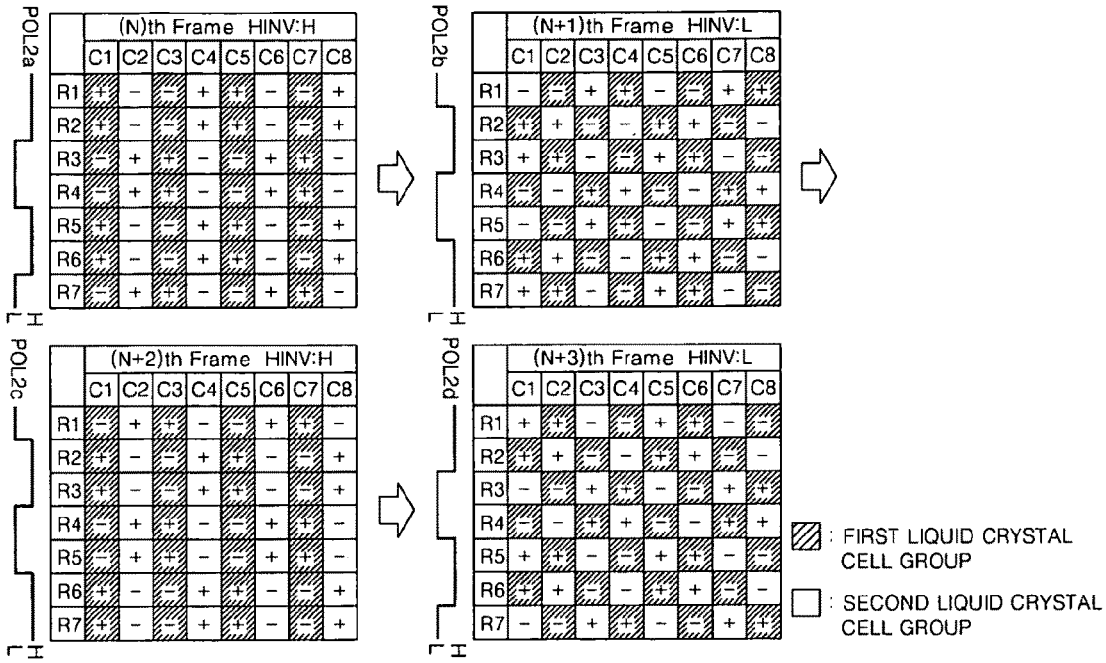
FIG. 31 is a diagram illustrating another exemplary polarity pattern of the data voltages supplied to the liquid crystal display device according to the fifth embodiment of the present invention.

As shown in FIGS. 25, 31 and 32, if the horizontal output inversion signal HINV is at a high logic level, the second switch device S2 is turned on and the first switch device S1 is turned off. Then, the non-inversion control terminal of the second multiplexer 303*b* is supplied with the inverted polarity control signals POL/POL2*a*-POL2*d*, and the inversion control terminal of the fourth multiplexer 303*d* is also supplied with the inverted polarity control signals POL/POL2*a*-POL2*d*. As a result, if the polarity control signals POL/POL2*a*-POL2*d* are at the high logic level and the horizontal output inversion signal HINV is at the high logic level, then the second multiplexer 303*b* outputs the negative gamma compensation voltage from the N-decoder 302 as the data voltage to be supplied to the (4i+2)th data lines D2, D6, . . . , Dm−2, and the fourth multiplexer 303*d* outputs the positive gamma compensation voltage from the P-decoder 301 as the data voltage to be supplied to the (4i+4)th data lines D4, D8, . . . , Dm. If the polarity control signals POL/POL2*a*-POL2*d* are at the low logic level and the horizontal output inversion signal HINV is at the high logic level, then the second multiplexer 303*b* outputs the positive gamma compensation voltage from the P-decoder 301 as the data voltage to be supplied to the (4i+2)th data lines D2, D6, . . . , Dm−2, and the fourth multiplexer 303*d* outputs the negative gamma compensation voltage from the N-decoder 302 as the data voltage to be supplied to the (4i+4)th data lines D4, D8, . . . , Dm.

If the horizontal output inversion signal HINV is at a low logic level, the first switch device S1 is turned on and the second switch device S2 is turned off. Then, the non-inversion control terminal of the second multiplexer 303*b* is supplied with the non-inverted polarity control signals POL/POL2*a*-POL2*d*, and the inversion control terminal of the fourth multiplexer 303*d* is also supplied with the non-inverted polarity control signals POL/POL2*a*-POL2*d*. As a result, if the polarity control signals POL/POL2*a*-POL2*d* are at the high logic level and the horizontal output inversion signal HINV is at the low logic level, then the second multiplexer 303*b* outputs the positive gamma compensation voltage from the P-decoder 301 as the data voltage to be supplied to the (4i+2)th data lines D2, D6, . . . , Dm−2, and the fourth multiplexer 303*d* outputs the negative gamma compensation voltage from the N-decoder 302 as the data voltage to be supplied to the (4i+4)th data lines D4, D8, . . . , Dm. If the polarity control signals POL/POL2*a*-POL2*d* are at the low logic level and the horizontal output inversion signal HINV is at the low logic level, then the second multiplexer 303*b* outputs the negative gamma compensation voltage from the N-decoder 302 as the data voltage to be supplied to the (4i+2)th data lines D2, D6 . . . , Dm−2, and the fourth multiplexer 303*d* outputs the positive gamma compensation voltage from the P-decoder 301 as the data voltage to be supplied to the (4i+4)th data lines D4, D8, . . . , Dm. Accordingly, the data voltages may be controlled by the present invention to be supplied to the liquid crystal cells with the polarity pattern of the horizontal two-dot and vertical two-dot inversion using the horizontal output inversion signal HINV and the polarity control signal POL/POL2*a*-POL2*d*.

FIG. 31 represents another example of the polarity pattern of the data voltages according to the fifth embodiment of the present invention. For purposes of example, FIG. 31 illustrates the polarity of the data voltage supplied to 8×7 liquid crystal cells for the Nth to (N+3)th frame periods. As shown in FIG. 31, for the Nth frame period, positive (+) data voltages are supplied to the liquid crystal cells arranged on the (4j+1)th and (4j+2)th horizontal lines R1, R2, R5, R6 in the (4i+1)th and (4i+4)th vertical lines C1, C4, C5, C8, and negative (−) data voltages are supplied to the liquid crystal cells arranged on the (4j+1)th and (4j+2)th horizontal lines R1, R2, R5, R6 in the (4i+2)th and (4i+3)th vertical lines C2, C3, C6, C7. For the Nth frame period, negative (−) data voltages are supplied to the liquid crystal cells arranged on the (4j+3)th and (4j+4)th horizontal lines R3, R4, R7 in the (4i+1)th and (4i+4)th vertical lines C1, C4, C5, C8, and positive (+) data voltages are supplied to the liquid crystal cells arranged on the (4j+3)th and (4j+4)th horizontal lines R3, R4, R7 in the (4i+2)th and (4i+3)th vertical lines C2, C3, C6, C7. For the Nth frame period, the first liquid crystal cell group charged with the data voltages of the same polarity from the (N−1)th frame period (not shown, but would have the same polarity pattern as the (N+3)th frame period) includes the liquid crystal cells arranged in the (4i+1)th and (4i+3)th vertical lines C1, C3, C5, C7. Additionally, for the Nth frame period, the second liquid crystal cell group charged with the data voltages of opposite polarities to the polarities of the (N−1)th frame period includes the liquid crystal cells arranged in the (4i+2)th and (4i+4)th vertical lines C2, C4, C6, C8.

For the (N+1)th frame period, positive (+) data voltages are supplied to the liquid crystal cells arranged on the (4j+1)th and (4j+4)th horizontal lines R1, R4, R5 in the (4i+3)th and (4i+4)th vertical lines C3, C4, C7, C8, and negative (−) data voltages are supplied to the liquid crystal cells arranged on the (4j+1)th and (4j+4)th horizontal lines R1, R4, R5 in the (4i+1)th and (4i+2)th vertical lines C1, C2, C5, C6. For the (N+1)th frame period, negative (−) data voltages are supplied to the liquid crystal cells arranged on the (4j+2)th and (4j+3)th horizontal lines R2, R3, R6, R7 in the (4i+3)th and (4i+4)th vertical lines C3, C4, C7, C8, and positive (+) data voltages are supplied to the liquid crystal cells arranged on the (4j+2)th and (4j+3)th horizontal lines R2, R3, R6, R7 in the (4i+1)th and (4i+2)th vertical lines C1, C2, C5, C6. For the (N+1)th frame period, the liquid crystal cells of the first liquid crystal cell group are arranged in alternating fashion with the liquid crystal cells of the second liquid crystal cell group in each of row and column directions.

For the (N+2)th frame period, positive (+) data voltages are supplied to the liquid crystal cells arranged on the (4j+1)th and (4j+4)th horizontal lines R1, R4, R5 in the (4i+2)th and (4i+3)th vertical lines C2, C3, C6, C7, and negative (−) data voltages are supplied to the liquid crystal cells arranged on the (4j+1)th and (4j+4)th horizontal lines R1, R4, R5 in the (4i+1)th and (4i+4)th vertical lines C1, C4, C5, C8. For the (N+2)th frame period, negative (−) data voltages are supplied to the liquid crystal cells arranged on the (4j+2)th and (4j+3)th horizontal lines R2, R3, R6, R7 in the (4i+2)th and (4i+3)th vertical lines C2, C3, C6, C7, and positive (+) data voltages are supplied to the liquid crystal cells arranged on the (4j+2)th and (4j+3)th horizontal lines R2, R3, R6, R7 in the (4i+1)th and (4i+4)th vertical lines C1, C4, C5, C8. For the (N+2)th frame period, the first liquid crystal cell group charged with the data voltages of the same polarity from the (N+1)th frame period includes the liquid crystal cells arranged in the (4i+1)th and (4i+3)th vertical lines C1, C3, C5, C7. Additionally, for the (N+2)th frame period, the second liquid crystal cell group charged with the data voltages of opposite polarities to the polarities of the (N+1)th frame period includes the liquid crystal cells arranged in the (4i+2)th and (4i+4)th vertical lines C2, C4, C6, C8.

For the (N+3)th frame period, positive (+) data voltages are supplied to the liquid crystal cells arranged on the (4j+1)th and (4j+2)th horizontal lines R1, R2, R5, R6 in the (4i+1)th and (4i+2)th vertical lines C1, C2, C5, C6, and negative (−) data voltages are supplied to the liquid crystal cells arranged on the (4j+1)th and (4j+2)th horizontal lines R1, R2, R5, R6 in the (4i+3)th and (4i+4)th vertical lines C3, C4, C7, C8. For the (N+3)th frame period, negative (−) data voltages are supplied to the liquid crystal cells arranged on the (4j+3)th and (4j+4)th horizontal lines R3, R4, R7 in the (4i+1)th and (4i+2)th vertical lines C1, C2, C5, C6, and positive (+) data voltages are supplied to the liquid crystal cells arranged on the (4j+3)th and (4j+4)th horizontal lines R3, R4, R7 in the (4i+3)th and (4i+4)th vertical lines C3, C4, C7, C8. For the (N+3)th frame period, the liquid crystal cells of the first liquid crystal cell group are arranged in alternating fashion with the liquid crystal cells of the second liquid crystal cell group in each of horizontal and vertical directions.

In the (N+4)th frame period, the liquid crystal cells are supplied with the data voltages of the same polarity pattern as the Nth frame period. In the (N+5)th frame period, the liquid crystal cells are supplied with the data voltages of the same polarity pattern as the (N+1)th frame period. In the (N+6)th frame period, the liquid crystal cells are supplied with the data voltages of the same polarity pattern as the (N+2)th frame period. In the (N+7)th frame period, the liquid crystal cells are supplied with the data voltages of the same polarity pattern as the (N+3)th frame period.

Figure 33:
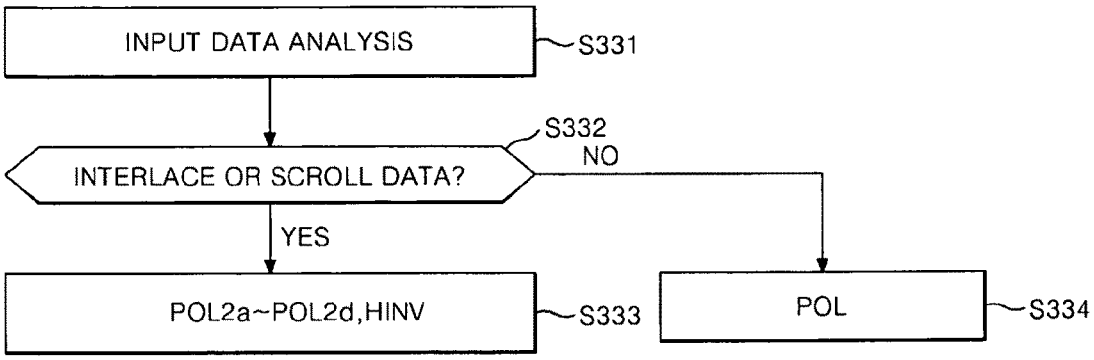
FIG. 33 is a flow chart illustrating an exemplary driving method of a liquid crystal display device according to a sixth embodiment of the present invention.

FIG. 33 is a flow chart illustrating an exemplary driving method of a liquid crystal display device according to a sixth embodiment of the present invention. As shown in FIG. 33, the exemplary driving method of the liquid crystal display device according to the sixth embodiment of the present invention analyzes input data and determines whether the input data is data with which DC image sticking will likely occur, such as interlace data or scroll data. (S331, 5332) In the step S332, if the currently input data is deemed to be data with which DC image sticking will likely occur, the present invention sequentially generates the first to fourth polarity control signals POL2*a* to POL2*d* for each frame period and controls the data voltage polarity frequency of the first liquid crystal cell group to be lower than the data voltage polarity frequency of the second liquid crystal cell group between two frame periods. Further, the horizontal output inversion signal HINV is generated and controls the polarities of the data voltages to be charged in the horizontally adjacent liquid crystal cells differently for each frame period. (S333) In the step S332, if the currently input data is deemed not to generate DC image sticking, the reference polarity control signal POL, the polarity of which is inverted for each frame period in all of the frame periods, is generated and controls the data voltage polarity frequency of the first and second liquid crystal cell groups to be the same. (S334)

Figure 34:
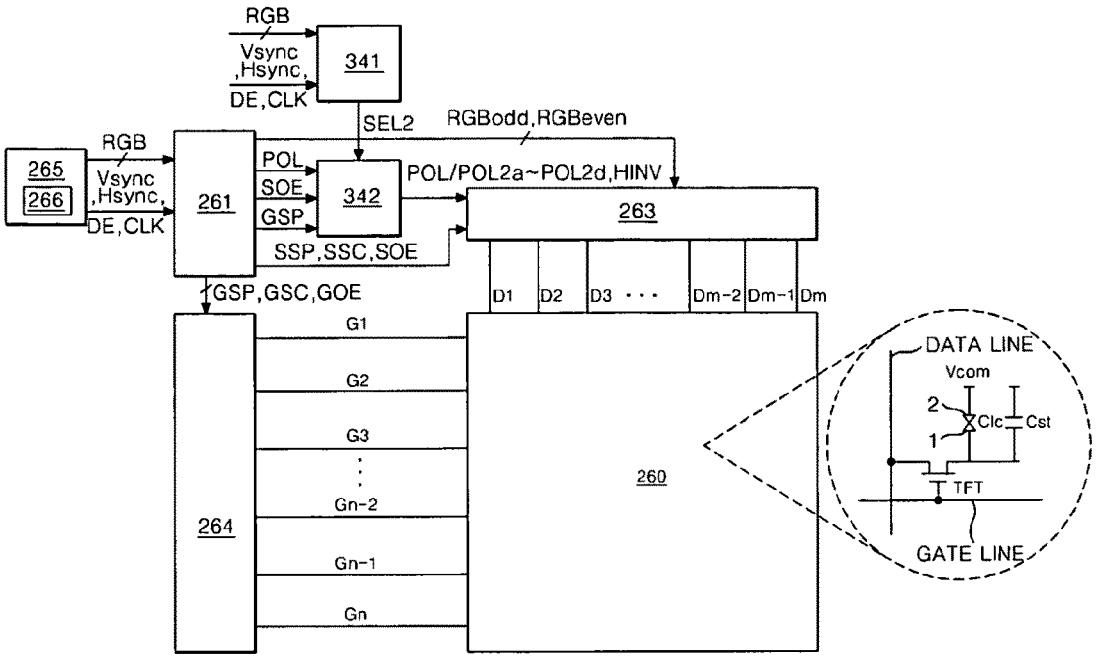
FIG. 34 is a block diagram illustrating an liquid crystal display device according to the sixth embodiment of the present invention.

FIG. 34 illustrates an exemplary liquid crystal display device according to the sixth embodiment of the present invention. As shown in FIG. 34, the liquid crystal display device according to the sixth embodiment of the present invention includes a video source 265, a liquid crystal display panel 260, an image analyzing circuit 341, a timing controller 261, a logic circuit 342, a data drive circuit 263, and a gate drive circuit 264. In this exemplary embodiment, the video source 265, the liquid crystal display panel 260, the timing controller 261, the data drive circuit 263, and the gate drive circuit 264 are substantially the same as the foregoing embodiments. Thus, the same reference numerals are given to the same components and a detail description thereof is omitted.

The image analyzing circuit 341 determines whether the digital video data of the currently input image is data with which DC image sticking will likely occur. The image analyzing circuit 341 compares the data between adjacent lines in one frame image and determines the currently input data to be interlace data if the data between the lines is more than a designated threshold value. Further, the image analyzing circuit 341 compares the data of each pixel by the unit of a frame and detects a moving picture in a display image and the speed of the moving picture. If the picture moves at a pre-set speed, the frame data including the moving picture is deemed to be scroll data. Based on the result of the image analysis, the image analyzing circuit 341 generates a selection signal SEL2 indicating presence of interlace data or scroll data and controls the logic circuit 342, as shown in FIG. 11, for example, using the selection signal SEL2.

The logic circuit 342 sequentially generates the first to fourth polarity control signals POL2*a* to POL2*d*, as shown in FIG. 31, in response to a first logic value of the selection signal SEL2 from the image analyzing circuit 341 and generates the horizontal output inversion signal HINV. Further, the logic circuit 342 transmits the reference polarity control signal POL to the data drive circuit 263 when data that is not interlace data or scroll data are input in response to a second logic value of the selection signal SEL2.

The data drive circuit 263 latches the digital video data RGBodd, RGBeven under control of the timing controller 261 and converts the digital video data RGBodd, RGBeven into positive/negative gamma compensation voltages in response to the polarity control signal POL/POL2*a*-POL2*d* from the logic circuit 342 to generate positive/negative analog data voltages, and then supplies the data voltages to the data lines D1 to Dm. The data drive circuit 343 inverts the polarity of the data voltage with the polarity pattern in response to the polarity control signals POL/POL2*a*-POL2*d* from the logic circuit 342, thereby shifting the polarities of the data voltages in the column direction. Further, the data drive circuit 343 shifts the polarities of the data voltages in the row direction in response to the horizontal output inversion signal HINV from the logic circuit 342. The timing controller 261, the image analyzing circuit 341, and the logic circuit 342 may be integrated into one chip.

FIG. 35 illustrates an exemplary polarity pattern of data voltages supplied to a liquid crystal display device according to a seventh embodiment of the present invention. For purposes of example, FIG. 35 illustrates the polarities of the data voltages supplied to 8×7 liquid crystal cells for the Nth to (N+3)th frame periods.

For the Nth frame period, positive (+) data voltages are supplied to the liquid crystal cells arranged on odd-numbered horizontal lines R1, R3, R5, R7 in the (4i+1)th and (4i+4)th vertical lines (where i is 0 and a positive integer) Cl, C4, C5, C8, and negative (−) data voltages are supplied to the liquid crystal cells arranged on the odd-numbered horizontal lines R1, R3, R5, R7 in the (4i+2)th and (4i+3)th vertical lines C2, C3, C6, C7. For the Nth frame period, negative (−) data voltages are supplied to the liquid crystal cells arranged on even-numbered horizontal lines R2, R4, R6 in the (4i+1)th and (4i+4)th vertical lines Cl, C4, C5, C8, and positive (+) data voltages are supplied to the liquid crystal cells arranged on the even-numbered horizontal lines R2, R4, R6 in the (4i+2)th and (4i+3)th vertical lines C2, C3, C6, C7. For the Nth frame period, the first liquid crystal cell group for preventing DC image sticking includes the liquid crystal cells arranged on even-numbered vertical lines, and the second liquid crystal cell group for preventing flicker includes the liquid crystal cells arranged on odd-numbered vertical lines.

For the (N+1)th frame period, positive (+) data voltages are supplied to the liquid crystal cells arranged on the odd-numbered horizontal lines R1, R3, R5, R7 in the (4i+1)th and (4i+2)th vertical lines C1, C2, C5, C6, and negative (−) data voltages are supplied to the liquid crystal cells arranged on the odd-numbered horizontal lines R1, R3, R5, R7 in the (4i+3)th and (4i+4)th vertical lines C3, C4, C7, C8. For the (N+1)th frame period, negative (−) data voltages are supplied to the liquid crystal cells arranged on the even-numbered horizontal lines R2, R4, R6 in the (4i+1)th and (4i+2)th vertical lines C1, C2, C5, C6, and positive (+) data voltages are supplied to the liquid crystal cells arranged on the even-numbered horizontal lines R2, R4, R6 in the (4i+3)th and (4i+4)th vertical lines C3, C4, C7, C8. For the (N+1)th frame period, the first liquid crystal cell group for preventing DC image sticking includes the liquid crystal cells arranged on the odd-numbered vertical lines, and the second liquid crystal cell group for preventing flicker includes the liquid crystal cells arranged on the even-numbered vertical lines.

For the (N+2)th frame period, negative (−) data voltages are supplied to the liquid crystal cells arranged on the odd-numbered horizontal lines R1, R3, R5, R7 in the (4i+1)th and (4i+4)th vertical lines C1, C4, C5, C8, and positive (+) data voltages are supplied to the liquid crystal cells arranged on the odd-numbered horizontal lines R1, R3, R5, R7 in the (4i+2)th and (4i+3)th vertical lines C2, C3, C6, C7. For the (N+2)th frame period, positive (+) data voltages are supplied to the liquid crystal cells arranged on the even-numbered horizontal lines R2, R4, R6 in the (4i+1)th and (4i+4)th vertical lines C1, C4, C5, C8, and negative (−) data voltages are supplied to the liquid crystal cells arranged on the even-numbered horizontal lines R2, R4, R6 in the (4i+2)th and (4i+3)th vertical lines C2, C3, C6, C7. For the (N+2)th frame period, the first liquid crystal cell group for preventing DC image sticking includes the liquid crystal cells arranged on the even-numbered vertical lines, and the second liquid crystal cell group for preventing flicker includes the liquid crystal cells arranged on the odd-numbered vertical lines.

For the (N+3)th frame period, negative (−) data voltages are supplied to the liquid crystal cells arranged on the odd-numbered horizontal lines R1, R3, R5, R7 in the (4i+1)th and (4i+2)th vertical lines C1, C2, C5, C6, and positive (+) data voltages are supplied to the liquid crystal cells arranged on the odd-numbered horizontal lines R1, R3, R5, R7 in the (4i+3)th and (4i+4)th vertical lines C3, C4, C7, C8. For the (N+3)th frame period, positive (+) data voltages are supplied to the liquid crystal cells arranged on the even-numbered horizontal lines R2, R4, R6 in the (4i+1)th and (4i+2)th vertical lines C1, C2, C5, C6, and negative (−) data voltages are supplied to the liquid crystal cells arranged on the even-numbered horizontal lines R2, R4, R6 in the (4i+3)th and (4i+4)th vertical lines C3, C4, C7, C8. For the (N+3)th frame period, the first liquid crystal cell group for preventing DC image sticking includes the liquid crystal cells arranged on the odd-numbered vertical lines, and the second liquid crystal cell group for preventing flicker includes the liquid crystal cells arranged on the even-numbered vertical lines.

Figure 36:
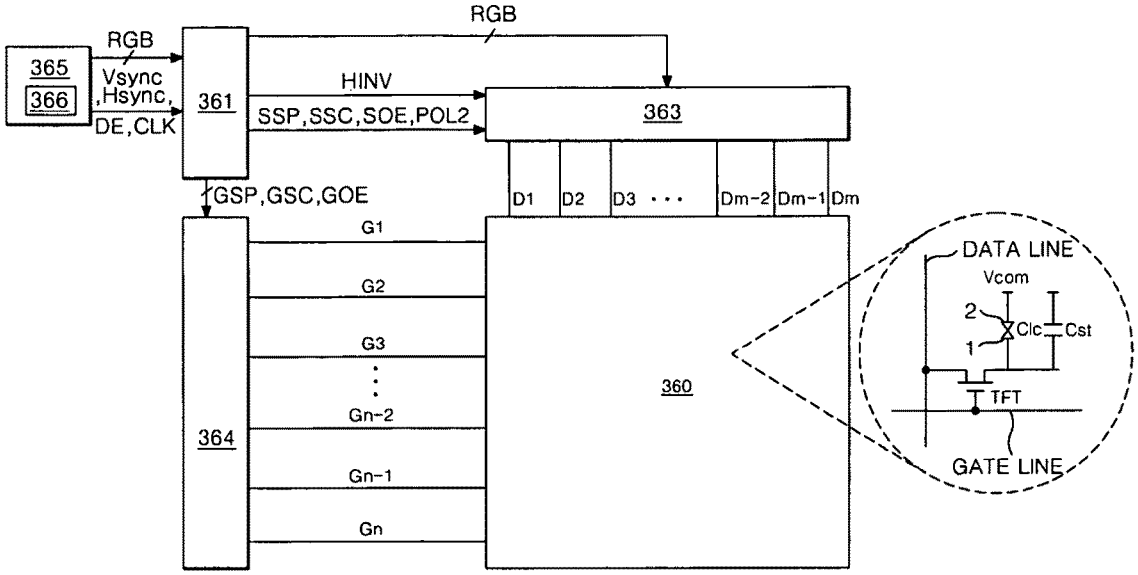
FIG. 36 is a block diagram illustrating an exemplary liquid crystal display device according to the seventh embodiment of the present invention.
Figure 37:
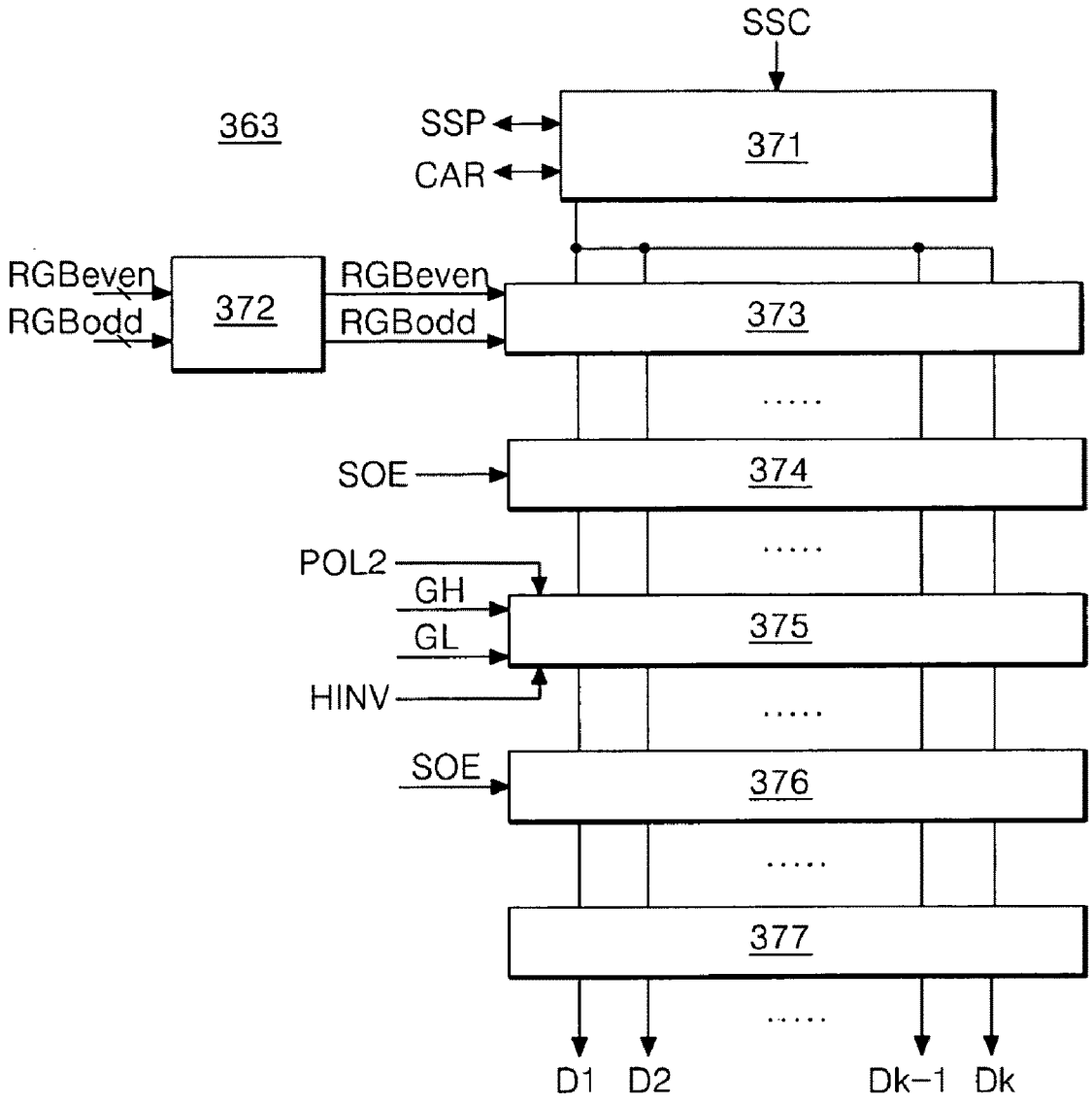
FIG. 37 is a block diagram illustrating an exemplary data drive circuit shown in FIG. 36.
Figure 38:
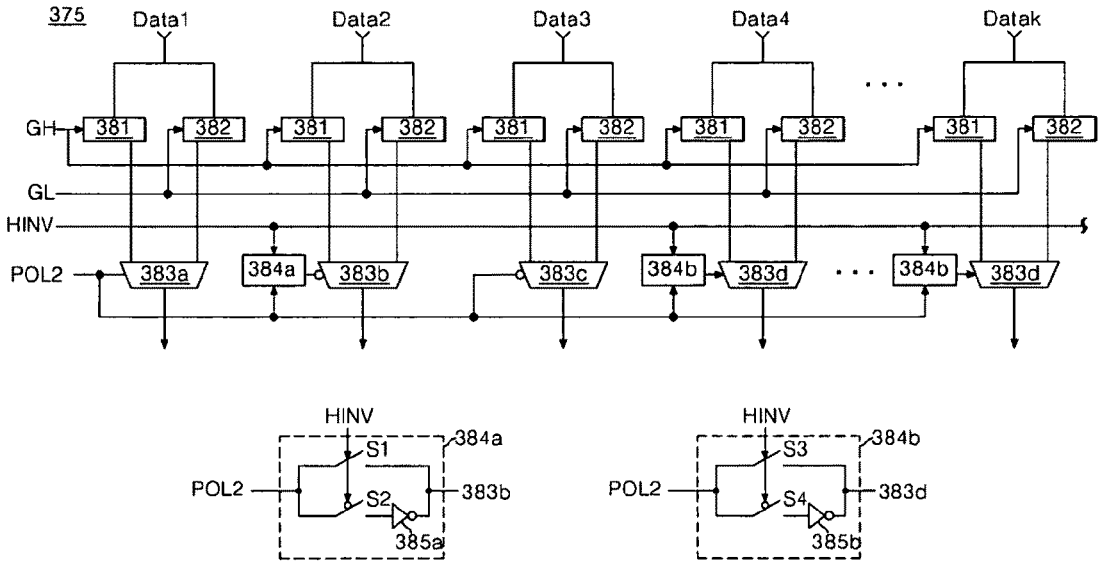
FIG. 38 is an exemplary circuit diagram illustrating the digital/analog converter shown in FIG. 37.

FIGS. 36 to 38 illustrate an exemplary liquid crystal display device according to the seventh embodiment of the present invention. As shown in FIG. 36, the exemplary liquid crystal display device according to the seventh embodiment of the present invention includes a video source 365, a liquid crystal display panel 360, a timing controller 361, a data drive circuit 363, and a gate drive circuit 364. The video source 365 includes a line memory 366 for storing interlace data. The video source 365, the liquid crystal display panel 360, and the gate drive circuit 364 are substantially the same as the foregoing embodiment. Thus, a detail description thereof is omitted.

The timing controller 361 receives timing signals such as vertical/horizontal synchronization signals Vsync, Hsync, data enables, clock signals CLK, and other signals to generate control signals for controlling the operation timing of the gate drive circuit 364 and the data drive circuit 363. The control signals include gate timing control signals such as a gate start pulse GSP, a gate shift clock signal GSC, a gate output enable signal GOE, and other control signals. Further, the control signals include a source start pulse SSP, a source sampling clock SSC, a source output enable signal SOE, a reference polarity control signal POL, and a horizontal output inversion signal HINV. The gate start pulse GSP indicates a start horizontal line from which a scan starts among a first vertical period when a screen is displayed. The gate shift clock signal GSC is input to a shift register within the gate drive circuit 364 and is generated to have a pulse width corresponding to the on-period of the TFT as a timing control signal for sequentially shifting the gate start pulse GSP. The gate output enable signal GOE indicates the output of the gate drive circuit 364. The source start pulse SSP indicates a start pixel in a first horizontal line where data are to be displayed. The source sampling clock SSC indicates a latch operation of the data within the data drive circuit 363 on the basis of a rising or falling edge. The source output enable signal SOE indicates the output of the data drive circuit 363. The polarity control signal POL2 indicates the polarities of the data voltages to be supplied to the liquid crystal cells Clc of the liquid crystal display panel 360. The logic of the polarity control signal POL2 is inverted for each horizontal period, as shown in FIG. 35. The horizontal output inversion signal HINV is a control signal for shifting the horizontal polarity pattern of the data voltages for each frame period by inverting some of the output of the data drive circuit 363.

The timing controller 361 divides the input digital video data RGB into the odd-numbered pixel data RGBodd and the even-numbered pixel data RGBeven in order to lower the transmission frequency of the digital video data and supplies the data to the data drive circuit 363. The data drive circuit 363 latches the digital video data RGBodd, RGBeven under control of the timing controller 361, converts the digital video data into the analog positive/negative gamma compensation voltages, and then supplies the data voltages of the polarity, which is selected in accordance with the polarity control signal POL2 and the horizontal output inversion signal HINV, to the data lines D1 to Dm. The data drive circuit 363 selects the polarity of the data voltage to be supplied to the liquid crystal cells arranged in the vertical direction in response to the polarity control signal POL2. Further, the data drive circuit 363 selects the polarity of the data voltage to be supplied to the liquid crystal cells arranged in the horizontal direction in accordance with the horizontal output inversion signal HINV. For the Nth and (N+2)th frame periods, the horizontal output inversion signal HINV is generated to have a high logic H. The data drive circuit 363 selects the polarities of the data voltages, which are supplied to four liquid crystal cells arranged in the horizontal direction, as shown in FIG. 35, to be "+−−+" or "−++−," in response to the horizontal output inversion signal. For the (N+1)th and (N+3)th frame periods, the horizontal output inversion signal HINV is generated to have a low logic L. The data drive circuit 363 selects the polarities of the data voltages, which are supplied to four liquid crystal cells arranged in the row direction, as shown in FIG. 35, to be "++−−" or "−−++," in response to the horizontal output inversion signal.

FIGS. 37 and 38 are exemplary circuit diagrams illustrating the data drive circuit 363. As shown in FIGS. 37 and 38, the data drive circuit 363 includes a plurality of integrated circuits ("ICs") of which each drives k number of data lines D1 to Dk (where k is an integer less than m). Each IC includes a shift register 371, a data register 372, a first latch 373, a second latch 374, a DAC 375, a charge share circuit 376, and an output circuit 377.

The shift register 371 shifts the source start pulse SSP from the timing controller 361 in accordance with the source sampling clock SSC to generate a sampling signal. Further, the shift register 371 shifts the source start pulse SSP to transmit a carry signal CAR to the shift register 371 of the next stage IC. The data register 372 temporarily stores an odd-numbered digital video data RGBodd and an even-numbered digital video data RGBeven which are divided by the timing controller 361 and supplies the stored data RGBodd, RGBeven to the first latch 373. The first latch 373 samples the digital video data RGBodd, RGBeven from the data register 372 in response to the sampling signal sequentially input from the shift register 371, latches the data RGBodd, RGBeven, and outputs the latched data at the same time. The second latch 374 outputs the latched data at the same time as the second latch 374 of other ICs for a low logic period of the source output enable signal SOE after latching the data input from the first latch 373.

The DAC 375 includes a P-decoder PDEC 381 which is supplied with a positive gamma reference voltage GH, an N-decoder NDEC 382 which is supplied with a negative gamma reference voltage GL, first to fourth multiplexers 383*a* to 383*d* which select from the output of the P-decoder 381 and the output of the N-decoder 382 in response to the polarity control signal POL2, and horizontal output inversion circuits 384*a*, 384*b* which inverts the logic of the selection control signal supplied to the control terminal of the multiplexer 383*a* to 383*d* in response to the horizontal output inversion signal HINV, as shown in FIG. 38. The P-decoder 381 decodes the digital video data input from the second latch 374 to output the positive gamma compensation voltage corresponding to the gray level value of the data, and the N-decoder 382 decodes the digital video data input from the second latch 374 to output the negative gamma compensation voltage corresponding to the gray level value of the data.

The multiplexers 383*a* to 383*d* include a (4i+1)th multiplexer 383*a* which outputs the data voltage to the output channel connected to the (4i+1)th data line D1, D5, D9, . . . , Dm−3, a (4i+2)th multiplexer 383*b* which outputs the data voltage to the output channel connected to the (4i+2)th data line D2, D6, D10, . . . , Dm−2, a (4i+3)th multiplexer 383*c* which outputs the data voltage to the output channel connected to the (4i+3)th data line D3, D7, D11, . . . , Dm−1, and a (4i+4)th multiplexer 383*d* which outputs the data voltage to the output channel connected to the (4i+4)th data line D4, D8, D12, . . . , Dm. The (4i+1)th multiplexer 383*a* selects between any one of the positive data voltage and the negative data voltage in response to a non-inversion logic value of the polarity control signal POL2. The (4i+2)th multiplexer 383*b* selects between any one of the positive data voltage and the negative data voltage in response to an inversion logic value of the polarity control signal POL2 of which the logic value is selectively inverted by the first horizontal output inversion circuit 384*a*. The (4i+3)th multiplexer 383*c* selects between any one of the positive data voltage and the negative data voltage in response to the inversion logic value of the polarity control signal POL2. The (4i+4)th multiplexer 383*d* selects between any one of the positive data voltage and the negative data voltage in response to the non-inversion logic value of the polarity control signal POL2 of which the logic value is selectively inverted by the second horizontal output inversion circuit 384*b*.

The horizontal output inversion circuits 384*a*, 384*b* include a first horizontal output inversion circuit 384*a* which selectively inverts the polarity control signal POL2 supplied to the inversion control terminal of the (4i+2)th multiplexer 383*b*, and a second horizontal output inversion circuit 384*b* which selectively inverts the polarity control signal POL2 supplied to the non-inversion control terminal of the (4i+4)th multiplexer 383*d*. The first horizontal output inversion circuit 384*a* includes first and second switch devices S1, S2 to which the polarity control signal POL2 is supplied in parallel and a first inverter 385*a* connected between the second switch device S2 and the inversion control terminal of the (4i+2)th multiplexer 383*b*. The first horizontal output inversion circuit 384*a* maintains the logic of the polarity control signal, which is supplied to the inversion control terminal of the (4i+2)th multiplexer 383*b*, intact for the Nth and (N+2)th frame periods but inverts the logic of the polarity control signal POL2, which is supplied to the inversion control terminal of the (4i+2)th multiplexer 383*b* for the (N+1)th and (N+3)th frame periods in response to the horizontal output inversion signal HINV of the high logic H.

The second horizontal output inversion circuit 384*b* includes third and fourth switch devices S3, S4 to which the polarity control signal POL2 is supplied in parallel and a second inverter 385*b* connected between the fourth switch device S4 and the inversion control terminal of the (4i+4)th multiplexer 383*d*. The third switch device S3 is turned on in response to the high logic H of the horizontal output inversion signal HINV and supplies the polarity control signal POL2 to the non-inversion control terminal of the (4i+4)th multiplexer 383*d*. The fourth switch device S4 is turned on in response to the low logic L of the horizontal output inversion signal HINV and supplies the polarity control signal POL2 to the second inverter 385*b*, thereby making the inverted polarity control signal POL2 to the non-inversion control terminal of the (4i+4)th multiplexer 383*d*. Accordingly, the second horizontal output inversion circuit 384*b* maintains the logic of the polarity control signal, which is supplied to the non-inversion control terminal of the (4i+4)th multiplexer 383*d*, intact for the Nth and (N+2)th frame periods, but inverts the logic of the polarity control signal POL2, which is supplied to the inversion control terminal of the (4i+4)th multiplexer 383*d* for the (N+1)th and (N+3)th frame periods, in response to the horizontal output inversion signal HINV of the high logic H.

Figure 39:
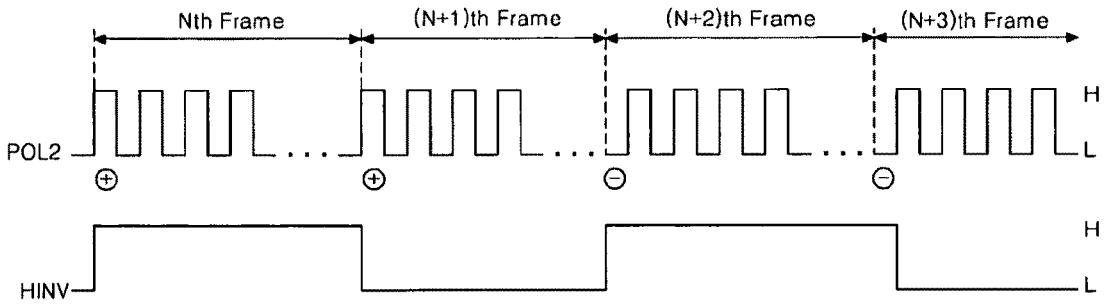
FIG. 39 is a waveform diagram illustrating an exemplary horizontal output inversion signal and an exemplary polarity control signal for controlling the digital/analog converter shown in FIG. 38.

FIG. 39 is an exemplary waveform diagram illustrating a horizontal output inversion signal and a polarity control signal POL2 for controlling the circuit of FIG. 38. As shown in FIGS. 35 and 38, the logic of polarity control signal POL2 is inverted for each horizontal period and the logic of the horizontal output inversion signal HINV is inverted for each frame period. Accordingly, as shown in FIG. 35, the liquid crystal cells are driven in the column direction by a vertical one-dot inversion method V1 dot and are driven in the row direction by a horizontal two-dot inversion method H2 dot. As shown, the polarity of the data voltage is shifted in the row direction by the horizontal output inversion signal for each frame.

Figure 40:
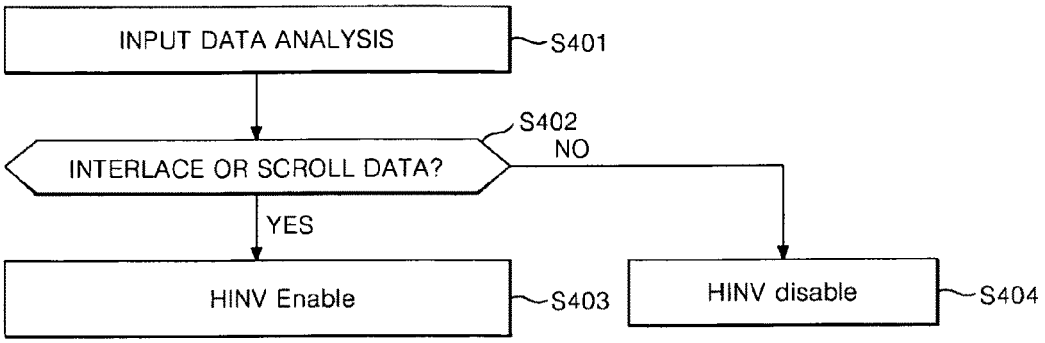
FIG. 40 is a flow chart illustrating an exemplary driving method of a liquid crystal display device according to an eighth embodiment of the present invention.

FIG. 40 is a flow illustrating an exemplary driving method of a liquid crystal display device according to an eighth embodiment of the present invention. As shown in FIG. 40, the exemplary driving method of the liquid crystal display device according to the eighth embodiment of the present invention analyzes input data and determines whether the input data is data with which DC image sticking will likely occur, such interlace data or scroll data. (S401, S402) In the step S402, if the currently input data is deemed to be data with which DC image sticking will likely occur, the present invention enables the horizontal output inversion signal HINV. (S403) In the step S402, if the currently input data is deemed not to generate DC image sticking, the present invention disables the horizontal output inversion signal HINV in order to invert the polarities of the data voltages charged in all of the liquid crystal cells for each frame period. (S404)

Figure 41:
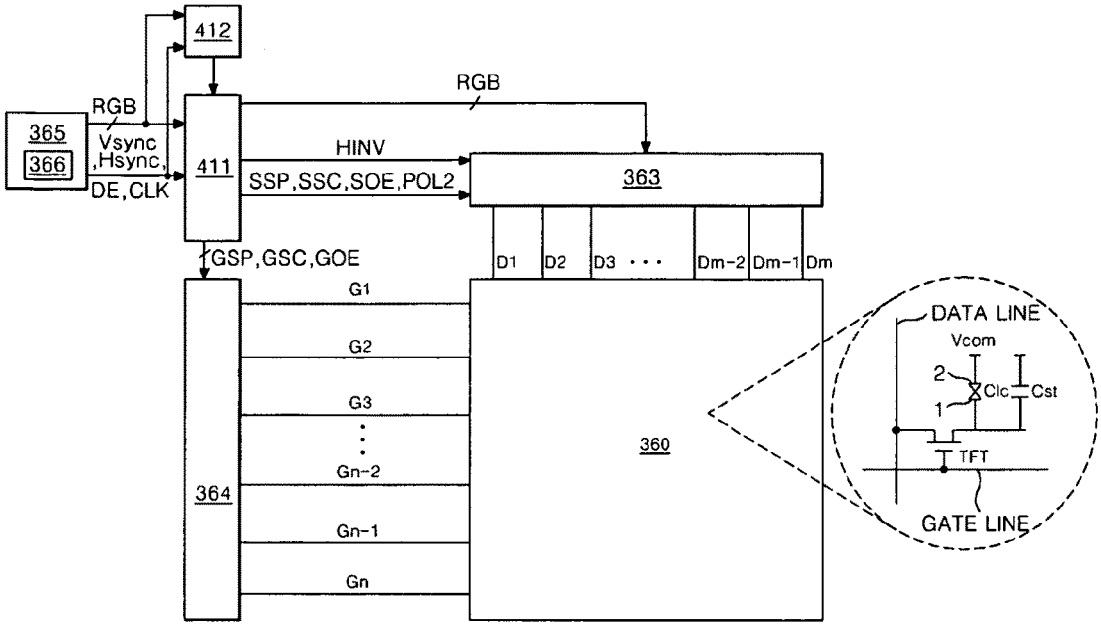
FIG. 41 is a block diagram illustrating an exemplary liquid crystal display device according to the eighth embodiment of the present invention.

FIG. 41 illustrates an exemplary liquid crystal display device according to the eighth embodiment of the present invention. As shown in FIG. 41, the exemplary liquid crystal display device according to the eighth embodiment of the present invention includes a video source 365, a liquid crystal display panel 360, an image analyzing circuit 412, a timing controller 411, a data drive circuit 363, and a gate drive circuit 364. In this exemplary embodiment, the video source 365, the liquid crystal display panel 360, the data drive circuit 363, and the gate drive circuit 364 are substantially the same as those of the foregoing embodiment. Thus, the same reference numerals are given to the same components and a detail description thereof is omitted.

The image analyzing circuit 412 judges whether the digital video data of the currently input image is data with which DC image sticking will likely occur. The image analyzing circuit 412 compares the data between adjacent lines in one frame image and deems the currently input data to be interlace data if the data between the lines is more than a designated threshold value. Further, the image analyzing circuit 412 compares the data of each pixel by the unit of a frame and detects a moving picture in a display image and the speed of the moving picture. If the picture moves at a pre-set speed, the frame data including the moving picture is deemed to be scroll data. From the result of the image analysis, the image analyzing circuit 412 supplies a signal indicating the presence of interlace data or scroll data to the timing controller 411.

The timing controller 411 receives timing signals such as vertical/horizontal synchronization signals Vsync, Hsync, data enables, clock signals CLK, and other signals to generate control signals for controlling the operation timing of the gate drive circuit 364 and the data drive circuit 363. Among the data timing control signals, the polarity control signal POL2 indicates the polarities of the data voltages to be supplied to the liquid crystal cells Clc of the liquid crystal display panel 360. The logic of the polarity control signal POL2 is inverted for each horizontal period, as shown in FIG. 35. The horizontal output inversion signal HINV is generated from the timing controller 411 when data with which DC image sticking will likely occur has been detected by the image analyzing circuit 412 and inverts the polarity of any one of the data voltages supplied to the two horizontally adjacent data lines, as shown in FIGS. 35, 38 and 39, and then shifts the polarity of the data voltage one-dot by one-dot in the horizontal direction for each frame period.

The data drive circuit 363 latches the digital video data RGBodd, RGBeven under control of the timing controller 411 and converts the digital video data into the analog positive/negative gamma compensation voltages. When data with which DC image sticking will likely occur is input, the data drive circuit 363 supplies the data voltages, the polarities of which are changed by the horizontal two-dot and vertical one-dot inversion methods, as shown in FIG. 35, in accordance with the polarity control signal POL2 and the horizontal output inversion signal HINV, to the data lines D1 to Dm. When the data that do not generate DC image sticking is input, the data drive circuit 363 determines the polarities of the data voltages only with the polarity control signal POL2.

FIG. 42 is another exemplary polarity pattern of the data voltages supplied to the liquid crystal display device according to the seventh and eighth embodiments of the present invention. For purposes of example, FIG. 42 illustrates polarities of data voltages supplied to 8×7 liquid crystal cells for the Nth to (N+3)th frame periods. As shown in FIG. 42, for the Nth frame period, positive (+) data voltages are supplied to the liquid crystal cells arranged on the (4j+1)th and (4j+2)th horizontal lines (where j is 0 and a positive integer) R1, R2, R5, R6 in the (4i+1)th and (4i+4)th vertical lines Cl, C4, C5, C8, and negative (−) data voltages are supplied to the liquid crystal cells arranged on the (4j+1)th and (4j+2)th horizontal lines R1, R2, R5, R6 in the (4i+2)th and (4i+3)th vertical lines C2, C3, C6, C7. For the Nth frame period, negative (−) data voltages are supplied to the liquid crystal cells arranged on the (4j+3)th and (4j+4)th horizontal lines R3, R4, R7 in the (4i+1)th and (4i+4)th vertical lines Cl, C4, C5, C8, and positive (+) data voltages are supplied to the liquid crystal cells arranged on the (4j+3)th and (4j+4)th horizontal lines R3, R4, R7 in the (4i+2)th and (4i+3)th vertical lines C2, C3, C6, C7. For the Nth frame period, the first liquid crystal cell group for preventing DC image sticking includes the liquid crystal cells arranged on even-numbered vertical lines, and the second liquid crystal cell group for preventing flicker includes the liquid crystal cells arranged on odd-numbered vertical lines.

For the (N+1)th frame period, positive (+) data voltages are supplied to the liquid crystal cells arranged on the (4j+1)th and (4j+2)th horizontal lines R1, R2, R5, R6 in the (4i+1)th and (4i+2)th vertical lines C1, C2, C5, C6, and negative (−) data voltages are supplied to the liquid crystal cells arranged on the (4j+1)th and (4j+2)th horizontal lines R1, R2, R5, R6 in the (4i+3)th and (4i+4)th vertical lines C3, C4, C7, C8. For the (N+1)th frame period, negative (−) data voltages are supplied to the liquid crystal cells arranged on the (4j+3)th and (4j+4)th horizontal lines R3, R4, R7 in the (4i+1)th and (4i+2)th vertical lines C1, C2, C5, C6, and positive (+) data voltages are supplied to the liquid crystal cells arranged on the (4j+3)th and (4j+4)th horizontal lines R3, R4, R7 in the (4i+3)th and (4i+4)th vertical lines C3, C4, C6, C7. For the (N+1)th frame period, the first liquid crystal cell group for preventing DC image sticking includes the liquid crystal cells arranged on the odd-numbered vertical lines, and the second liquid crystal cell group for preventing flicker includes the liquid crystal cells arranged on the even-numbered vertical lines.

For the (N+2)th frame period, negative (−) data voltages are supplied to the liquid crystal cells arranged on the (4j+1)th and (4j+2)th horizontal lines R1, R2, R5, R6 in the (4i+1)th and (4i+4)th vertical lines C1, C4, C5, C8, and positive (+) data voltages are supplied to the liquid crystal cells arranged on the (4j+1)th and (4j+2)th horizontal lines R1, R2, R5, R6 in the (4i+2)th and (4i+3)th vertical lines C2, C3, C6, C7. For the (N+2)th frame period, positive (+) data voltages are supplied to the liquid crystal cells arranged on the (4j+3)th and (4j+4)th horizontal lines R3, R4, R7 in the (4i+1)th and (4i+4)th vertical lines C1, C4, C5, C8, and negative (−) data voltages are supplied to the liquid crystal cells arranged on the (4j+3)th and (4j+4)th horizontal lines R3, R4, R7 in the (4i+2)th and (4i+3)th vertical lines C2, C3, C6, C7. For the (N+2)th frame period, the first liquid crystal cell group for preventing DC image sticking includes the liquid crystal cells arranged on the even-numbered vertical lines, and the second liquid crystal cell group for preventing flicker includes the liquid crystal cells arranged on the odd-numbered vertical lines.

For the (N+3)th frame period, negative (−) data voltages are supplied to the liquid crystal cells arranged on the (4j+1)th and (4j+2)th horizontal lines R1, R2, R5, R6 in the (4i+1)th and (4i+2)th vertical lines C1, C2, C5, C6, and positive (+) data voltages are supplied to the liquid crystal cells arranged on the (4j+1)th and (4j+2)th horizontal lines R1, R2, R5, R6 in the (4i+3)th and (4i+4)th vertical lines C3, C4, C7, C8. For the (N+3)th frame period, positive (+) data voltages are supplied to the liquid crystal cells arranged on the (4j+3)th and (4j+4)th horizontal lines R3, R4, R7 in the (4i+1)th and (4i+2)th vertical lines C1, C2, C5, C6, and negative (−) data voltages are supplied to the liquid crystal cells arranged on the (4j+3)th and (4j+4)th horizontal lines R3, R4, R7 in the (4i+3)th and (4i+4)th vertical lines C3, C4, C7, C8. For the (N+3)th frame period, the first liquid crystal cell group for preventing DC image sticking includes the liquid crystal cells arranged on the odd-numbered vertical lines, and the second liquid crystal cell group for preventing flicker includes the liquid crystal cells arranged on the even-numbered vertical lines. The polarity of the data voltage of FIG. 42 is controlled by the polarity control signal POL2, the logic of which is inverted every two horizontal periods, and the horizontal output inversion signal HINV, the logic of which is inverted for each frame period.

Figure 43A:
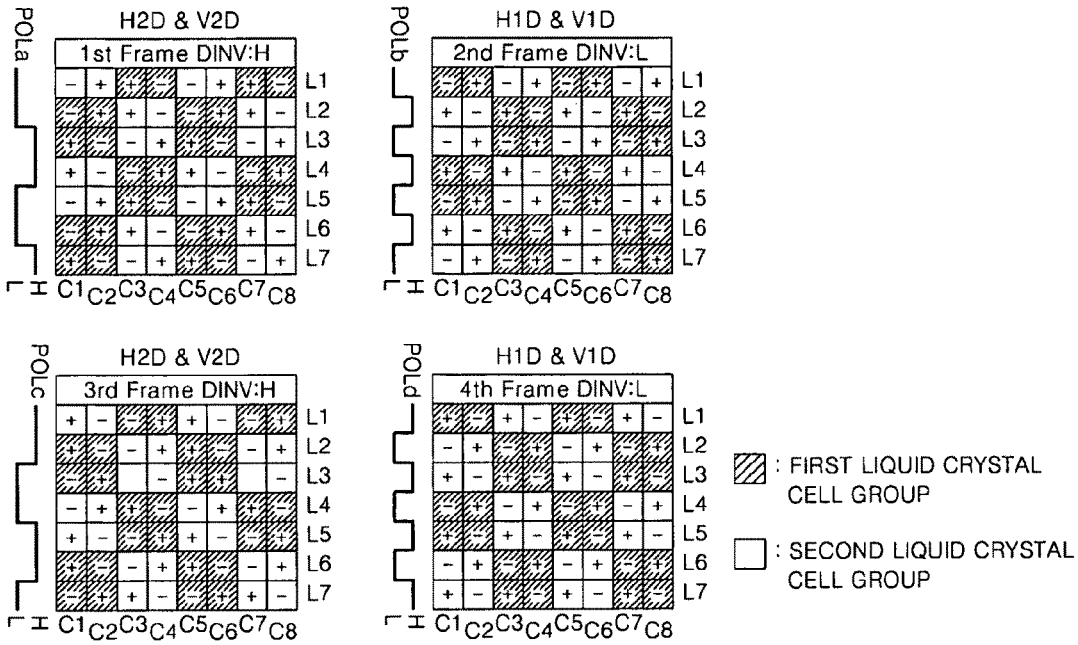
FIGS. 43A to 45B are diagrams illustrating various exemplary polarity patterns of a data voltage according to a ninth embodiments of the present invention.

FIGS. 43A to 45B illustrate various exemplary polarity patterns of data voltages supplied to a liquid crystal display device according to a ninth embodiment of the present invention. As shown in FIGS. 43A and 43B, for (4i+1)th frame period (where i is 0 and a positive integer), the first liquid crystal cell group includes liquid crystal cells Clc disposed on (4i+1)th and (4i+2)th vertical lines Cl, C2, C5, C6 in (4i+2)th and (4i+3)th horizontal lines L2, L3, L6, L7, and includes liquid crystal cells Clc disposed on (4i+3)th and (4i+4)th vertical lines C3, C4, C7, C8 in (4i+1)th and (4i+4)th horizontal lines L1, L4, L5. The second liquid crystal cell group is arranged between the first liquid crystal cell groups in vertical and horizontal directions, and includes liquid crystal cells Clc disposed on (4i+3)th and (4i+4)th vertical lines C3, C4, C7, C8 in (4i+2)th and (4i+3)th horizontal lines L2, L3, L6, L7 and liquid crystal cells Clc disposed on (4i+1)th and (4i+2)th vertical lines C1, C2, C5, C6 in (4i+1)th and (4i+4)th horizontal lines L1, L4, L5.

Each of the first and second liquid crystal cell groups is defined by a unit of 2×2 liquid crystal cells, for example, which are adjacent in the vertical and horizontal directions. The polarities of the adjacent liquid crystal cells within the 2×2 liquid crystal cells are opposites. The liquid crystal cells of the first liquid crystal cell group and the liquid crystal cells of the second liquid crystal cell group adjacent thereto are charged with the data voltages of the same polarities. To this end, the polarity of a first polarity control signal POLa generated during the (4i+1)th frame period is inverted every two horizontal periods corresponding to two horizontal synchronization signals. The data drive circuit outputs the data voltages of the same polarity through two adjacent output channels in response to the first polarity control signal POLa and inverts the polarities of the data voltages for each two output channels in order to supply the data voltages of the same polarity to two horizontally adjacent liquid crystal cells for the (4i+1)th frame period. Further, the data drive circuit inverts the polarities of the data voltages every two horizontal periods in response to the first polarity control signal POLa in order to invert the polarities of the data voltages for each two horizontal periods for the (4i+1)th frame period. For the (4i+1)th frame period, the first and second liquid crystal cell groups are driven by a horizontal two-dot inversion (H2D) method and a vertical two-dot inversion (V2D) method.

For the (4i+2)th frame period, the first liquid crystal cell group includes liquid crystal cells Clc disposed on (4i+3)th and (4i+4)th vertical lines C3, C4, C7, C8 in the (4i+2)th and (4i+3)th horizontal lines L2, L3, L6, L7, and includes liquid crystal cells Clc disposed on (4i+1)th and (4i+2)th vertical lines C1, C2, C5, C6 in the (4i+1)th and (4i+4)th horizontal lines L1, L4, L5. The second liquid crystal cell group is arranged between the first liquid crystal cell groups in vertical and horizontal directions. The second liquid crystal cell group includes liquid crystal cells Clc disposed on (4i+1)th and (4i+2)th vertical lines C1, C2, C5, C6 in (4i+2)th and (4i+3)th horizontal lines L2, L3, L6, L7 and liquid crystal cells Clc disposed on (4i+3)th and (4i+4)th vertical lines C3, C4, C7, C8 in (4i+1)th and (4i+4)th horizontal lines L1, L4, L5.

Each of the first and second liquid crystal cell groups is defined by a unit of 2×2 liquid crystal cells, for example, which are adjacent in the vertical and horizontal directions. The polarities of the adjacent liquid crystal cells within the 2×2 liquid crystal cells are opposites. The liquid crystal cells of the first liquid crystal cell group and the liquid crystal cells of the second liquid crystal cell group adjacent thereto are charged with the data voltages of different polarities from each other. To this end, the polarity of a second polarity control signal POLb generated during the (4i+2)th frame period is inverted for each horizontal period. The data drive circuit outputs the data voltages of the different polarities from each other through adjacent output channels in response to the second polarity control signal POLb and inverts the polarities of the data voltages for each horizontal period in order to invert the polarity of the data voltage for each liquid crystal cell in each of the vertical and horizontal directions during the (4i+2)th frame period. For the (4i+2)th frame period, the first and second liquid crystal cell groups are driven by a horizontal one-dot inversion (H1D) method and a vertical one-dot inversion (V1D) method.

For the (4i+3)th frame period, the first liquid crystal cell group includes liquid crystal cells Clc disposed on (4i+1)th and (4i+2)th vertical lines C1, C2, C5, C6 in (4i+2)th and (4i+3)th horizontal lines L2, L3, L6, L7, and includes liquid crystal cells Clc disposed on (4i+3)th and (4i+4)th vertical lines C3, C4, C7, C8 in (4i+1)th and (4i+4)th horizontal lines L1, L4, L5. The second liquid crystal cell group is arranged between the first liquid crystal cell groups in vertical and horizontal directions. The second liquid crystal cell group includes liquid crystal cells Clc disposed on (4i+3)th and (4i+4)th vertical lines C3, C4, C7, C8 in (4i+2)th and (4i+3)th horizontal lines L2, L3, L6, L7 and liquid crystal cells Clc disposed on (4i+1)th and (4i+2)th vertical lines C1, C2, C5, C6 in (4i+1)th and (4i+4)th horizontal lines L1, L4, L5.

Each of the first and second liquid crystal cell groups is defined by a unit of 2×2 liquid crystal cells, for example, which are adjacent in the vertical and horizontal directions. The polarities of the adjacent liquid crystal cells within the 2×2 liquid crystal cells are opposites. The liquid crystal cells of the first liquid crystal cell group and the liquid crystal cells of the second liquid crystal cell group adjacent thereto are charged with the data voltages of the same polarities. The polarities of the data voltages respectively supplied to the liquid crystal cells of the first and second liquid crystal cell groups for the (4i+3)th frame period are opposite to the polarities of the data voltages generated for the (4i+1)th frame period. To this end, the polarity of a third polarity control signal POLc generated during the (4i+3)th frame period is inverted every two horizontal periods, and a phase thereof is inverted in comparison with the first polarity control signal POLa. The data drive circuit outputs the data voltages of the same polarity through two adjacent output channels in response to the third polarity control signal POLc and inverts the polarities of the data voltages for each two output channels, in order to supply the data voltages of the same polarity to two horizontally adjacent liquid crystal cells for the (4i+3)th frame period. Further, the data drive circuit inverts the polarities of the data voltages for each two horizontal periods in response to the third polarity control signal POLc in order to invert the polarities of the data voltages for each two horizontal periods for the (4i+3)th frame period. For the (4i+

3)th frame period, the first and second liquid crystal cell groups are driven by a horizontal two-dot inversion (H2D) method and a vertical two-dot inversion (V2D) method.

For the (4i+4)th frame period, the first liquid crystal cell group includes liquid crystal cells Clc disposed on (4i+3)th and (4i+4)th vertical lines C3, C4, C7, C8 in (4i+2)th and (4i+3)th horizontal lines L2, L3, L6, L7, and includes liquid crystal cells Clc disposed on (4i+1)th and (4i+2)th vertical lines C1, C2, C5, C6 in (4i+1)th and (4i+4)th horizontal lines L1, L4, L5. The second liquid crystal cell group is arranged between the first liquid crystal cell groups in vertical and horizontal directions. The second liquid crystal cell group includes liquid crystal cells Clc disposed on (4i+1)th and (4i+2)th vertical lines C1, C2, C5, C6 in (4i+2)th and (4i+3)th horizontal lines L2, L3, L6, L7 and liquid crystal cells Clc disposed on (4i+3)th and (4i+4)th vertical lines C3, C4, C7, C8 in (4i+1)th and (4i+4)th horizontal lines L1, L4, L5.

Each of the first and second liquid crystal cell groups is defined by a unit of 2×2 liquid crystal cells, for example, which are adjacent in the vertical and horizontal directions. The polarities of the adjacent liquid crystal cells within the 2×2 liquid crystal cells are opposites. The liquid crystal cells of the first liquid crystal cell group and the liquid crystal cells of the second liquid crystal cell group adjacent thereto are charged with the data voltages of different polarities from each other. The polarities of the data voltages supplied to each of the liquid crystal cells of the first and second liquid crystal cell groups for the (4i+4)th frame period are opposite to the polarities of the data voltages generated for the (4i+2)th frame period. To this end, the polarity of a fourth polarity control signal POLd generated during the (4i+4)th frame period is inverted for each horizontal period and a phase thereof is inverted in comparison with the second polarity control signal POLb. The data drive circuit outputs the data voltages of the different polarities from each other through adjacent output channels in response to the fourth polarity control signal POLd and inverts the polarities of the data voltages for each horizontal period, in order to invert the polarity of the data voltage for each liquid crystal cell in each of the vertical and horizontal directions during the (4i+4)th frame period. For the (4i+4)th frame period, the first and second liquid crystal cell groups are driven by a horizontal one-dot inversion (H1D) method and a vertical one-dot inversion (V1D) method.

Figure 44A:
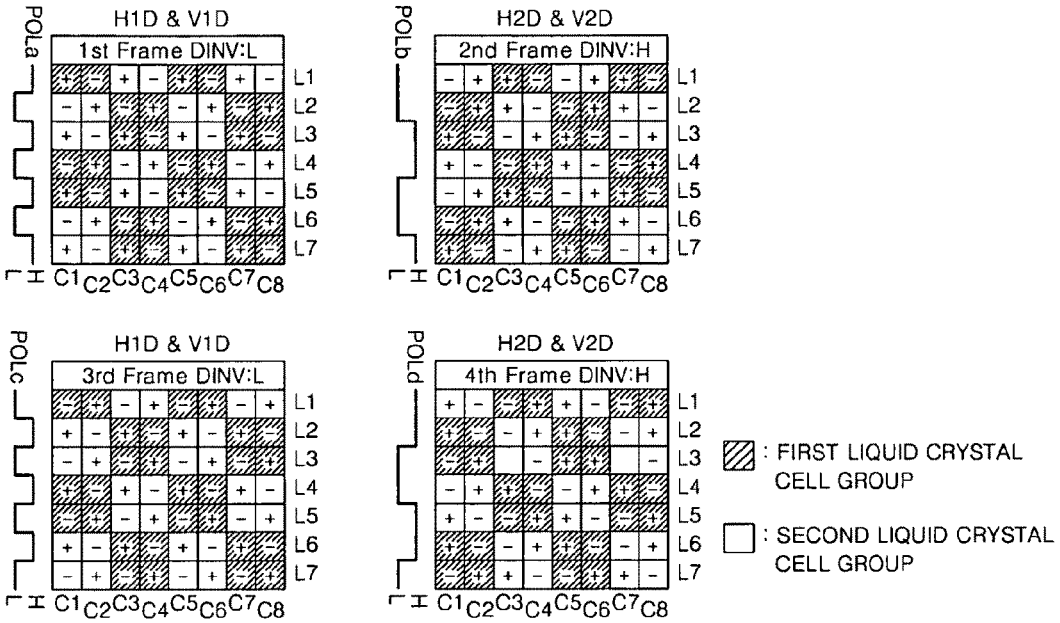
Figure 44B:
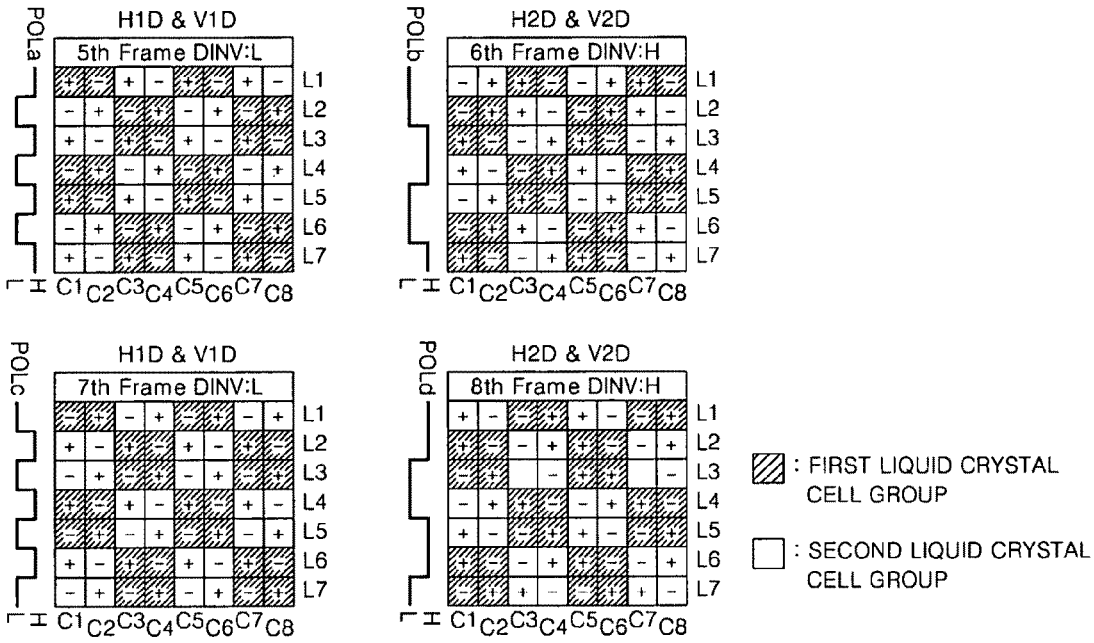

As shown in FIGS. 44A and 44B, for the (4i+1)th frame period, the first liquid crystal cell group includes liquid crystal cells Clc disposed on (4i+3)th and (4i+4)th vertical lines C3, C4, C7, C8 in (4i+2)th and (4i+3)th horizontal lines L2, L3, L6, L7, and includes liquid crystal cells Clc disposed on (4i+1)th and (4i+2)th vertical lines C1, C2, C5, C6 in (4i+1)th and (4i+4)th horizontal lines L1, L4, L5. The second liquid crystal cell group is arranged between the first liquid crystal cell groups in vertical and horizontal directions. The second liquid crystal cell group includes liquid crystal cells Clc disposed on (4i+1)th and (4i+2)th vertical lines C1, C2, C5, C6 in (4i+2)th and (4i+3)th horizontal lines L2, L3, L6, L7 and liquid crystal cells Clc disposed on (4i+3)th and (4i+4)th vertical lines C3, C4, C7, C8 in (4i+1)th and (4i+4)th horizontal lines L1, L4, L5.

Each of the first and second liquid crystal cell groups is defined by a unit of 2×2 liquid crystal cells, for example, which are adjacent in the vertical and horizontal directions. The polarities of the adjacent liquid crystal cells within the 2×2 liquid crystal cells are opposites. The liquid crystal cells of the first liquid crystal cell group and the liquid crystal cells of the second liquid crystal cell group adjacent thereto are charged with the data voltages of the different polarities from each other. To this end, the polarity of a first polarity control signal POLa generated during the (4i+1)th frame period is inverted for each horizontal period. The data drive circuit outputs the data voltages of the different polarities from each other through adjacent output channels in response to the first polarity control signal POLa and inverts the polarities of the data voltages for each horizontal period, in order to invert the polarity of the data voltage for each liquid crystal cell in each of the vertical and horizontal directions during the (4i+1)th frame period. For the (4i+1)th frame period, the first and second liquid crystal cell groups are driven by a horizontal one-dot inversion (H1D) method and a vertical one-dot inversion (V1D) method.

For (4i+2)th frame period, the first liquid crystal cell group includes liquid crystal cells Clc disposed on (4i+1)th and (4i+2)th vertical lines C1, C2, C5, C6 in (4i+2)th and (4i+3)th horizontal lines L2, L3, L6, L7, and includes liquid crystal cells Clc disposed on (4i+3)th and (4i+4)th vertical lines C3, C4, C7, C8 in (4i+1)th and (4i+4)th horizontal lines L1, L4, L5. The second liquid crystal cell group is arranged between the first liquid crystal cell groups in vertical and horizontal directions. The second liquid crystal cell group includes liquid crystal cells Clc disposed on (4i+3)th and (4i+4)th vertical lines C3, C4, C7, C8 in (4i+2)th and (4i+3)th horizontal lines L2, L3, L6, L7 and liquid crystal cells Clc disposed on (4i+1)th and (4i+2)th vertical lines C1, C2, C5, C6 in (4i+1)th and (4i+4)th horizontal lines L1, L4, L5.

Each of the first and second liquid crystal cell groups is defined by a unit of 2×2 liquid crystal cells, for example, which are adjacent in the vertical and horizontal directions. The polarities of the adjacent liquid crystal cells within the 2×2 liquid crystal cells are opposites. The liquid crystal cells of the first liquid crystal cell group and the liquid crystal cells of the second liquid crystal cell group adjacent thereto are charged with the data voltages of the same polarities. To this end, the polarity of a second polarity control signal POLb generated during the (4i+2)th frame period is inverted every two horizontal periods. The data drive circuit outputs the data voltages of the same polarity through two adjacent output channels in response to the second polarity control signal POLb and inverts the polarities of the data voltages for each two output channels in order to supply the data voltages of the same polarity to two horizontally adjacent liquid crystal cells for the (4i+2)th frame period. Further, the data drive circuit inverts the polarities of the data voltages for each two horizontal periods in response to the second polarity control signal POLb in order to invert the polarities of the data voltages for each two horizontal periods for the (4i+2)th frame period. For the (4i+2)th frame period, the first and second liquid crystal cell groups are driven by a horizontal two-dot inversion (H2D) method and a vertical two-dot inversion (V2D) method.

For the (4i+3)th frame period, the first liquid crystal cell group includes liquid crystal cells Clc disposed on (4i+3)th and (4i+4)th vertical lines C3, C4, C7, C8 in (4i+2)th and (4i+3)th horizontal lines L2, L3, L6, L7, and includes liquid crystal cells Clc disposed on (4i+1)th and (4i+2)th vertical lines C1, C2, C5, C6 in (4i+1)th and (4i+4)th horizontal lines L1, L4, L5. The second liquid crystal cell group is arranged between the first liquid crystal cell groups in vertical and horizontal directions. The second liquid crystal cell group includes liquid crystal cells Clc disposed on (4i+1)th and (4i+2)th vertical lines C1, C2, C5, C6 in (4i+2)th and (4i+3)th horizontal lines L2, L3, L6, L7 and liquid crystal cells Clc disposed on (4i+3)th and (4i+4)th vertical lines C3, C4, C7, C8 in (4i+1)th and (4i+4)th horizontal lines L1, L4, L5.

Each of the first and second liquid crystal cell groups is defined by a unit of 2×2 liquid crystal cells, for example, which are adjacent in the vertical and horizontal directions. The polarities of the adjacent liquid crystal cells within the 2×2 liquid crystal cells are opposites. The liquid crystal cells of the first liquid crystal cell group and the liquid crystal cells of the second liquid crystal cell group adjacent thereto are charged with the data voltages of different polarities from each other. The polarities of the data voltages supplied to each of the liquid crystal cells of the first and second liquid crystal cell groups for the (4i+3)th frame period are opposite to the polarities of the data voltages generated for the (4i+1)th frame period. To this end, the polarity of a third polarity control signal POLc generated during the (4i+3)th frame period is inverted for each horizontal period and is generated to have an inverted logic in comparison with the first polarity control signal POLa. The data drive circuit outputs the data voltages of the different polarities from each other through adjacent output channels in response to the third polarity control signal POLc and inverts the polarities of the data voltages for each horizontal period in order to invert the polarity of the data voltage for each liquid crystal cell in each of the vertical and horizontal directions during the (4i+3)th frame period. For the (4i+3)th frame period, the first and second liquid crystal cell groups are driven by a horizontal one-dot inversion (H1D) method and a vertical one-dot inversion (V1D) method.

For the (4i+4)th frame period, the first liquid crystal cell group includes liquid crystal cells Clc disposed on (4i+i)th and (4i+2)th vertical lines C1, C2, C5, C6 in (4i+2)th and (4i+3)th horizontal lines L2, L3, L6, L7, and includes liquid crystal cells Clc disposed on (4i+3)th and (4i+4)th vertical lines C3, C4, C7, C8 in (4i+1)th and (4i+4)th horizontal lines L1, L4, L5. The second liquid crystal cell group is arranged between the first liquid crystal cell groups in vertical and horizontal directions. The second liquid crystal cell group includes liquid crystal cells Clc disposed on (4i+3)th and (4i+4)th vertical lines C3, C4, C7, C8 in (4i+2)th and (4i+3)th horizontal lines L2, L3, L6, L7 and liquid crystal cells Clc disposed on (4i+1)th and (4i+2)th vertical lines C1, C2, C5, C6 in (4i+1)th and (4i+4)th horizontal lines L1, L4, L5.

Each of the first and second liquid crystal cell groups is defined by a unit of 2×2 liquid crystal cells, for example, which are adjacent in the vertical and horizontal directions. The polarities of the adjacent liquid crystal cells within the 2×2 liquid crystal cells are opposites. The liquid crystal cells of the first liquid crystal cell group and the liquid crystal cells of the second liquid crystal cell group adjacent thereto are charged with the data voltages of the same polarities. The polarities of the data voltages respectively supplied to the liquid crystal cells of the first and second liquid crystal cell groups for the (4i+4)th frame period are opposite to the polarities of the data voltages generated for the (4i+2)th frame period. To this end, the polarity of a fourth polarity control signal POLd generated during the (4i+4)th frame period is inverted every two horizontal periods and is generated to have an inverted logic in comparison with the second polarity control signal POLb. The data drive circuit outputs the data voltages of the same polarity through two adjacent output channels in response to the fourth polarity control signal POLd and inverts the polarities of the data voltages for each two output channels in order to supply the data voltages of the same polarity to two horizontally adjacent liquid crystal cells for the (4i+4)th frame period. Further, the data drive circuit inverts the polarities of the data voltages for each two horizontal periods in response to the fourth polarity control signal POLd in order to invert the polarities of the data voltages for each two horizontal periods for the (4i+4)th frame period. For the (4i+4)th frame period, the first and second liquid crystal cell groups are driven by a horizontal two-dot inversion (H2D) method and a vertical two-dot inversion (V2D) method.

Figure 45A:
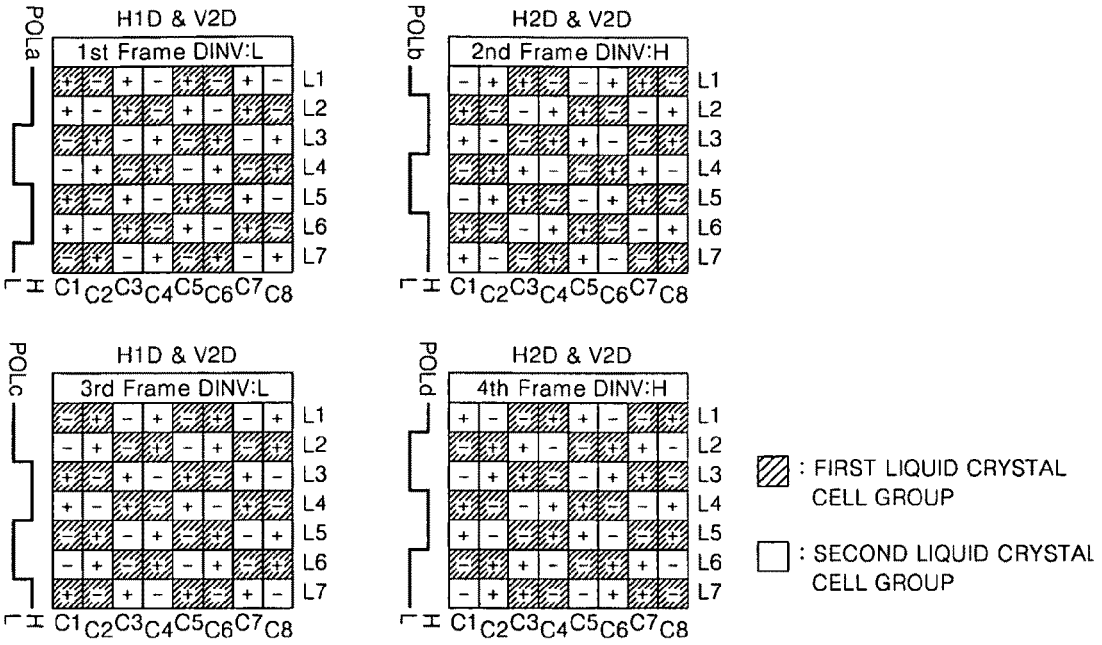
Figure 45B:
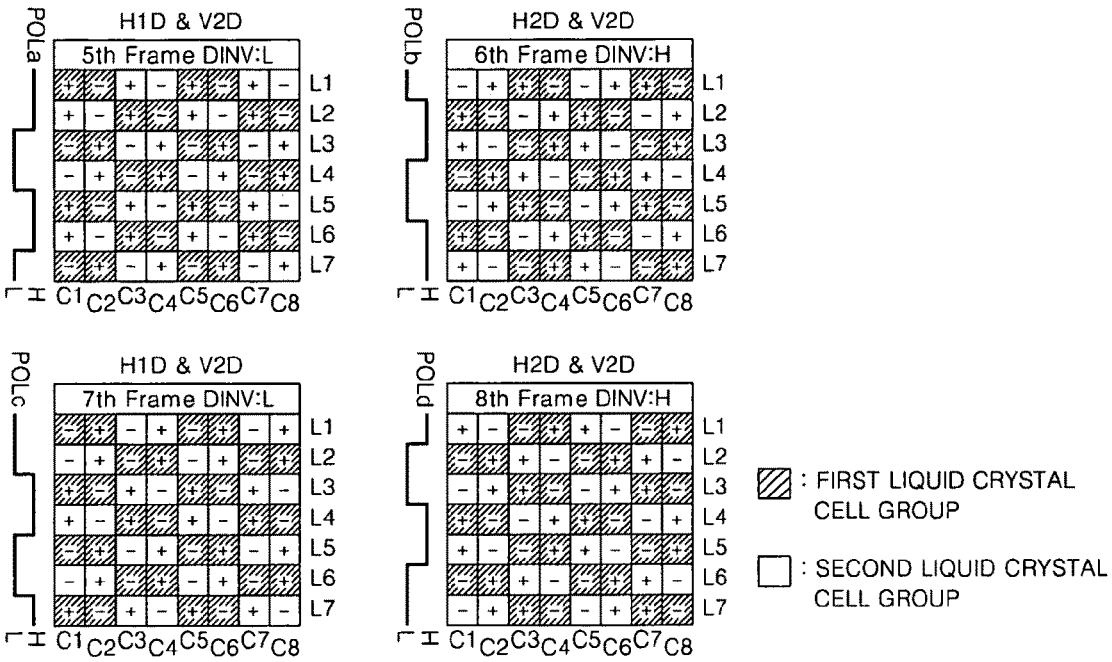

As shown in FIGS. 45A and 45B, for (4i+1)th frame period, the first liquid crystal cell group includes liquid crystal cells Clc disposed on (4i+1)th and (4i+2)th vertical lines C1, C2, C5, C6 in (4i+1)th and (4i+3)th horizontal lines L1, L3, L5, L7, and includes liquid crystal cells Clc disposed on (4i+3)th and (4i+4)th vertical lines C3, C4, C7, C8 in (4i+2)th and (4i+4)th horizontal lines L2, L4, L6. The second liquid crystal cell group is arranged between the first liquid crystal cell groups in vertical and horizontal directions. The second liquid crystal cell group includes liquid crystal cells Clc disposed on (4i+3)th and (4i+4)th vertical lines C3, C4, C7, C8 in (4i+1)th and (4i+3)th horizontal lines L1, L3, L5, L7 and liquid crystal cells Clc disposed on (4i+1)th and (4i+2)th vertical lines C1, C2, C5, C6 in (4i+2)th and (4i+4)th horizontal lines L2, L4, L6.

Each of the first and second liquid crystal cell groups is defined by a unit of 2×1 liquid crystal cells, for example, which are adjacent in the horizontal direction. The polarities of the adjacent liquid crystal cells within the 2×1 liquid crystal cells are opposites. The liquid crystal cells of the first liquid crystal cell group and the liquid crystal cells of the second liquid crystal cell group adjacent thereto are charged with the data voltages of different polarities from each other. To this end, the polarity of a first polarity control signal POLa generated during the (4i+1)th frame period is inverted every two horizontal periods. The data drive circuit supplies the data voltages of different polarities from each other to the horizontally adjacent liquid crystal cells for the (4i+1)th frame period and inverts the polarities of the data voltages in response to the first polarity control signal POLa in order to invert the polarities of the data voltages for each two horizontal periods. For the (4i+1)th frame period, the first and second liquid crystal cell groups are driven by a horizontal one-dot inversion (H1D) method and a vertical two-dot inversion (V2D) method.

For the (4i+2)th frame period, the first liquid crystal cell group includes liquid crystal cells Clc disposed on (4i+3)th and (4i+4)th vertical lines C3, C4, C7, C8 in (4i+1)th and (4i+3)th horizontal lines L1, L3, L5, L7, and includes liquid crystal cells Clc disposed on (4i+1)th and (4i+2)th vertical lines C1, C2, C5, C6 in (4i+2)th and (4i+4)th horizontal lines L2, L4, L6. The second liquid crystal cell group is arranged between the first liquid crystal cell groups in vertical and horizontal directions. The second liquid crystal cell group includes liquid crystal cells Clc disposed on (4i+1)th and (4i+2)th vertical lines C1, C2, C5, C6 in (4i+1)th and (4i+3)th horizontal lines L1, L3, L5, L7 and liquid crystal cells Clc disposed on (4i+3)th and (4i+4)th vertical lines C3, C4, C7, C8 in (4i+2)th and (4i+4)th horizontal lines L2, L4, L6.

Each of the first and second liquid crystal cell groups is defined by a unit of 2×1 liquid crystal cells, for example, which are adjacent in the horizontal direction. The polarities of the adjacent liquid crystal cells within the 2×1 liquid crystal cells are opposites. The liquid crystal cells of the first liquid crystal cell group and the liquid crystal cells of the second liquid crystal cell group adjacent thereto are charged with the data voltages of the different polarities from each other. To this end, the polarity of a second polarity control signal POLb generated during the (4i+2)th frame period is inverted every two horizontal periods and is generated to have a phase difference as much as one horizontal period in comparison with the first polarity control signal POLa. The data drive circuit outputs the data voltages of the different polarities from each other to the horizontally adjacent liquid crystal cells for the (4i+2)th frame period and inverts the polarities of the data voltages in response to the second polarity control signal POLb in order to invert the polarity of the data voltage for each two horizontal periods. For the (4i+2)th frame period, the first and second liquid crystal cell groups are driven by a horizontal two-dot inversion (H2D) method and a vertical two-dot inversion (V2D) method.

For the (4i+3)th frame period, the first liquid crystal cell group includes liquid crystal cells Clc disposed on (4i+1)th and (4i+2)th vertical lines C1, C2, C5, C6 in (4i+1)th and (4i+3)th horizontal lines L1, L3, L5, L7, and includes liquid crystal cells Clc disposed on (4i+3)th and (4i+4)th vertical lines C3, C4, C7, C8 in (4i+2)th and (4i+4)th horizontal lines L2, L4, L6. The second liquid crystal cell group is arranged between the first liquid crystal cell groups in vertical and horizontal directions. The second liquid crystal cell group includes liquid crystal cells Clc disposed on (4i+3)th and (4i+4)th vertical lines C3, C4, C7, C8 in (4i+1)th and (4i+3)th horizontal lines L1, L3, L5, L7 and liquid crystal cells Clc disposed on (4i+1)th and (4i+2)th vertical lines C1, C2, C5, C6 in (4i+2)th and (4i+4)th horizontal lines L2, L4, L6.

Each of the first and second liquid crystal cell groups is defined by a unit of 2×1 liquid crystal cells, for example, which are adjacent in the vertical and horizontal directions. The polarities of the adjacent liquid crystal cells within the 2×1 liquid crystal cells are opposites. The liquid crystal cells of the first liquid crystal cell group and the liquid crystal cells of the second liquid crystal cell group adjacent thereto are charged with the data voltages of different polarities from each other. The polarities of the data voltages respectively supplied to the liquid crystal cells of the first and second liquid crystal cell groups for the (4i+3)th frame period are opposite to the polarities of the data voltages generated for the (4i+1)th frame period. To this end, the polarity of a third polarity control signal POLc generated during the (4i+3)th frame period is inverted every two horizontal periods and is generated to have an inverted logic in comparison with the first polarity control signal POLa. The data drive circuit outputs the data voltages of the same polarity through two adjacent output channels in response to the third polarity control signal POLc and inverts the polarities of the data voltages for each two output channels in order to supply the data voltages of the same polarity to two horizontally adjacent liquid crystal cells for the (4i+3)th frame period. Further, the data drive circuit supplies the data voltages of different polarities from each other to the horizontally adjacent liquid crystal cells for the (4i+3)th frame period and inverts the polarities of the data voltages in response to the third polarity control signal POLc in order to invert the polarities of the data voltages for each two horizontal periods. For the (4i+3)th frame period, the first and second liquid crystal cell groups are driven by a horizontal one-dot inversion (H1D) method and a vertical two-dot inversion (V2D) method.

For the (4i+4)th frame period, the first liquid crystal cell group includes liquid crystal cells Clc disposed on (4i+3)th and (4i+4)th vertical lines C3, C4, C7, C8 in (4i+1)th and (4i+3)th horizontal lines L1, L3, L5, L7, and includes liquid crystal cells Clc disposed on (4i+1)th and (4i+2)th vertical lines C1, C2, C5, C6 in (4i+2)th and (4i+4)th horizontal lines L2, L4, L6. The second liquid crystal cell group is arranged between the first liquid crystal cell groups in vertical and horizontal directions. The second liquid crystal cell group includes liquid crystal cells Clc disposed on (4i+1)th and (4i+2)th vertical lines C1, C2, C5, C6 in (4i+1)th and (4i+3)th horizontal lines L1, L3, L5, L7 and liquid crystal cells Clc disposed on (4i+3)th and (4i+4)th vertical lines C3, C4, C7, C8 in (4i+2)th and (4i+4)th horizontal lines L1, L4, L5.

Each of the first and second liquid crystal cell groups is defined by a unit of 2×1 liquid crystal cells, for example, which are adjacent in the vertical and horizontal directions. The polarities of the adjacent liquid crystal cells within the 2×1 liquid crystal cells are opposites. The liquid crystal cells of the first liquid crystal cell group and the liquid crystal cells of the second liquid crystal cell group adjacent thereto are charged with the data voltages of different polarities from each other. The polarities of the data voltages supplied to each of the liquid crystal cells of the first and second liquid crystal cell groups for the (4i+4)th frame period are opposite to the polarities of the data voltages generated for the (4i+2)th frame period. To this end, the polarity of a fourth polarity control signal POLd generated during the (4i+4)th frame period is inverted for every horizontal periods and is generated to have an inverted polarity in comparison with the second polarity control signal POLb. The data drive circuit supplies the data voltages of different polarities from each other to the horizontally adjacent liquid crystal cells for the (4i+4)th frame period and inverts the polarities of the data voltages in response to the fourth polarity control signal POLd in order to invert the polarities of the data voltages for each two horizontal periods. For the (4i+4)th frame period, the first and second liquid crystal cell groups are driven by a horizontal two-dot inversion (H2D) method and a vertical two-dot inversion (V2D) method.

Figure 46:
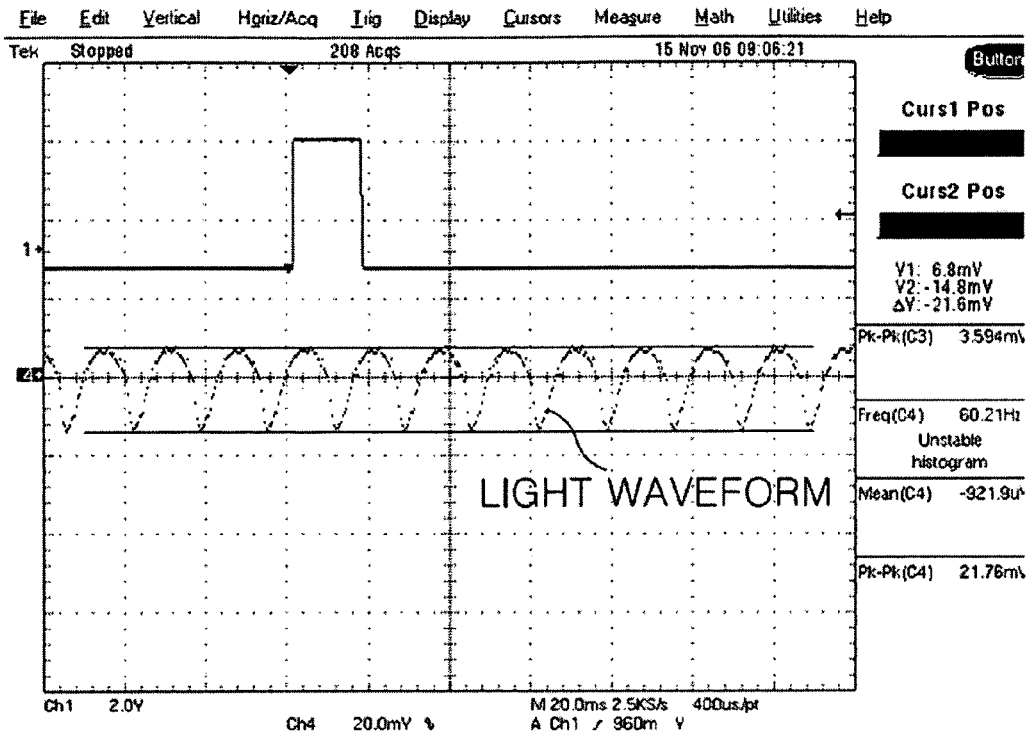
FIG. 46 is a waveform diagram illustrating an exemplary light waveform measured in a liquid crystal display panel to which the data voltages of FIGS. 43A to 45B are supplied.

In an experiment, an optical sensor was installed on a sample liquid crystal display panel and the light waveform was measured as the first liquid crystal cell group was driven at about 30 Hz and the second liquid crystal group was driven at about 60 Hz. As shown in FIG. 46, the light waveform of the liquid crystal display panel was measured to be about 60 Hz due to the second liquid crystal cell group. This was because the light waveform measured in the liquid crystal display panel was determined by a light charge cycle of the second liquid crystal cell group of which the data voltage polarity frequency was faster than the data voltage polarity frequency of the first liquid crystal cell group between two frame periods.

Figure 47:
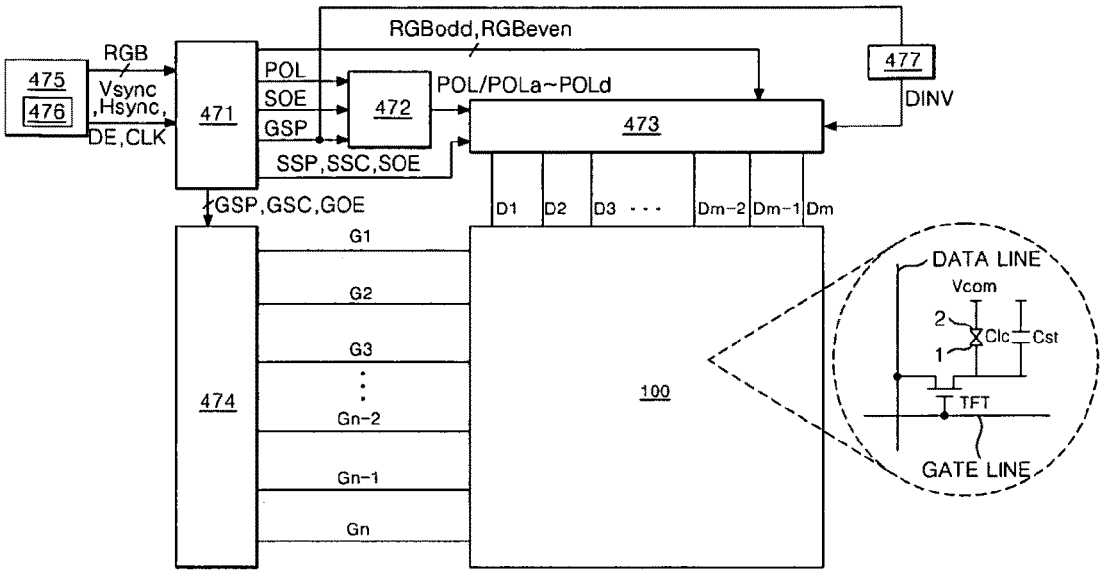
FIG. 47 is a block diagram illustrating an exemplary liquid crystal display device according to a ninth embodiment of the present invention.

FIG. 47 illustrates an exemplary liquid crystal display device according to the ninth embodiment of the present invention. As shown in FIG. 47, the exemplary liquid crystal display device according to the ninth embodiment of the present invention includes a video source 475 including a line memory 476, liquid crystal display panel 100, a timing controller 471, a POL logic circuit 472, a data drive circuit 473, a gate drive circuit 474, and a horizontal output inversion logic circuit 477. In this exemplary embodiment, the video source 475, the liquid crystal panel 100, and the gate driver 474 are substantially the same as those of the foregoing embodiments. Thus, a detail description thereof is omitted.

The timing controller 471 receives timing signals such as vertical/horizontal synchronization signals Vsync, Hsync, data enables, clock signals CLK, and other signals to generate control signals for controlling the operation timing of the POL logic circuit 472, the gate drive circuit 474, and the data drive circuit 473. The control signals include a gate start pulse GSP, a gate shift clock signal GSC, a gate output enable GOE, a source start pulse SSP, a source sampling clock SSC, a source output enable signal SOE, and a reference polarity control signal POL. The POL logic circuit 472 receives the gate start pulse GSP, the source output enable signal SOE, and the reference polarity control signal POL and sequentially outputs the polarity control signals POLa to POLd to prevent residual images and flicker or selectively outputs the same reference polarity control signal POL for each frame. The POL logic circuit 472 may be implemented by the exemplary circuits as shown in FIGS. 13 and 14.

The data drive circuit 473 latches the digital video data RGBodd, RGBeven under control of the timing controller 471. The data drive circuit 473 converts the digital video data into an analog positive/negative gamma compensation voltage in response to the polarity control signal POL/POLa-POLd from the POL logic circuit 472 to generate a positive/negative analog data voltage, thereby supplying the data voltage to the data lines D1 to Dm. The data drive circuit 473 controls the polarity of the data voltage in the vertical direction in response to the polarity control signal POL/POLa-POLd. Further, the data drive circuit 473, in response to a horizontal (H2/H1) inverting signal DINV generated by the horizontal output inversion logic circuit 477, alternately changes the horizontal direction polarity of the data voltage between a horizontal two-dot inversion method (H2) and a horizontal one-dot inversion method (H1).

Figure 43B:
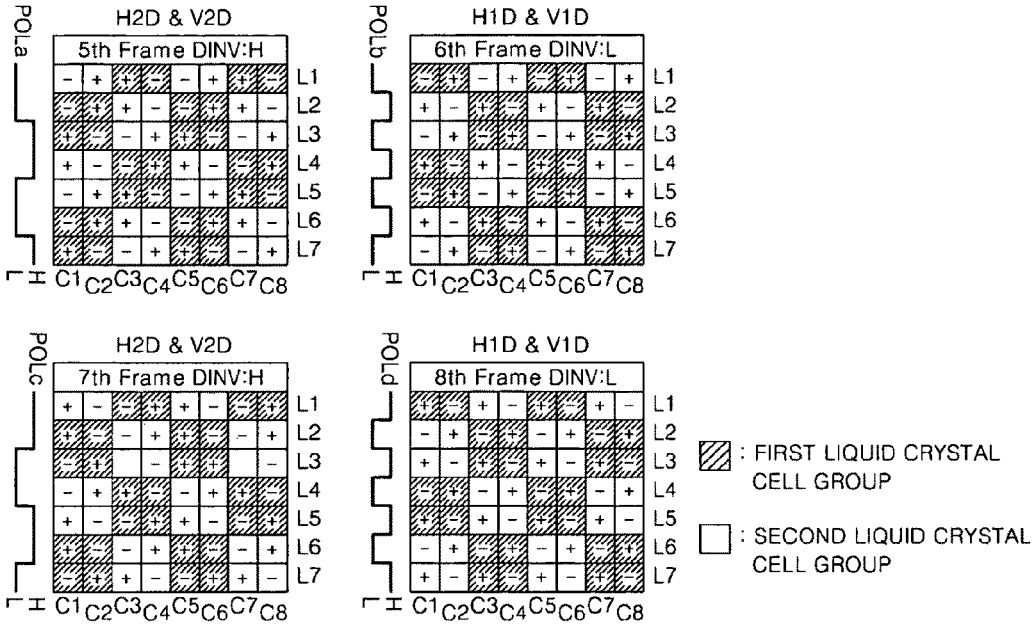
Figure 53:
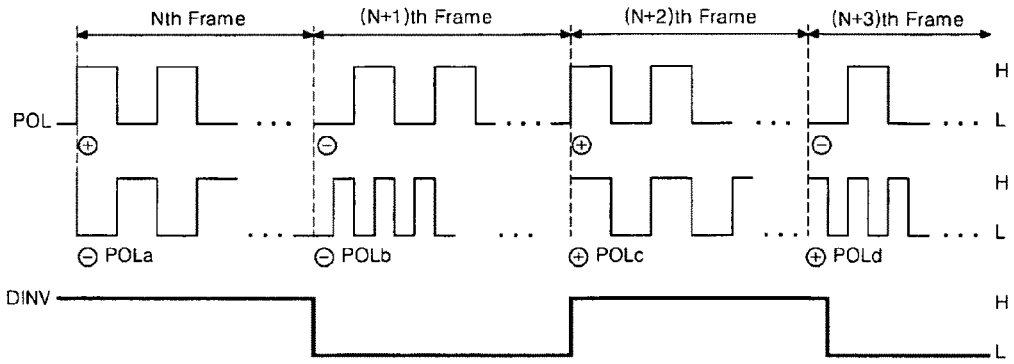
FIGS. 53 to 55 are waveform diagrams illustrating various exemplary polarity control signals and H2/H1 inversion signal.
Figure 54:
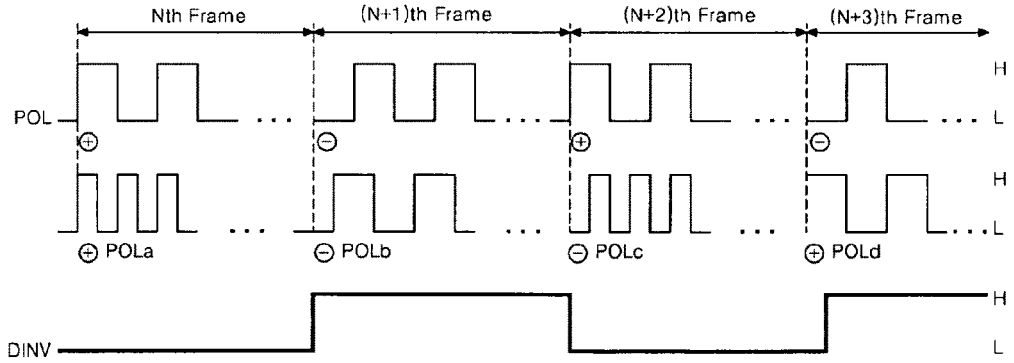
Figure 55:
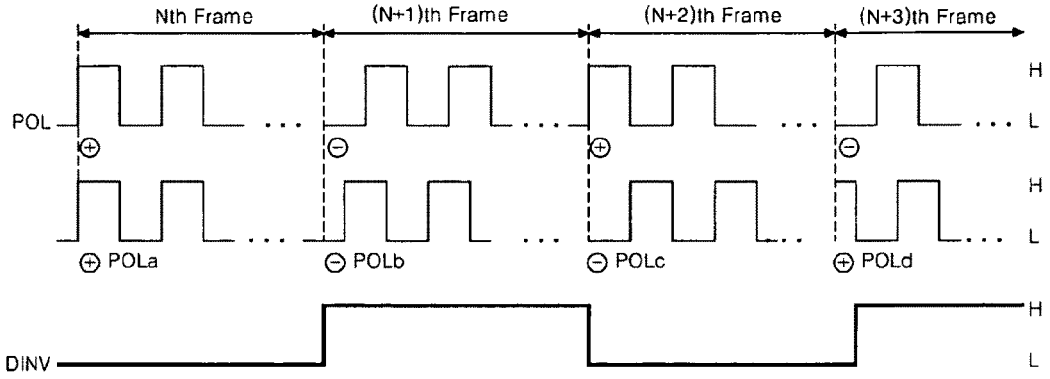

The H2/H1 inverting signal is inverted every one frame period as shown in FIGS. 53 to 55, for example. Thus, the horizontal polarity pattern of the data voltages, which are concurrently output from the data drive circuit 473, is controlled to be different every one horizontal period. For example, the data voltages, which are concurrently output from the data drive circuit 473, may be generated by the horizontal two-dot inversion method (H2) in odd frames and by the horizontal one-dot method (H1) in even frame periods as shown in FIGS. 43A and 43B, respectively. In addition, the data voltages, which are concurrently output from the data drive circuit 473, may be generated by the horizontal one-dot inversion method (H1) in odd frames and by the horizontal two-dot inversion method (H2) in even frames as shown in FIGS. 44A and 44B, respectively.

The horizontal output inversion logic circuit 477 generates H2/H1 inversion signal DINV, the logic of which is inverted whenever each gate start pulse GSP is input in response to the gate start pulse GSP from the timing controller 471. The logic of H2·H1 inversion signal DINV inverted every one frame period as shown in FIGS. 53-55 since the gate start pulse GSP is generated once concurrently with the start of the one frame period during the frame period. The POL logic circuit 472 may be incorporated into the timing controller 471.

Figure 48:
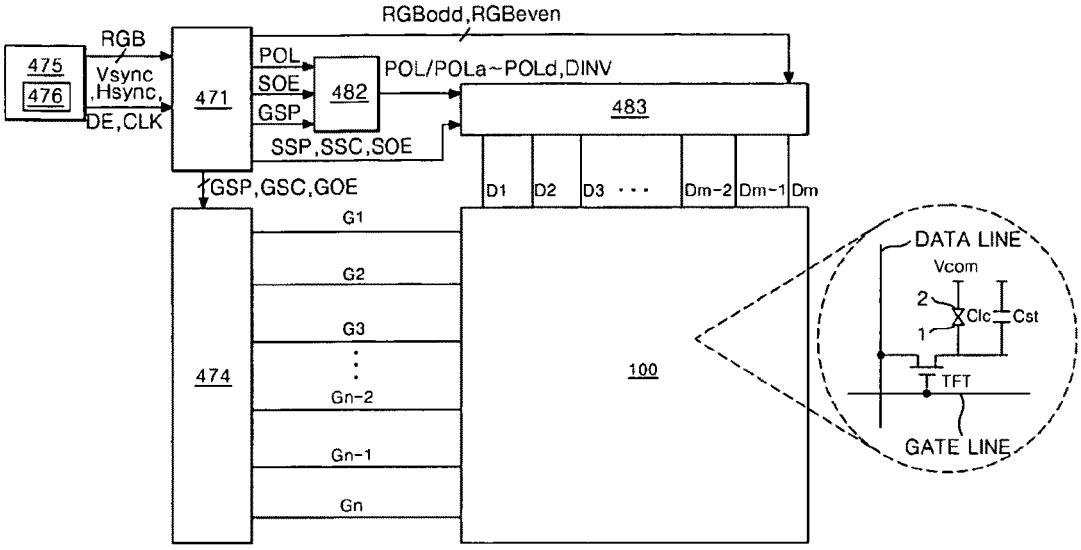
FIG. 48 is a block diagram illustrating an exemplary liquid crystal display device according to a tenth embodiment of the present invention.
Figure 49:
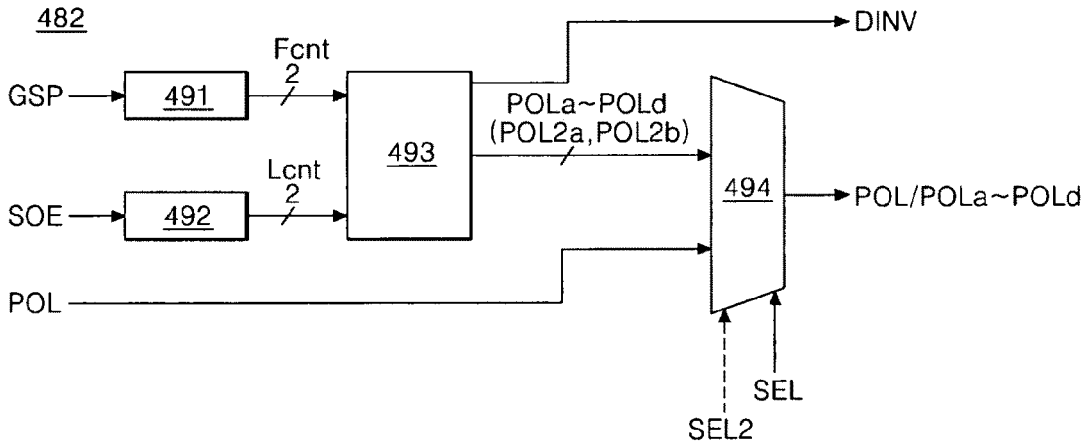
FIG. 49 is a block diagram illustrating an exemplary POL logic circuit shown in FIG. 48.

FIGS. 48 and 49 illustrate an exemplary liquid crystal display device according to a tenth embodiment of the present invention. As shown in FIG. 48, the exemplary liquid crystal display device according to the tenth embodiment of the present invention includes a liquid crystal display panel 100, a timing controller 471, a POL logic circuit 482, a data drive circuit 483, and a gate drive circuit 474. In this exemplary embodiment, the liquid crystal display panel 100, the timing controller 471, and the gate drive circuit 474 are substantially the same as those of the foregoing embodiments. Thus, the same reference numerals are given to the same components and a detail description thereof is omitted.

The POL logic circuit 482 receives the gate start pulse GSP, the source output enable signal SOE, and the reference polarity control signal POL, and sequentially outputs the polarity control signals POLa to POLd to prevent residual images and flicker or selectively outputs the same reference polarity control signal POL for each frame. Further, the POL logic circuit 482 outputs a horizontal output (H2/H1) inversion signal DINV for controlling a cycle with which the polarities of the data voltages are inverted in the horizontal direction.

The data drive circuit 483 latches the digital video data RGBodd, RGBeven under control of the timing controller 471 and converts the digital video data into an analog positive/negative gamma compensation voltage in response to the polarity control signal POL/POLa-POLd from the POL logic circuit 482 to generate a positive/negative analog data voltage and then supplies the data voltage to the data lines D1 to Dm. The data drive circuit 473 inverts the polarity of the data voltage for each horizontal period or every two horizontal periods in response to the polarity control signal POL/POLa-POLd from the POL logic circuit 482. Further, the data drive circuit 483 inverts the polarities of the data voltages to be supplied to the adjacent data lines in response to the H2/H1 inversion signal DINV from the POL logic circuit 482, or inverts the polarities of the data voltages for each two data lines.

FIG. 49 is an exemplary circuit diagram illustrating the POL logic circuit 482. As shown in FIG. 49, the POL logic circuit 482 includes a frame counter 491, a line counter 492, a POL generation circuit 493, and a multiplexer 494.

The frame counter 491 outputs a frame count information Fcnt indicating the number of frames of a picture that is to be displayed in the liquid crystal display panel 100 in response to the gate start pulse GSP that is generated once for one frame period at the same time as a start of the frame period. The frame count information Fcnt is generated as a 2-bit information, for example, so as to be able to identify each of four frame periods in the case where the polarity pattern of the data voltage is repeated for each four frame periods. The line counter 492 outputs a line count information Lcnt indicating a horizontal line that is to be displayed in the liquid crystal display panel 100 in response to the source output enable signal SOE that indicates a point of time when the data voltage is supplied to each horizontal line. The line count information Lcnt is generated as a 2-bit information, for example.

The POL generation circuit 493 generates the H2/H1 inversion signal DINV of 1 bit, the logic of which is inverted for each frame period based on the frame count information Fcnt. The POL generation circuit 493 includes a circuit such as the one shown in FIG. 14 to sequentially generate the polarity control signals POLa to POLd.

Figure 50:
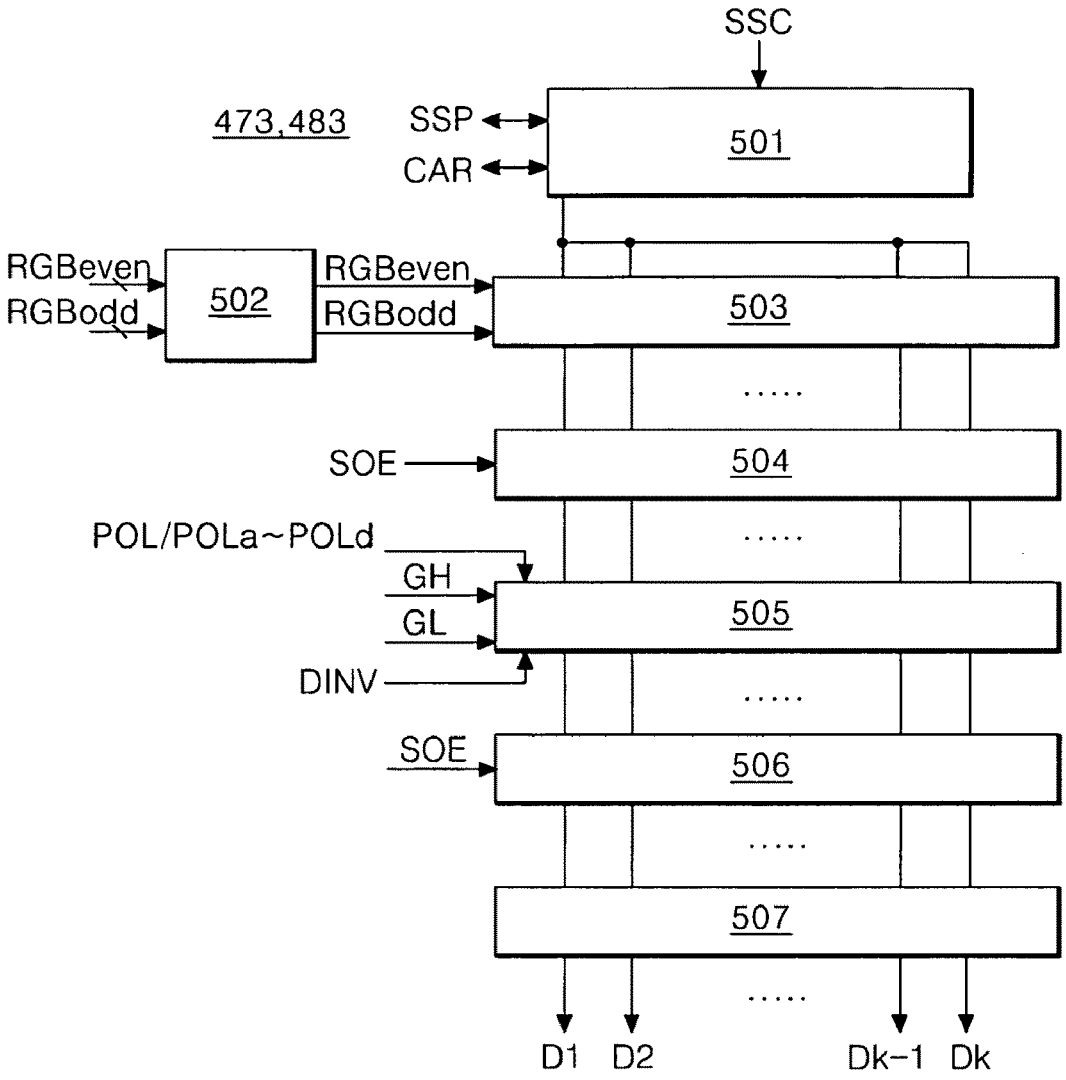
FIG. 50 is a block diagram illustrating an exemplary data drive circuit shown in FIG. 48.

FIG. 50 is an exemplary circuit diagram illustrating the data drive circuit 473, 483. As shown in FIG. 50, the data drive circuit 473, 483 includes a plurality of integrated circuits ("ICs") of which each drives k number of data lines D1 to Dk (where k is an integer less than m). Each IC includes a shift register 501, a data register 502, a first latch 503, a second latch 504, a digital/analog converter (hereinafter, referred to as "DAC") 505, a charge share circuit 506, and an output circuit 507.

The shift register 501 shifts the source start pulse SSP from the timing controller 471 in accordance with the source sampling clock SSC to generate a sampling signal. Further, the shift register 501 shifts the source start pulse SSP to transmit a carry signal CAR to the shift register 501 of the next stage IC. The data register 502 temporarily stores an odd-numbered digital video data RGBodd and an even-numbered digital video data RGBeven, which are divided by the timing controller 471, and supplies the stored data RGBodd, RGBeven to the first latch 503. The first latch 503 samples the digital video data RGBodd, RGBeven from the data register 502 in response to the sampling signal sequentially input from the shift register 501, latches the data RGBodd, RGBeven for each horizontal line, and outputs the data of one horizontal line portion at the same time. The second latch 504 outputs the digital video data which are latched at the same time as the second latch 504 of other ICs for a low logic period of the source output enable signal SOE after latching the data of one horizontal line portion inputted from the first latch 503.

Figure 51:
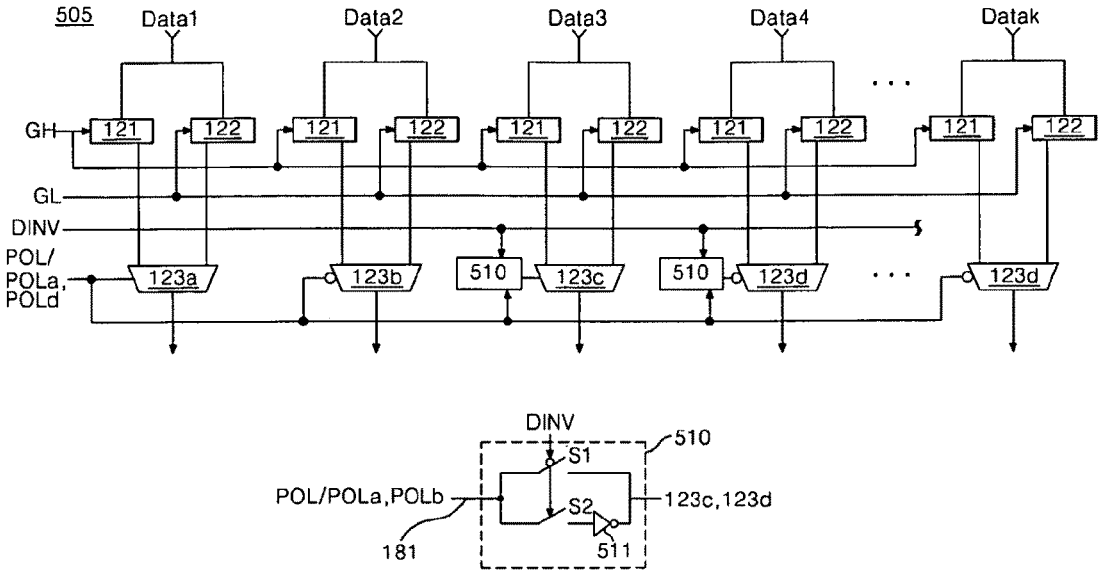
FIG. 51 is a circuit diagram illustrating an exemplary embodiment of the digital/analog converter shown in FIG. 48.
Figure 52:
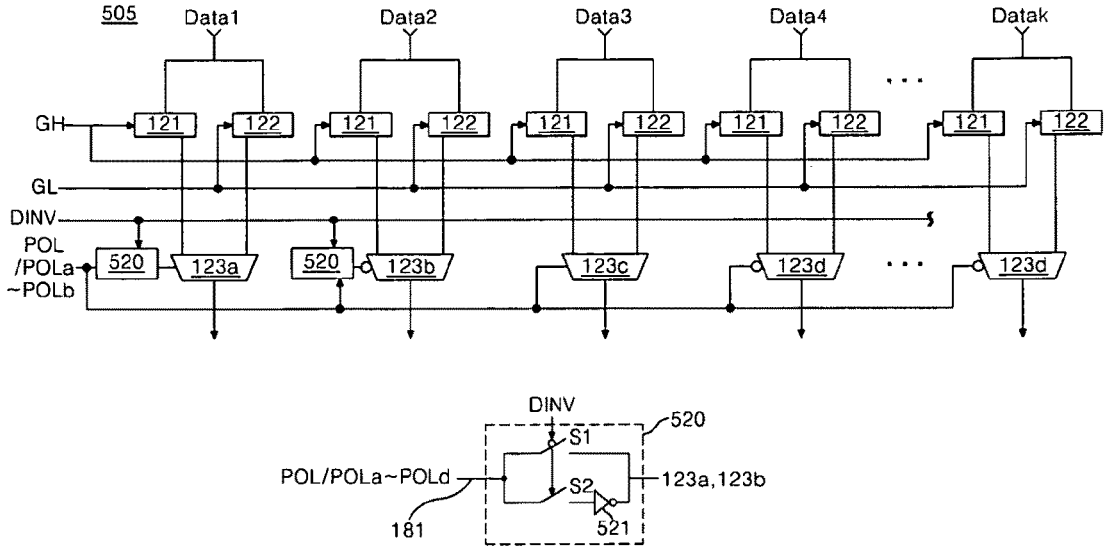
FIG. 52 is a circuit diagram illustrating an alternative embodiment of the digital/analog converter shown in FIG. 48.

The DAC 505 may be configured as shown in FIG. 51 or FIG. 52. The DAC 505 converts the digital video data from the second latch 504 into a positive gamma compensation voltage GH or a negative gamma compensation voltage GL in response to the polarity control signal POL/POLa-POLd and the H2/H1 inversion signal DINV, thereby converting the data into an analog positive/negative data voltage.

The charge share circuit 506 shorts adjacent data output channels for the high logic period of the source output enable signal SOE to output an average value of the adjacent data voltages as a charge share voltage, or supplies common voltages Vcom to the data output channels for the high logic period of the source output enable signal SOE to reduce a rapid change of the positive and negative data voltages. The output circuit 507 includes a buffer and minimizes a signal attenuation of the analog data voltage supplied to the data line D1 to Dk.

FIG. 51 is a circuit diagram illustrating an exemplary embodiment of the DAC 505. The DAC 505 of FIG. 51 outputs the data voltage with the polarity pattern shown in FIGS. 43A and 43B. As shown in FIG. 51, the DAC 505 according to this exemplary embodiment includes a P-decoder PDEC 121 to which a positive gamma compensation voltage GH is supplied, a N-decoder NDEC 122 to which a negative gamma compensation voltage GL is supplied, multiplexers 123*a* to 123*d* which select between the output of the P-decoder 121 and the output of the N-decoder 122 in response to the polarity control signals POL/POLa-POLd, and a horizontal output inversion circuit 510, which inverts a logic of the selection control signal supplied to the control terminal of the multiplexers 123*a* to 123*d* in response to the H2/H1 inversion signal DINV. The P-decoder 121 and the N-decoder 122 operate in substantially the same way as described above for FIG. 12. Thus, a detail description thereof is omitted.

The (4i+1)th multiplexer 123*a* alternately selects between the positive gamma compensation voltage and the negative gamma compensation voltage for each horizontal period or every two horizontal periods in response to the polarity control signal POL/POLa-POLd input to its own non-inversion control terminal and outputs the selected positive/negative gamma compensation voltage as an analog data voltage. The (4i+2)th multiplexer 123*b* alternately selects between the positive gamma compensation voltage and the negative gamma compensation voltage for each horizontal period or every two horizontal periods in response to the polarity control signal POL/POLa-POLd input to its own inversion control terminal and outputs the selected positive/negative gamma compensation voltage as an analog data voltage.

The (4i+3)th multiplexer 123*c* alternately selects between the positive gamma compensation voltage and the negative gamma compensation voltage for each horizontal period or every two horizontal periods in response to the output of the horizontal output inversion circuit 510 input to its own non-inversion control terminal and outputs the selected positive/negative gamma compensation voltage as an analog data voltage. The (4i+4)th multiplexer 123*d* alternately selects between the positive gamma compensation voltage and the negative gamma compensation voltage for each horizontal period or every two horizontal periods in response to the output of the horizontal output inversion circuit 510 input to its own inversion control terminal and outputs the selected positive/negative gamma compensation voltage as an analog data voltage. The horizontal output inversion circuit 510 controls the (4i+3)th and (4i+4)th multiplexers 173*c*, 173*d* in response to the H2/H1 inversion signal DINV so that the data voltages to be supplied to the data lines are output after the polarities thereof are inverted by the horizontal one-dot inversion method H1 or the horizontal two-dot inversion method H2.

The horizontal output inversion circuit 510 includes switch devices S1, S2 and an inverter 511. The horizontal output inversion circuit 510 controls the logic value of the selection control signal supplied to the control terminal of the (4i+3)th and (4i+4)th multiplexers 173*c*, 173*d* in response to the H2/H1 inversion signal DINV. An input terminal of the first switch device S1 is connected to a polarity control signal supply terminal 181 and an output terminal of the first switch device S1 is connected to non-inversion/inversion control terminals of the (4i+3)th and (4i+4)th multiplexers 123*c*, 123*d*. The inversion control terminal of the first switch device S1 is supplied with the H2/H1 inversion signal DINV. An input terminal of the second switch device S2 is connected to the polarity control signal supply terminal 181 and an output terminal of the second switch device S2 is connected to the inverter 511. The non-inversion control terminal of the second switch device S2 is supplied with the H2/H1 inversion signal DINV. The inverter 511 is connected to the output terminal of the second switch device S2 and the non-inversion/inversion control terminals of the (4i+3)th and (4i+4)th multiplexers 123*c*, 123*d*.

If the H2/H1 inversion signal DINV is a high logic, the second switch device S2 is turned on and the first switch device S1 is turned off. Then, the inverted polarity control signals POL/POLa-POLd are input to the non-inversion control terminal of the (4i+3)th multiplexers 123*c* and the inverted polarity control signals POL/POLa-POLd are input to the inversion control terminal of the (4i+4)th multiplexers 123*d*. If the H2/H1 inversion signal DINV is a low logic, the first switch device S1 is turned on and the second switch device S2 is turned off. Then, the original polarity control signals POL/POLa-POLd are input to the non-inversion control terminal of the (4i+3)th multiplexers 123*c* and the original polarity control signals POL/POLa-POLd are input to the inversion control terminal of the (4i+4)th multiplexers 123*d*. Accordingly, if the H2/H1 inversion signal DINV and the polarity control signals POL/POLa-POLd are generated as shown in FIG. 53, a horizontal polarity pattern of the data supplied to the (4i+1)th to (4i+4)th data lines becomes "−++−" for the (4i+1)th frame period, "−+−+−" for the (4i+2)th frame period, "+−−+" for the (4i+3)th frame period, and "+−+−" for the (4i+4)th frame period as shown in FIGS. 43A and 43B.

FIG. 52 is a circuit diagram illustrating an alternative exemplary embodiment of the DAC 505. The DAC 505 of FIG. 52 outputs the data voltage with the polarity pattern shown in FIGS. 44A to 45B. As shown in FIG. 52, the DAC 505 according to the alternative embodiment includes a P-decoder PDEC 121 to which a positive gamma compensation voltage GH is supplied, a N-decoder NDEC 122 to which a negative gamma compensation voltage GL is supplied, multiplexers 123*a* to 123*d* which select the output of the P-decoder 121 and the output of the N-decoder 122 in response to the polarity control signals POL/POLa-POLd, and a horizontal output inversion circuit 520.

The (4i+3)th multiplexer 123*c* alternately selects between the positive gamma compensation voltage and the negative gamma compensation voltage for each horizontal period or every two horizontal periods in response to the polarity control signal POL/POLa-POLd input to its own non-inversion control terminal and outputs the selected positive/negative gamma compensation voltage as an analog data voltage. The (4i+4)th multiplexer 123*d* alternately selects between the positive gamma compensation voltage and the negative gamma compensation voltage for each horizontal period or every two horizontal periods in response to the polarity control signal POL/POLa-POLd input to its own inversion control terminal and outputs the selected positive/negative gamma compensation voltage as an analog data voltage.

The (4i+1)th multiplexer 123*a* alternately selects between the positive gamma compensation voltage and the negative gamma compensation voltage for each horizontal period or every two horizontal periods in response to the output of the horizontal output inversion circuit 520 input to its own non-inversion control terminal and outputs the selected positive/negative gamma compensation voltage as an analog data voltage. The (4i+2)th multiplexer 123*b* alternately selects between the positive gamma compensation voltage and the negative gamma compensation voltage for each horizontal period or every two horizontal periods in response to the output of the horizontal output inversion circuit 520 input to its own inversion control terminal and outputs the selected positive/negative gamma compensation voltage as an analog data voltage. The horizontal output inversion circuit 520 controls the (4i+1)th and (4i+2)th multiplexers 123*a*, 123*b* in response to the H2/H1 inversion signal DINV so that the data voltages to be supplied to the data lines are output after the polarities thereof are inverted by the horizontal one-dot inversion method H1 or the horizontal two-dot inversion method H2.

The horizontal output inversion circuit 520 includes switch devices S1, S2 and an inverter 521. The horizontal output inversion circuit 520 controls the logic value of the selection control signal supplied to the control terminal of the (4i+1)th and (4i+2)th multiplexers 123*a*, 123*b* in response to the H2/H1 inversion signal DINV. An input terminal of the first switch device S1 is connected to a polarity control signal supply terminal 181 and an output terminal of the first switch device S1 is connected to non-inversion/inversion control terminals of the (4i+1)th and (4i+2)th multiplexers 123*a*, 123*b*. The inversion control terminal of the first switch device S1 is supplied with the H2/H1 inversion signal DINV. An input terminal of the second switch device S2 is connected to the polarity control signal supply terminal 181 and an output terminal of the second switch device S2 is connected to the inverter 521. The non-inversion control terminal of the second switch device S2 is supplied with the H2/H1 inversion signal DINV. The inverter 521 is connected to the output terminal of the second switch device S2 and the non-inversion/inversion control terminal of the (4i+1)th and (4i+2)th multiplexers 123*a*, 123*b*.

If the H2/H1 inversion signal DINV is a high logic, the second switch device S2 is turned on and the first switch device S1 is turned off. Then, the inverted polarity control signals POL/POLa-POLd are input to the non-inversion control terminal of the (4i+1)th multiplexers 123*a* and the inverted polarity control signals POL/POLa-POLd are input to the inversion control terminal of the (4i+2)th multiplexers 123*b*. If the H2/H1 inversion signal DINV is a low logic, the first switch device S1 is turned on and the second switch device S2 is turned off. Then, the original polarity control signals POL/POLa-POLd are input to the non-inversion control terminal of the (4i+1)th multiplexers 123*a* and the original polarity control signals POL/POLa-POLd are input to the inversion control terminal of the (4i+2)th multiplexers 123*b*. Accordingly, if the H2/H1 inversion signal DINV and the polarity control signals POL/POLa-POLd are generated as shown in FIGS. 54 and 55, a horizontal polarity pattern of the data supplied to the (4i+1)th to (4i+4)th data lines becomes "+−+−" for the (4i+1)th frame period, "−++−" for the (4i+2)th frame period, "−+−+" for the (4i+3)th frame period, and "+−−+" for the (4i+4)th frame period, as shown in FIGS. 44A to 45B.

Figure 56:
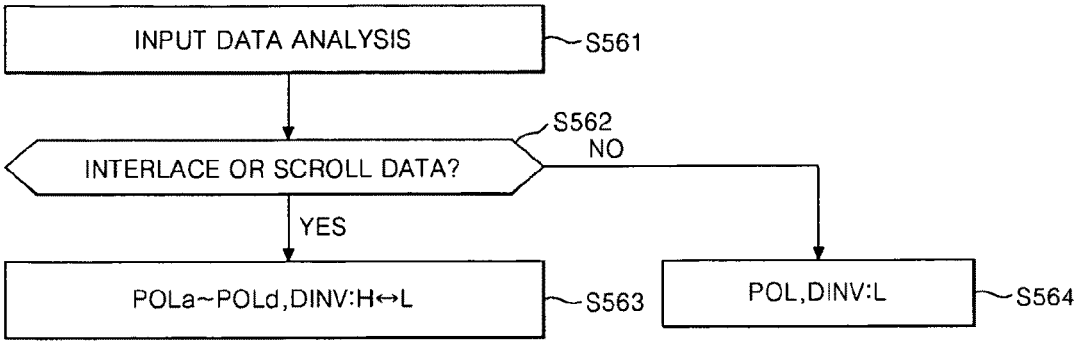
FIG. 56 is a flow chart illustrating an exemplary driving method of a liquid crystal display device according to an eleventh embodiment of the present invention.

FIG. 56 is a flow chart illustrating an exemplary driving method of a liquid crystal display device according to an eleventh embodiment of the present invention. As shown in FIG. 56, the exemplary driving method of the liquid crystal display device according to the eleventh embodiment of the present invention analyzes input data and determines whether the input data is data with which DC image sticking will likely occur, such as interlace data or scroll data. (S561, 5562) In the step S562, if the currently input data is data with which DC image sticking will likely occur, the present invention sequentially generates the first to fourth polarity control signals POLa to POLd for each frame period and controls the data voltage polarity frequency of the first liquid crystal cell group to be lower than the data voltage polarity frequency of the second liquid crystal cell group between two frame periods. Further, the present invention generates the H2/H1 inversion signal DINV, the logic of which is inverted for each frame period and controls the horizontal polarity pattern of the data voltage output from the data drive circuit for each frame period to be different. (S563) In the step S562, if the currently input data is data that do not generate DC image sticking, the present invention generates the reference polarity control signal POL in all frame periods and generates the H2/H1 inversion signal DINV of low logic, thereby controlling the data voltage polarity frequency of all of the liquid crystal cells to be the same. (S564)

Figure 57:
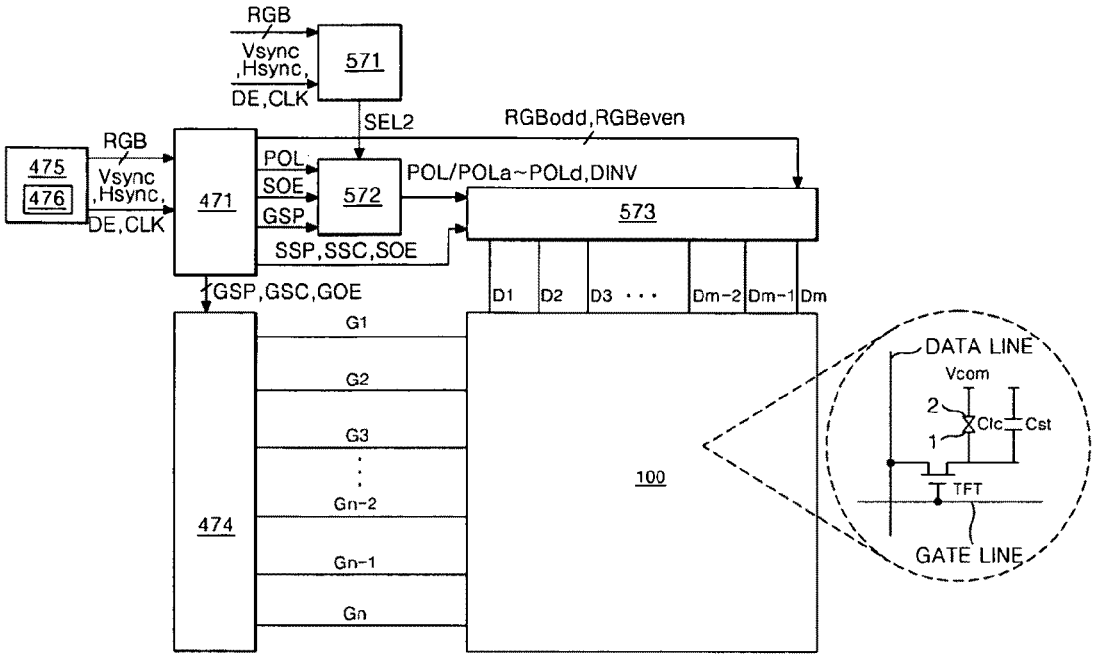
FIG. 57 is a block diagram illustrating an exemplary liquid crystal display device according to the eleventh embodiment of the present invention.

FIG. 57 illustrates an exemplary liquid crystal display device according to the eleventh embodiment of the present invention. As shown in FIG. 57, the exemplary liquid crystal display device according to the eleventh embodiment of the present invention include a video source 475, a liquid crystal display panel 100, an imaging analyzing circuit 571, a timing controller 471, a POL logic circuit 572, a data drive circuit 573, and a gate drive circuit 474. In this exemplary embodiment, the video source 475, the liquid crystal display panel 100, the timing controller 471, and the gate drive circuit 474 are substantially the same as the foregoing embodiments. Thus, the same reference numerals are given to the same components and a detail description thereof is omitted.

The image analyzing circuit 571 determines whether the digital video data of the currently input image is data with which DC will likely occur. The image analyzing circuit 571 compares the data between adjacent lines in one frame image and deems the currently input data to be interlace data if the data between the lines is more than a designated threshold value. Further, the image analyzing circuit 571 compares the data of each pixel by the unit of a frame and detects a moving picture in a display image and the speed of the moving picture. If the picture moves at a pre-set speed, the frame data including the moving picture is deemed to be scroll data. From the result of the image analysis, the image analyzing circuit 571 generates a selection signal SEL2 indicating the presence of interlace data or scroll data and controls the POL logic circuit 572 using of the selection signal SEL2.

The POL logic circuit 572 sequentially generates the first to fourth polarity control signals POLa to POLd for the (4i+1)th to (4i+4)th frame periods in response to the selection signal SEL2 from the image analyzing circuit 571 and inverts the logic of the H2/H1 inversion signal DINV for each frame period. Further, the POL logic circuit 572 transmits the reference polarity control signal POL to the data drive circuit 573 when data that is not interface data or scroll data are input and maintains the logic of the H2/H1 inversion signal DINV to be a low logic in response to the selection signal SEL2.

The data drive circuit 573 latches the digital video data RGBodd, RGBeven under control of the timing controller 471. And, the data drive circuit 573 converts the digital video data into an analog positive/negative gamma compensation voltage in response to the polarity control signal POL/POLa-POLd from the POL logic circuit 572 to generate a positive/negative analog data voltage, thereby supplying the data voltage to the data lines D1 to Dm. The data drive circuit 573 inverts the polarity of the data voltage for each horizontal period or every two horizontal periods in response to the polarity control signal POL/POLa-POLd from the POL logic circuit 572. Further, the data drive circuit 573 controls the polarities of the data voltages to alternate by the horizontal one-dot inversion method H1 and the horizontal two-dot inversion method H2 in response to the H2/H1 inversion signal DINV from the POL logic circuit 572. The image analyzing circuit 571 and the POL logic circuit 572 may be embedded within the timing controller 471.

As described above, the liquid crystal display device and the driving method thereof according to the exemplary embodiments of the present invention controls the data voltage polarity frequency of the data voltage supplied to the first liquid crystal cell group of the liquid crystal display panel to be low so as to prevent DC image sticking and controls the data voltage polarity frequency of the data voltage supplied to the second liquid crystal cell group to be high so as to prevent flicker, thereby increasing the display quality. In addition, the exemplary embodiment of the present invention periodically inserts irregular polarity patterns to reduce the regularity of the locations of the first and second liquid crystal cell groups, thereby minimizing the regular brightness change.

It will be apparent to those skilled in the art that various modifications and variations can be made in the liquid crystal display device and the driving method thereof of the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a liquid crystal display panel including a plurality of data lines, a plurality of gate lines, and a plurality of liquid crystal cells, the plurality of liquid crystal cells associated to a first and second liquid crystal cell groups;

a data drive circuit to supply a data voltage to the data lines in response to a source output enable signal and invert a polarity of the data voltage in response to a polarity control signal;

a gate drive circuit to recognize a start horizontal line in response to a gate start pulse and supply a scan pulse to the gate lines;

a polarity control circuit to generate the polarity control signal for each frame period and to control data voltage polarity frequencies of the first and second liquid crystal cell groups to be different from each other, and a timing controller to generate the source output enable signal and the gate start pulse, wherein the polarity control circuit includes:

a frame counter to count the gate start pulse to generate a frame count information that indicates the number of frames, a line counter to count the source output enable signal to generate a line count information that indicates the number of display lines of the liquid crystal display panel, a polarity control signal generation circuit to generate a first to fourth polarity control signals based on the frame count information and the line count information, and a multiplexer to sequentially select the first to fourth polarity control signals in response to the frame count information, wherein the gate start pulse from the timing controller is input to the gate drive circuit and the frame counter to simultaneously control an operation timing of the gate drive circuit and the frame counter, and wherein the source output enable signal from the timing controller is input to the data drive circuit and the line counter to simultaneously control an operation timing of the data drive circuit and the line counter.

2. The liquid crystal display device according to claim 1, wherein:

for a (4i+1)th frame period (where i is 0 and a positive integer), the first liquid crystal cell group is defined by liquid crystal cells of even-numbered horizontal lines and the second liquid crystal cell group is defined by liquid crystal cells of odd-numbered horizontal lines, for a (4i+2)th frame period, the first liquid crystal cell group is defined by the liquid crystal cells of the odd-numbered horizontal lines and the second liquid crystal cell group is defined by the liquid crystal cells of the even-numbered horizontal lines, for a (4i+3)th frame period, the first liquid crystal cell group is defined by the liquid crystal cells of the even-numbered horizontal lines and the second liquid crystal cell group is defined by the liquid crystal cells of the odd-numbered horizontal lines, for a (4i+4)th frame period, the first liquid crystal cell group is defined by the liquid crystal cells of the odd-numbered horizontal lines and the second liquid crystal cell group is defined by the liquid crystal cells of the even-numbered horizontal lines, the data voltage polarity frequency of the first liquid crystal cell group is lower than the data voltage polarity frequency of the second liquid crystal cell group within two frame periods, and in each frame period, voltage polarities of the vertically adjacent liquid crystal cells of the first liquid crystal cell group are opposite to each other and the voltage polarities of the horizontally adjacent liquid crystal cells of the first liquid crystal cell group are opposite to each other, and the voltage polarities of the vertically adjacent liquid crystal cells of the second liquid crystal cell group are opposite to each other and the voltage polarities of the horizontally adjacent liquid crystal cells of the second liquid crystal cell group are opposite to each other.

3. The liquid crystal display device according to claim 1, wherein:

for a (4i+1)th frame period (where i is 0 and a positive integer), the first liquid crystal cell group is defined by liquid crystal cells of odd-numbered horizontal lines and the second liquid crystal cell group is defined by liquid crystal cells of even-numbered horizontal lines, for a (4i+2)th frame period, the first liquid crystal cell group is defined by the liquid crystal cells of the even-numbered horizontal lines and the second liquid crystal cell group is defined by the liquid crystal cells of the odd-numbered horizontal lines, for a (4i+3)th frame period, the first liquid crystal cell group is defined by the liquid crystal cells of the odd-numbered horizontal lines and the second liquid crystal cell group is defined by the liquid crystal cells of the even-numbered horizontal lines, for a (4i+4)th frame period, the first liquid crystal cell group is defined by the liquid crystal cells of the even-numbered horizontal lines and the second liquid crystal cell group is defined by the liquid crystal cells of the odd-numbered horizontal lines, the data voltage polarity frequency of the first liquid crystal cell group is lower than the data voltage polarity frequency of the second liquid crystal cell group within two frame periods, and in each frame period, voltage polarities of the vertically adjacent liquid crystal cells of the first liquid crystal cell group are opposite to each other and the voltage polarities of the horizontally adjacent liquid crystal cells of the first liquid crystal cell group are opposite to each other, and the voltage polarities of the vertically adjacent liquid crystal cells of the second liquid crystal cell group are opposite to each other and the voltage polarities of the horizontally adjacent liquid crystal cells of the second liquid crystal cell group are opposite to each other.

4. The liquid crystal display device according to claim 1, wherein logic of the first to fourth control signals is inverted every two horizontal periods, to invert the polarity of the data voltage every two horizontal lines of the liquid crystal display panel.

5. The liquid crystal display device according to claim 4, wherein the first polarity control signal is generated in a (4i+1)th frame period, wherein the second polarity control signal is generated in a (4i+2)th frame period having a phase difference of about one horizontal period in comparison with the first polarity control signal, wherein the third polarity control signal is generated in a (4i+3)th frame period having an opposite phase as that of the first polarity control signal, and wherein the fourth polarity control signal is generated in a (4i+4)th frame period having an opposite phase as that of the second polarity control signal.

6. The liquid crystal display device according to claim 5, wherein the first to fourth polarity control signals are sequentially output by the polarity control circuit for each frame period.

7. The liquid crystal display device according to claim 1, wherein the polarity control circuit further includes a first inverter to invert the first polarity control signal to generate the third polarity control signal and to supply the third polarity control signal to the multiplexer, and a second inverter to invert the second polarity control signal to generate the fourth polarity control signal and to supply the fourth polarity control signal to the multiplexer.

8. A method of driving a liquid crystal display device comprising a liquid crystal display panel including a plurality of data lines, a plurality of gate lines, and a plurality of liquid crystal cells, a data drive circuit to supply a data voltage to the data lines in response to a source output enable signal and invert a polarity of the data voltage in response to a polarity control signal, a gate drive circuit to recognize a start horizontal line in response to a gate start pulse and supply a scan pulse to the gate lines, a polarity control circuit to generate the polarity control signal for each frame period, and a timing controller to generate the source output enable signal and the gate start pulse, the method comprising the steps of:

generating a polarity control signal that is different for each frame period so as to variably control a data voltage polarity frequency to be supplied to first and second liquid crystal cell groups that co-exist in a liquid crystal display panel;

supplying a data voltage to data lines of the liquid crystal display panel in response to the polarity control signal; and supplying a scan pulse to gate lines of the liquid crystal display panel, wherein generating a polarity control signal includes:

counting the gate start pulse to generate a frame count information that indicates the number of frames, counting the source output enable signal to generate a line count information that indicates the number of display lines of the liquid crystal display panel, generating a first to fourth polarity control signals based on the frame count information and the line count information, and sequentially selecting the first to fourth polarity control signals in response to the frame count information, wherein the gate start pulse from the timing controller is input to the gate drive circuit and the frame counter to simultaneously control an operation timing of the gate drive circuit and the frame counter, and wherein the source output enable signal from the timing controller is input to the data drive circuit and the line counter to simultaneously control an operation timing of the data drive circuit and the line counter.

9. The method according to claim 8, wherein logic of the first to fourth control signals is inverted every two horizontal periods, to invert the polarity of the data voltage every two horizontal lines of the liquid crystal display panel.

10. The method according to claim 9, wherein the first polarity control signal is generated in a (4i+1)th frame period, wherein the second polarity control signal is generated in a (4i+2)th frame period having a phase difference of about one horizontal period in comparison with the first polarity control signal, wherein the third polarity control signal is generated in a (4i+3)th frame period having an opposite phase as that of the first polarity control signal, and wherein the fourth polarity control signal is generated in a (4i+4)th frame period having an opposite phase as that of the second polarity control signal.

11. The method according to claim 10, wherein the step of generating different polarity control signals for each frame period includes the step of sequentially outputting the first to fourth polarity control signals for each frame period.

* * * * *